US010094604B2

(12) United States Patent
Yamashita

(10) Patent No.: US 10,094,604 B2
(45) Date of Patent: Oct. 9, 2018

(54) AIR-CONDITIONING APPARATUS WITH A PLURALITY OF INDOOR UNITS AND A COOLING AND HEATING MIXED MODE OF OPERATION

(71) Applicant: Mitsubishi Electric Corporation, Tokyo (JP)

(72) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 405 days.

(21) Appl. No.: 14/443,147

(22) PCT Filed: Dec. 2, 2013

(86) PCT No.: PCT/JP2013/082354
§ 371 (c)(1),
(2) Date: May 15, 2015

(87) PCT Pub. No.: WO2014/097870
PCT Pub. Date: Jun. 26, 2014

(65) Prior Publication Data

US 2015/0285545 A1 Oct. 8, 2015

(30) Foreign Application Priority Data

Dec. 20, 2012 (WO) ..... PCT/JP2012/083025

(51) Int. Cl.
*F25B 7/00* (2006.01)
*F25B 49/02* (2006.01)
(Continued)

(52) U.S. Cl.
CPC ..... *F25B 49/02* (2013.01); *F25B 7/00* (2013.01); *F25B 13/00* (2013.01); *F25B 25/005* (2013.01);
(Continued)

(58) Field of Classification Search
CPC ..... F25B 7/00; F25B 13/00; F25B 25/005; F25B 49/02; F25B 2700/1933;
(Continued)

(56) References Cited

U.S. PATENT DOCUMENTS 3,058,724 A * 10/1962 Maudlin ..... F25B 13/00 165/233
5,184,472 A * 2/1993 Guilbault ..... F24J 2/423 62/160
(Continued)

FOREIGN PATENT DOCUMENTS

EP 2363664 A1 9/2011
EP 2428749 A1 3/2012
(Continued)

OTHER PUBLICATIONS

International Search Report of the International Searching Authority dated Mar. 4, 2014 for the corresponding international application No. PCT/JP2013/082354 (and English translation).
(Continued)

*Primary Examiner* — Ljiljana Ciric
(74) *Attorney, Agent, or Firm* — Posz Law Group, PLC

(57) ABSTRACT

An air-conditioning apparatus cools and heats a first heat transfer medium at the same time in a relay unit, and the cooled first heat transfer medium and the heated first heat transfer medium are separately distributed to a plurality of indoor units.

19 Claims, 15 Drawing Sheets

(51) Int. Cl.
*F25B 13/00* (2006.01)
*F25B 25/00* (2006.01)

(52) U.S. Cl.
CPC . *F25B 2313/005* (2013.01); *F25B 2313/0231* (2013.01); *F25B 2313/0314* (2013.01); *F25B 2313/0315* (2013.01); *F25B 2700/1931* (2013.01); *F25B 2700/1933* (2013.01); *F25B 2700/21151* (2013.01)

(58) Field of Classification Search
CPC ..... F25B 2700/1931; F25B 2313/0231; F25B 2313/0314; F25B 2700/21151; F25B 2313/0315; F25B 2313/005
USPC ..... 62/175
See application file for complete search history.

(56) References Cited

U.S. PATENT DOCUMENTS 5,832,735 A * 11/1998 Matsumoto ..... F25B 13/00 62/151
6,338,257 B1 * 1/2002 Chiu ..... F24F 1/42 62/171
8,091,377 B2 * 1/2012 Jeong ..... F25B 13/00 62/159
9,366,452 B2 * 6/2016 Takenaka ..... F24F 3/06
9,534,807 B2 * 1/2017 Takenaka ..... F24F 3/06
9,587,843 B2 * 3/2017 Yamashita ..... F24F 1/02
9,638,447 B2 * 5/2017 Yamashita ..... F25B 13/00
9,759,460 B2 * 9/2017 Yamashita ..... F25B 30/02
9,958,170 B2 * 5/2018 Yamashita ..... F24F 3/06
2002/0017110 A1 * 2/2002 Chiu ..... F24F 1/42 62/305
2011/0138829 A1 * 6/2011 Koh ..... F25B 25/00 62/160
2011/0192184 A1 * 8/2011 Yamashita ..... F24F 1/02 62/196.1
2012/0198874 A1 * 8/2012 Yamashita ..... F24F 3/06 62/160
2012/0297812 A1 * 11/2012 Takata ..... F24F 1/68 62/324.6
2012/0304675 A1 * 12/2012 Motomura ..... F24F 3/06 62/156
2013/0167559 A1 * 7/2013 Kim ..... F25B 49/02 62/56
2013/0312436 A1 * 11/2013 Chen ..... F25B 47/025 62/81
2014/0026601 A1 * 1/2014 Chen ..... F25B 47/025 62/81
2014/0083123 A1 * 3/2014 Yamashita ..... F25B 13/00 62/222
2014/0165635 A1 * 6/2014 Yamashita ..... F25B 13/00 62/160
2014/0182320 A1 * 7/2014 Hatomura ..... F25B 13/00 62/278
2014/0223940 A1 * 8/2014 Morimoto ..... F25B 49/027 62/183
2015/0247661 A1 * 9/2015 Ishimura ..... F25B 13/00 62/225
2015/0300714 A1 * 10/2015 Ishimura ..... F25B 13/00 62/225
2016/0238273 A1 * 8/2016 Takenaka ..... F24F 3/06
2017/0167761 A1 * 6/2017 Ikeda ..... F25B 13/00

FOREIGN PATENT DOCUMENTS

JP H05-280818 A 10/1993
JP H06-082110 A 3/1994
JP H08-338667 A 12/1996
JP H09-264619 A 10/1997
JP 2000-257800 A 9/2000
JP 2001-289465 A 10/2001
JP 2003-343936 A 12/2003
JP 2005-140444 A 6/2005
JP 2008-075948 A 4/2008
JP 2008-101895 A 5/2008
JP 2009-085474 A 4/2009
JP 2011-047607 A 3/2011
WO 2010/049998 A1 5/2010
WO 2012/042573 A1 4/2012

OTHER PUBLICATIONS

Office Action dated Aug. 11, 2015 in the corresponding JP application No. 2014-553062 (with English Translation).
Extended European Search Report dated Jun. 27, 2016 in the corresponding EP patent application No. 13866281.2.

* cited by examiner

AIR-CONDITIONING APPARATUS WITH A PLURALITY OF INDOOR UNITS AND A COOLING AND HEATING MIXED MODE OF OPERATION

CROSS REFERENCE TO RELATED APPLICATIONS

This application is a U.S. national stage application of International Application No. PCT/JP2013/082354 filed on Dec. 2, 2013, which claims priority to International Application No. PCT/JP2012/083025 filed on Dec. 20, 2012, the disclosures of which are incorporated herein by reference.

TECHNICAL FIELD

The present invention relates to an air-conditioning apparatus to be used as, for example, a multi-air-conditioning apparatus for building.

BACKGROUND ART

Some air-conditioning apparatuses such as multi-air-conditioning apparatuses for building are configured to circulate a refrigerant, for example between an outdoor unit installed outdoors for serving as a heat source unit and indoor units located inside the rooms, to perform a cooling operation or heating operation. More specifically, the refrigerant transfers heat to air to heat the air or removes heat from the air to cool the air, and such heated or cooled air is utilized to heat or cool the space to be air-conditioned. In such a type of air-conditioning apparatus, for example a hydrofluorocarbon (HFC)-based refrigerant is often employed. In addition, air-conditioning apparatuses that employ a natural refrigerant such as carbon dioxide ($CO_2$) have also been proposed.

Air-conditioning apparatuses differently configured, typically represented by a chiller system, have also been developed. In this type of air-conditioning apparatus, cooling energy or heating energy is generated in the heat source unit installed outdoors, and a heat transfer medium such as water or antifreeze solution is heated or cooled with a heat exchanger provided in the outdoor unit.

Then the heat transfer medium is conveyed to the indoor unit located in the region to be air-conditioned, such as a fan coil unit or a panel heater, to cool or heat the region to be air-conditioned (see, for example, Patent Literature 1).

In addition, an outdoor-side heat exchanger, called exhaust heat collection chiller, is known in which the outdoor unit and the indoor units are connected via four water pipes, and cooled or heated water is supplied at the same time to allow each of the indoor units to select cooling or heating operation as desired (see, for example, Patent Literature 2).

An air-conditioning apparatus is also known in which a heat exchanger for heat exchange between the refrigerant and the heat transfer medium is located in the vicinity of each indoor unit, and the heat transfer medium is supplied from the heat exchanger to the indoor unit (see, for example, Patent Literature 3).

Further, an air-conditioning apparatus is known in which the outdoor unit and branch units each including a heat exchanger are connected via two pipes, to supply the heat transfer medium to the indoor unit (see, for example, Patent Literature 4).

Still further, an air-conditioning apparatus is known in which the outdoor unit and a relay unit are connected via two refrigerant pipes, and the relay unit and the indoor units are connected via two pipes through which a heat transfer medium such as water circulates, to transfer heat from the refrigerant to the heat transfer medium in the relay unit, thereby allowing the cooling and heating operation to be performed at the same time (see, for example, Patent Literature 5).

CITATION LIST

Patent Literature

Patent Literature 1: Japanese Unexamined Patent Application Publication No. 2005-140444 (page 4, FIG. 1)

Patent Literature 2: Japanese Unexamined Patent Application Publication No. 5-280818 (pages 4, 5, FIG. 1)

Patent Literature 3: Japanese Unexamined Patent Application Publication No. 2001-289465 (pages 5 to 8, FIGS. 1, 2)

Patent Literature 4: Japanese Unexamined Patent Application Publication No. 2003-343936 (page 5, FIG. 1)

Patent Literature 5: International Publication No. 2010/049998 (page 6, FIG. 1)

SUMMARY OF INVENTION

Technical Problem

In the conventional air-conditioning apparatuses such as the multi-air-conditioning apparatus for building, the refrigerant is made to circulate as far as the indoor units, and hence the refrigerant may leak into the room. On the other hand, in the air-conditioning apparatus according to Patent Literature 1 and Patent Literature 2, the refrigerant is kept from passing through the indoor unit. Accordingly, the air-conditioning apparatus according to Patent Literature 1 eliminates the likelihood that the refrigerant leaks into the room, however the operation is switchable to only either of cooling and heating. Therefore, simultaneous cooling and heating operation for satisfying different air-conditioning loads for each of the rooms is unable to be performed.

To allow each of the indoor units to select between the cooling and heating operation with the air-conditioning apparatus according to Patent Literature 2, four pipes have to be connected between the outdoor unit and each of the rooms, which makes the installation work complicated. With the air-conditioning apparatus according to Patent Literature 3, each of the indoor units has to have a secondary medium circulation device such as pumps, which leads to an increase not only in cost but also in operation noise, and is hence unsuitable for practical use. In addition, since the heat exchanger is located in the vicinity of the indoor unit, the risk of leakage of the refrigerant into the room or therearound is unable to be eliminated.

With the air-conditioning apparatus according to Patent Literature 4, the refrigerant which has undergone the heat exchange flows into the same flow path as that of the refrigerant yet to perform the heat exchange and hence energy loss is inevitable, and therefore each of a plurality of indoor units connected in the system is unable to make optimal performance. In addition, the branch unit and an extension pipe are connected via two pipes each for cooling and heating, totally four pipes, which is similar to the system in which the outdoor unit and the branch units are connected via four pipes, and therefore the installation work is complicated.

In the air-conditioning apparatus according to Patent Literature 5, the refrigerant is conveyed from the outdoor unit to the relay unit through two refrigerant pipes, and then from the relay unit to each indoor unit through two heat transfer medium pipes, to allow the cooling and heating operation to be performed at the same time. However, in the case where a flammable refrigerant is employed, since the relay unit is installed inside the building, the refrigerant may ignite depending on the location of the relay unit. In the case where a low-density refrigerant such as HFO-1234yf is employed, a refrigerant pipe (extension pipe) having a large diameter has to be employed between the outdoor unit and the relay unit in order to suppress pressure loss in the refrigerant pipe (extension pipe), which leads to degraded workability for installation.

The present invention has been accomplished in view of the foregoing problems, and provides an air-conditioning apparatus that can be efficiently installed. The present invention also provides an air-conditioning apparatus that enables cooling and heating operation to be performed at the same time with two pipes, without introducing the refrigerant pipe into the building for higher safety. Further, the present invention provides an air-conditioning apparatus that eliminates the need to employ a long refrigerant pipe to connect between outside and inside of the building, to thereby reduce the amount of the refrigerant to be employed.

Solution to Problem

In an aspect, the present invention provides An air-conditioning apparatus comprising: an indoor unit installed inside a building at a position that allows the indoor unit to condition air in a space to be air-conditioned and including a use-side heat exchanger; a relay unit configured to be installed in a space not to be air-conditioned different from the space to be air-conditioned; and an outdoor unit installed in an outdoor space outside the building or a space inside the building communicating with the outdoor space, wherein the relay unit and the indoor unit are connected to each other via a first heat transfer medium pipe in which a first heat transfer medium that transports heating energy or cooling energy flows, the outdoor unit and the relay unit are connected to each other via a second heat transfer medium pipe in which a second heat transfer medium that transports heating energy or cooling energy flows, the relay unit includes: a first compressor; a first refrigerant flow switching device; a plurality of first intermediate heat exchangers; a second refrigerant flow switching device associated with each of the plurality of first intermediate heat exchangers; a plurality of first expansion devices that depressurize a first refrigerant that shifts between two phases or turns into a supercritical state during operation; and a second intermediate heat exchanger, the first compressor, the first refrigerant flow switching device, a refrigerant flow path in the plurality of first intermediate heat exchangers, the second refrigerant flow switching device, the plurality of first expansion devices, and a refrigerant flow path in the second intermediate heat exchanger are connected via a first refrigerant pipe in which the first refrigerant that shifts between two phases or turns into a supercritical state flows, to form a first refrigerant circuit, the first heat transfer medium is allowed to circulate through a heat transfer medium flow path in the plurality of first intermediate heat exchangers, a plurality of heat transfer medium feeding devices that feed the first heat transfer medium, and the plurality of use-side heat exchangers, to form a first heat transfer medium circuit, cooling of the first heat transfer medium and heating of the first heat transfer medium are performed at the same time utilizing one or both of the first refrigerant flow switching device and the second refrigerant flow switching device, a heat transfer medium flow switching device is provided between the plurality of first intermediate heat exchangers and the plurality of use-side heat exchangers, the heat transfer medium flow switching device being configured to separately distribute the heated first heat transfer medium and the cooled first heat transfer medium to one or more of a plurality of the indoor units, and the outdoor unit is configured to control a temperature of the second heat transfer medium.

Advantageous Effects of Invention

The air-conditioning apparatus according to the present invention enables a cooling and a heating operation to be performed at the same time with the two heat transfer medium pipes without introducing the refrigerant pipe into the building from outside, and the relay unit that utilizes the refrigerant is not installed in the vicinity of the indoor space, and therefore the refrigerant is kept from leaking into the room. In addition, since the amount of the refrigerant in the relay unit is relatively small, even though a flammable refrigerant leaks out of the relay unit during the operation, the concentration of the refrigerant can only be far below the ignition point. Consequently, the air-conditioning apparatus according to the present invention provides higher safety.

DESCRIPTION OF EMBODIMENTS

Figure 1:
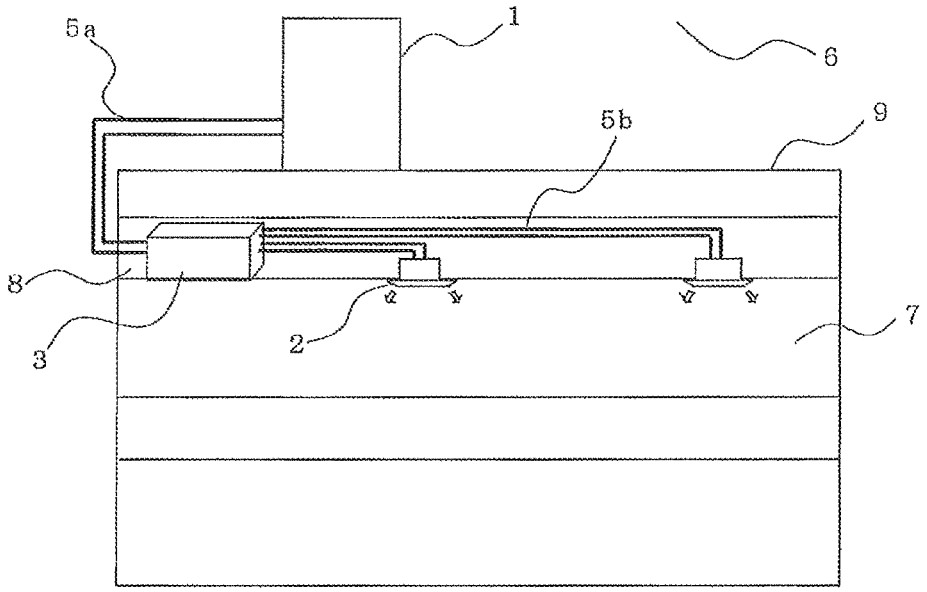
FIG. 1 is a schematic drawing showing an installation example of an air-conditioning apparatus according to Embodiment 1 of the present invention.

Hereafter, Embodiments of the present invention will be described with reference to the drawings. In FIG. 1 and other drawings, the relative sizes of the constituents may be different from the actual ones. In addition, the constituents of the same numeral in different drawings represent the same or corresponding ones, throughout the description. Further, the configurations of the constituents defined in the description are merely exemplary and in no way intended for limiting the configuration.

Embodiment 1

FIG. 1 is a schematic drawing showing an installation example of an air-conditioning apparatus according to Embodiment 1 of the present invention. Referring to FIG. 1, the installation example of the air-conditioning apparatus will be described hereunder. The air-conditioning apparatus is configured to allow selection of a desired operation mode between a cooling mode and a heating mode with respect to each indoor unit, by utilizing a second refrigerant circuit A, a second heat transfer medium circuit B, a first refrigerant circuit C, and a first heat transfer medium circuit D.

The second refrigerant circuit A is used for circulating the second refrigerant. The second heat transfer medium circuit B is used for circulating the second heat transfer medium. The first refrigerant circuit C is used for circulating the first refrigerant. The first heat transfer medium circuit D is used for circulating the first heat transfer medium. The mentioned refrigerant circuits and the heat transfer medium circuits will be subsequently described in detail.

As shown in FIG. 1, the air-conditioning apparatus according to Embodiment 1 includes an outdoor unit 1 which serves as a heat source unit, a plurality of indoor units 2, and a relay unit 3 installed between the outdoor unit 1 and the indoor units 2. The outdoor unit 1 transfers heat to or removes heat from an outdoor space utilizing the second refrigerant, to thereby cool or heat the second heat transfer medium. The relay unit 3 utilizes the first refrigerant to transfer heat to or remove heat from the second heat transfer medium, to thereby cool or heat the first heat transfer medium. The indoor units 2, satisfy the air-conditioning load by utilizing the first heat transfer medium cooled or heated and conveyed from the relay unit 3.

The outdoor unit 1 and the relay unit 3 are connected to each other via a heat transfer medium pipe 5*a* in which the second heat transfer medium flows. The relay unit 3 and each of the indoor units 2 are connected to each other via a heat transfer medium pipe 5*b* in which the first heat transfer medium flows. Cooling energy or heating energy generated in the outdoor unit 1 is distributed to the indoor units 2 via the relay unit 3. The first refrigerant and the second refrigerant have a nature of shifting between two phases or turning to a supercritical state during operation, and the first heat transfer medium and the second heat transfer medium are water, an antifreeze solution, or the like, which does not shift between two phases or turn to a supercritical state during operation.

The relay unit 3 may be separately located from the outdoor unit 1 and the indoor units 2, and may be enclosed in a single casing or a plurality of casings, provided that the casing(s) can be located between the outdoor unit 1 and the indoor units 2. In the case where the relay unit 3 is enclosed in separate casings, those casings may be connected via two, three, or four refrigerant pipes in which the first refrigerant flows, or via two, three, or four heat transfer medium pipes in which the first heat transfer medium flows. In the case where the relay unit 3 is enclosed in separate casings, the casings may be located close to or away from each other.

As shown in FIG. 1, in the air-conditioning apparatus according to Embodiment 1, the outdoor unit 1 and the relay unit 3 are connected to each other via the heat transfer medium pipe 5*a* routed in two lines, and the relay unit 3 and each of the indoor units 2 are connected to each other via the heat transfer medium pipe 5*b* routed in two lines. Thus, in the air-conditioning apparatus according to Embodiment 1, the units (outdoor unit 1, indoor units 2, and the relay unit 3) are connected to each via the pipes (heat transfer medium pipe 5*a* and heat transfer medium pipe 5*b*) each routed only in two lines, which facilitates the installation work.

Here, FIG. 1 illustrates the case where the relay unit 3 is located in a space inside the building 9 but different from the indoor space 7, for example a space behind a ceiling (hereinafter, simply "space 8"). Instead, the relay unit 3 may be located, for example, in a common-use space where an elevator is installed. In addition, although the indoor units 2 shown in FIG. 1 are of a ceiling cassette type having the main body located behind the ceiling and the air outlet exposed in the indoor space 7, the indoor units 2 may be of a wall-mounted type having the main body located inside the indoor space 7, or of a ceiling-embedded type or a ceiling-suspension type having a duct or the like for supplying air into the indoor space 7. The indoor units 2 may be of any desired type provided that the heating air or cooling air can be blown into the indoor space 7 to satisfy the air-conditioning load in the indoor space 7.

Further, although FIG. 1 illustrates the case where the outdoor unit 1 is installed in the outdoor space 6, the outdoor unit 1 may be installed in a different location. For example, the outdoor unit 1 may be located in an enclosed space such as a machine room with a ventilation port, or inside the building 9 provided that waste heat can be discharged out of the building 9 through an exhaust duct. Alternatively, a water-cooled type outdoor unit 1 may be employed, to allow the outdoor unit 1 to be installed inside the building 9.

Whereas the relay unit 3 can be installed away from the outdoor unit 1, the relay unit 3 may be installed either outside the building 9 or in the vicinity of the outdoor unit 1. In addition, the number of units of the outdoor unit 1, the indoor units 2, and the relay unit 3 connected to each other is not limited to the number illustrated in FIG. 1, but may be determined depending on the condition of the building 9 in which the air-conditioning apparatus according to Embodiment 1 is to be installed.

Figure 2:
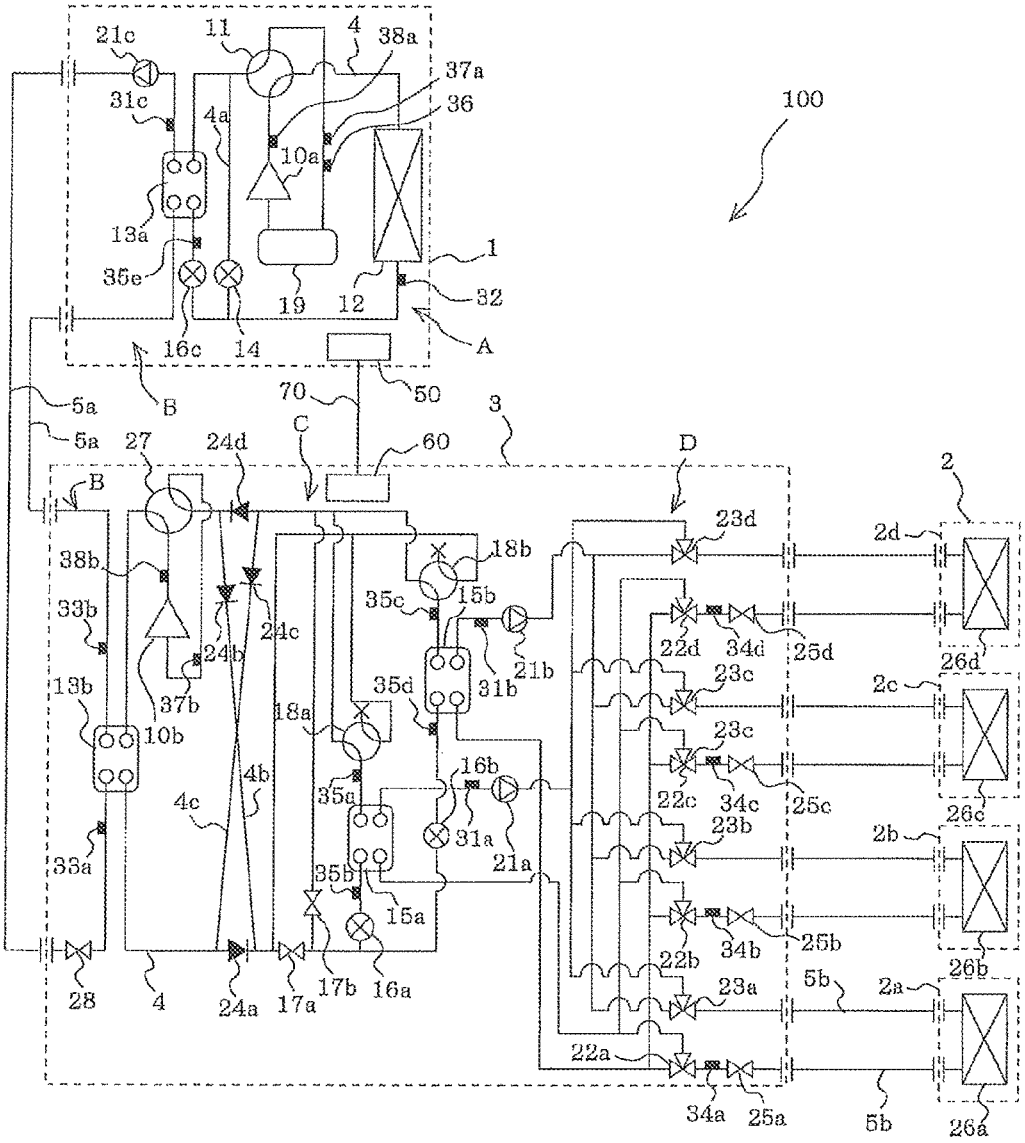
FIG. 2 is a schematic circuit diagram showing a circuit configuration of the air-conditioning apparatus according to Embodiment 1 of the present invention.

FIG. 2 is a schematic circuit diagram showing a circuit configuration of the air-conditioning apparatus (hereinafter, air-conditioning apparatus 100) according to Embodiment 1. Referring to FIG. 2, the detailed configuration of the air-conditioning apparatus 100 will be described. As shown in FIG. 2, the outdoor unit 1 and the relay unit 3 are connected to each other via the heat transfer medium pipe 5*a* routed through a third intermediate heat exchanger 13*a* in the outdoor unit 1 and a second intermediate heat exchanger 13*b* in the relay unit 3. The relay unit 3 and each of the indoor units 2 are connected to each other via the heat transfer medium pipe 5*b* routed through the first intermediate heat exchanger 15*a* and the first intermediate heat exchanger 15*b*.

[Outdoor Unit 1]

The outdoor unit 1 includes a compressor 10*a*, third refrigerant flow switching device 11, a heat source-side heat exchanger 12, a second expansion device 16*c*, the third intermediate heat exchanger 13*a*, and an accumulator 19, which are serially connected via a refrigerant pipe 4. The second refrigerant circulates in the refrigerant pipe 4, thereby constituting the second refrigerant circuit A. In the outdoor unit 1, the refrigerant pipe 4*a* is routed to form a bypass circumventing the third intermediate heat exchanger 13*a* and the second expansion device 16*c*. The refrigerant pipe 4*a* includes a bypass flow control device 14. The second expansion device 16*c* and the bypass flow control device 14 may be constituted of, for example, an electronic expansion valve driven by a stepping motor to vary the opening degree.

The compressor 10*a* sucks and compresses the second refrigerant to turn the second refrigerant into high-temperature/high-pressure state, and may be constituted of, for example, a variable-capacity inverter compressor. The third refrigerant flow switching device 11 is constituted of a four-way valve for example, and serves to switch the flow path of the second refrigerant between a path for heating the second heat transfer medium (hereinafter, heating operation) and a path for cooling the second heat transfer medium (hereinafter, cooling operation). The heat source-side heat exchanger 12 acts as an evaporator in the heating operation and as a condenser (or radiator) in the cooling operation, to evaporate and gasify the second refrigerant or condense and liquefy the second refrigerant through heat exchange between the second refrigerant and air supplied by a non-illustrated fan. The accumulator 19 is provided on the suction side of the compressor 10*a*, and serves to store a surplus of the refrigerant.

In the case where the heat source-side heat exchanger 12 is of a water-cooled type which exchanges heat between the second refrigerant and water or the like, there is only a slight difference in necessary amount of the refrigerant between the heating operation and the cooling operation, and therefore the surplus refrigerant is barely produced. In such a case the accumulator 19 for storing the surplus refrigerant is not mandatory and may be excluded.

The bypass flow control device 14 serves to adjust the flow rate of the second refrigerant flowing through the third intermediate heat exchanger 13*a*, in collaboration with the second expansion device 16*c*, and may be constituted of an electronic expansion valve with variable opening degree, or a solenoid valve capable of opening and closing the flow path.

In a normal operation, the flow rate of the second refrigerant flowing through the third intermediate heat exchanger 13*a* can be adjusted with the second expansion device 16*c* alone. Accordingly, the bypass flow control device 14 is closed. In contrast, for example when the flow rate of the second refrigerant flowing through the third intermediate heat exchanger 13*a* is too high despite the compressor 10*a* being driven at the minimum operable frequency, the bypass flow control device 14 is fully opened, or the opening degree thereof is controlled to cause a part of the second refrigerant to flow through the refrigerant pipe 4*a* to circumvent the third intermediate heat exchanger 13*a*, thereby reducing the amount of the refrigerant flowing through the third intermediate heat exchanger 13*a*. Further details will be subsequently described with reference to each of the operation modes.

Further, the outdoor unit 1 includes a pump 21*c* (second heat transfer medium feeding device) for causing the heat transfer medium flowing through the heat transfer medium pipe 5*a* to circulate. The pump 21*c* is located in the heat transfer medium pipe 5*a* at a position corresponding to the outlet flow path of the third intermediate heat exchanger 13*a*, and may be, for example, a variable-capacity pump.

The outdoor unit 1 also includes various sensors (an intermediate heat exchanger outlet temperature sensor 31*c*, a heat source-side heat exchanger outlet refrigerant temperature sensor 32, an intermediate heat exchanger refrigerant temperature sensor 35*e*, a compressor-sucked refrigerant temperature sensor 36, a low-pressure refrigerant pressure sensor 37*a*, and a high-pressure refrigerant pressure sensor 38*a*). The information detected by these sensors (temperature information, pressure information) is transmitted to a controller 50 associated with the outdoor unit 1, to be utilized to control the driving frequency of the compressor 10*a*, switching of the third refrigerant flow switching device 11, the opening degree of the second expansion device 16*c*, the opening degree of the bypass flow control device 14, the rotation speed of a non-illustrated fan for sending air to the heat source-side heat exchanger 12, the switching of the open/close device 17, the switching of the second refrigerant flow switching device 18 and the driving frequency of the pump 21*c*.

The intermediate heat exchanger outlet temperature sensor 31*c* serves to detect he temperature of the second heat transfer medium flowing out of the third intermediate heat exchanger 13*a*, and may be constituted of a thermistor, for example. The intermediate heat exchanger outlet temperature sensor 31*c* is provided in the heat transfer medium pipe 5*a* at a position between the third intermediate heat exchanger 13*a* and the pump 21*c*. Instead, the intermediate heat exchanger outlet temperature sensor 31*c* may be provided in the heat transfer medium pipe 5*a* on the downstream side of the pump 21*c*.

The heat source-side heat exchanger outlet refrigerant temperature sensor 32 serves to detect the temperature of the second refrigerant flowing out of the heat source-side heat exchanger 12, when the heat source-side heat exchanger 12 is acting as a condenser, and may be constituted of a thermistor, for example. The heat source-side heat exchanger outlet refrigerant temperature sensor 32 is provided in the refrigerant pipe 4 at a position between the heat source-side heat exchanger 12 and the second expansion device 16*c*.

The intermediate heat exchanger refrigerant temperature sensor 35*e* serves to detect the temperature of the second refrigerant flowing out of the third intermediate heat exchanger 13*a*, when the third intermediate heat exchanger 13*a* is acting as an evaporator, and may be constituted of a thermistor, for example. The intermediate heat exchanger refrigerant temperature sensor 35*e* is provided between the third intermediate heat exchanger 13*a* and the second expansion device 16*c*.

The compressor-sucked refrigerant temperature sensor 36 serves to detect the temperature of the second refrigerant sucked into the compressor 10*a*, and may be constituted of a thermistor, for example. The compressor-sucked refrigerant temperature sensor 36 is provided in the refrigerant pipe 4 on the inlet side of the compressor 10*a*.

The low-pressure refrigerant pressure sensor 37*a* is provided in the suction flow path of the compressor 10*a*, to detect the pressure of the second refrigerant sucked into the compressor 10*a*.

The high-pressure refrigerant pressure sensor 38*a* is provided in the discharge flow path of the compressor 10*a*, to detect the pressure of the second refrigerant discharged from the compressor 10*a*.

The controller 50 is constituted of a microcomputer for example, and serves to control the driving frequency of the compressor 10*a*, switching of the third refrigerant flow switching device 11, the opening degree of the second expansion device 16*c*, the opening degree of the bypass flow control device 14, the rotation speed of a non-illustrated fan for sending air to the heat source-side heat exchanger 12, the switching of the open/close device 17, the switching of the second refrigerant flow switching device 18 and the driving frequency of the pump 21*c*, according to the information detected by the sensors and instructions from a remote controller, to thereby perform the operation modes to be subsequently described.

The heat transfer medium pipe 5*a* in which the second heat transfer medium flows is connected to the inlet and the outlet of the third intermediate heat exchanger 13*a*. The heat transfer medium pipe 5*a* connected to the inlet of the third intermediate heat exchanger 13*a* is connected to the relay unit 3, and the heat transfer medium pipe 5*a* connected to the outlet of the third intermediate heat exchanger 13*a* is connected to the relay unit 3 via the pump 21*c*.

[Indoor Unit 2]

The indoor units 2 each include a use-side heat exchanger 26. The use-side heat exchanger 26 is connected to a first heat transfer medium flow control device 25 and to a second heat transfer medium flow switching device 23 of the relay unit 3, via the heat transfer medium pipe 5*b*. The use-side heat exchanger 26 serves to exchange heat between the air supplied by the non-illustrated fan and the heat transfer medium, to thereby generate the heating air or cooling air to be supplied to the indoor space 7.

FIG. 2 illustrates the case where four indoor units 2 are connected to the relay unit 3, which are numbered as indoor unit 2*a*, indoor unit 2*b*, indoor unit 2*c*, and indoor unit 2*d* from the bottom of the drawing. Likewise, the use-side heat exchangers 26 are numbered as use-side heat exchanger 26*a*, use-side heat exchanger 26*b*, use-side heat exchanger 26*c*, and use-side heat exchanger 26*d* from the bottom, to respectively correspond to the indoor unit 2*a* to the indoor unit 2*d*. As stated with reference to FIG. 1, the number of indoor units 2 is not limited to four as illustrated in FIG. 2.

[Relay Unit 3]

The relay unit 3 includes a compressor 10*b*, a first refrigerant flow switching device 27 constituted of a four-way valve for example, the second intermediate heat exchanger 13*b*, a first expansion device 16*a* and a first expansion device 16*b*, the first intermediate heat exchanger 15*a* and the first intermediate heat exchanger 15*b*, a second refrigerant flow switching device 18*a* and a second refrigerant flow switching device 18*b*, which are serially connected via a refrigerant pipe 4. The first refrigerant circulates inside the refrigerant pipe 4, thereby constituting a first refrigerant circuit C.

The relay unit 3 also includes a pump 21*a* and a pump 21*b*, four first heat transfer medium flow switching devices 22, four second heat transfer medium flow switching devices 23, and four first heat transfer medium flow control devices 25. The first heat transfer medium circulates inside the heat transfer medium pipe 5*b*, thereby constituting a part of the first heat transfer medium circuit D.

Further, the relay unit 3 includes a refrigerant pipe 4*b* and a refrigerant pipe 4*c*, a check valve 24*a*, a check valve 24*b*, a check valve 24*c*, and a check valve 24*d*. These pipes and valves allow the first refrigerant flowing to the inlet side of the open/close device 17*a* to flow in a fixed direction, irrespective of the direction of the first refrigerant flow switching device 27. Accordingly, the refrigerant circuit for switching between cooling and heating of the first heat transfer medium can be simplified, in each of the first intermediate heat exchanger 15*a* and the first intermediate heat exchanger 15*b*. Here, the check valve may be excluded, and the configuration without the check valve will be subsequently described with reference to Embodiment 3.

Further, the relay unit 3 includes a second heat transfer medium flow control device 28 constituting a part of the second heat transfer medium circuit B and located on the inlet side of the heat transfer medium flow path in the second intermediate heat exchanger 13*b*.

In addition, the relay unit 3 includes two open/close devices 17.

The compressor 10*b* sucks and compresses the first refrigerant, thereby turning the first refrigerant into a high-temperature/high-pressure state, and may be constituted of, for example, a variable-capacity inverter compressor.

The first refrigerant flow switching device 27 is constituted of a four-way valve for example, and serves to switch between a cooling operation in which the second intermediate heat exchanger 13*b* is caused to act as a condenser to transfer heat from the first refrigerant to the second heat transfer medium, and a heating operation in which the second intermediate heat exchanger 13*b* is caused to act as an evaporator to cause the first refrigerant to remove heat from the second heat transfer medium.

The second intermediate heat exchanger 13*b* acts as a condenser or an evaporator, thereby serving to transmit the cooling energy or heating energy of the first refrigerant to the second heat transfer medium. The second intermediate heat exchanger 13*b* is provided between the first refrigerant flow switching device 27 and the check valve 24*a* in the first refrigerant circuit C, for cooling or heating the second heat transfer medium.

The first intermediate heat exchanger 15 (first intermediate heat exchanger 15*a*, first intermediate heat exchanger 15*b*) acts as a condenser or an evaporator, to transmit the cooling energy or heating energy of the first refrigerant to the first heat transfer medium. The first intermediate heat exchanger 15*a* is provided between the first expansion device 16*a* and the second refrigerant flow switching device 18*a* in the first refrigerant circuit C, for cooling the heat transfer medium in a cooling and heating mixed operation mode. The first intermediate heat exchanger 15*b* is provided between the first expansion device 16*b* and the second refrigerant flow switching device 18*b* in the first refrigerant circuit C, for heating the heat transfer medium in the cooling and heating mixed operation mode.

The first expansion device 16*a* and the first expansion device 16*b* have the function of a pressure reducing valve or an expansion valve, to depressurize and expand the first refrigerant. The first expansion device 16*a* is located upstream of the intermediate heat exchanger 15*a*, in the state where the first intermediate heat exchanger 15*a* acts as an evaporator. The first expansion device 16*b* is located upstream of the first intermediate heat exchanger 15*b* in the state where the intermediate heat exchanger 15*b* acts as an evaporator. The first expansion device 16*a* and the first expansion device 16*b* may be constituted of, for example, an electronic expansion valve with variable opening degree.

The pair of open/close devices 17 (open/close device 17*a*, open/close device 17*b*) may be constituted of a two-way valve, a solenoid valve, an electronic expansion valve, or the like, and serves to open and close the refrigerant pipe 4. The open/close device 17*a* is provided in the flow path connecting between the outlet side of the second intermediate heat exchanger 13*b* and the inlet side of the first expansion device 16, in the cooling operation. The open/close device 17*b* is provided at a position for connecting between the inlet side flow path of the first expansion device 16 and the outlet side flow path of the second refrigerant flow switching device 18, in the state where the first intermediate heat exchanger 15 acts as an evaporator.

The pair of second refrigerant flow switching devices 18 (second refrigerant flow switching device 18*a*, second refrigerant flow switching device 18*b*) serve to switch the flow of the refrigerant, depending on the operation mode. The second refrigerant flow switching device 18*a* is located downstream of the first intermediate heat exchanger 15*a*, in the state where the first intermediate heat exchanger 15*a* acts as an evaporator. The second refrigerant flow switching device 18*b* is located downstream of the first intermediate heat exchanger 15*b*, in the state where the first intermediate heat exchanger 15*a* acts as an evaporator. The second refrigerant flow switching devices 18 (second refrigerant flow switching device 18*a*, second refrigerant flow switching device 18*b*) may be constituted of a four-way valve, a two-way valve, a solenoid valve, or the like, and FIG. 2 illustrates the case where the four-way valve is employed.

The pair of pumps (first heat transfer medium feeding devices) 21 (pump 21*a*, pump 21*b*) serve to cause the first heat transfer medium to circulate in the heat transfer medium pipe 5*b*. The pump 21*a* is located in the heat transfer medium pipe 5*b* at a position between the first intermediate heat exchanger 15*a* and the second heat transfer medium flow switching device 23. The pump 21*b* is located in the heat transfer medium pipe 5*b* at a position between the first intermediate heat exchanger 15*b* and the second heat transfer medium flow switching device 23. The pump 21*a* and the pump 21*b* may be constituted of a variable-capacity valve, for example.

The four first heat transfer medium flow switching devices 22 (first heat transfer medium flow switching device 22*a* to first heat transfer medium flow switching device 22*d*) are each constituted of a three-way valve for example, and serve to switch the flow path of the heat transfer medium. The number of first heat transfer medium flow switching devices 22 corresponds to the number of indoor units 2 (four in Embodiment 1). The first heat transfer medium flow switching device 22 is provided on the outlet side of the heat transfer medium flow path of the use-side heat exchanger 26, with one of the three ways connected to the first intermediate heat exchanger 15*a*, another way connected to the first intermediate heat exchanger 15*b*, and the rest of way connected to the first heat transfer medium flow control device 25. The first heat transfer medium flow switching devices 22 are each numbered as first heat transfer medium flow switching device 22*a*, first heat transfer medium flow switching device 22*b*, first heat transfer medium flow switching device 22*c*, and first heat transfer medium flow switching device 22*d* from the bottom of FIG. 2, to correspond to the indoor units 2.

The four second heat transfer medium flow switching devices 23 (second heat transfer medium flow switching device 23*a* to second heat transfer medium flow switching device 23*d*) are each constituted of a three-way valve for example, and serve to switch the flow path of the heat transfer medium. The number of second heat transfer medium flow switching devices 23 corresponds to the number of indoor units 2 (four in Embodiment 1). The second heat transfer medium flow switching device 23 is provided on the inlet side of the heat transfer medium flow path of the use-side heat exchanger 26, with one of the three ways connected to the first intermediate heat exchanger 15*a*, another way connected to the first intermediate heat exchanger 15*b*, and the rest of way connected to the use-side heat exchanger 26. The second heat transfer medium flow switching devices 23 are each numbered as second heat transfer medium flow switching device 23*a*, second heat transfer medium flow switching device 23*b*, second heat transfer medium flow switching device 23*c*, and second heat transfer medium flow switching device 23*d* from the bottom of FIG. 2, to correspond to the indoor units 2.

It is not mandatory that the first heat transfer medium flow switching device 22 and the second heat transfer medium flow switching device 23 are formed separately from each other, and the first heat transfer medium flow switching device 22 and the second heat transfer medium flow switching device 23 may be formed in a unified configuration provided that the flow path of the first heat transfer medium flowing in the use-side heat exchanger 26 can be switched on the side of the pump 21*a* and the pump 216.

The four first heat transfer medium flow control devices 25 (first heat transfer medium flow control device 25*a* to first heat transfer medium flow control device 25*d*) are each constituted of, for example, a two-way valve with variable opening degree (opening area), and controls the flow rate in the heat transfer medium pipe 5*b*. The number of first heat transfer medium flow control devices 25 corresponds to the number of indoor units 2 (four in Embodiment 1). The first heat transfer medium flow control device 25 is located on the outlet side of the heat transfer medium flow path of the use-side heat exchanger 26, with one way connected to the use-side heat exchanger 26 and the other way connected to the first heat transfer medium flow switching device 22. The first heat transfer medium flow control devices 25 are numbered as first heat transfer medium flow control device 25*a*, first heat transfer medium flow control device 25*b*, first heat transfer medium flow control device 25*c*, and first heat transfer medium flow control device 25*d* from the bottom in FIG. 2, to correspond to the indoor units 2.

The first heat transfer medium flow control device 25 may be located on the inlet side of the heat transfer medium flow path of the use-side heat exchanger 26. It is not mandatory that the first heat transfer medium flow control device 25 is separately formed from the first heat transfer medium flow switching device 22 and the second heat transfer medium flow switching device 23, and the first heat transfer medium flow control device 25 may be formed in a unified configuration with the first heat transfer medium flow switching device 22 or the second heat transfer medium flow switching device 23, provided that the flow rate of the first heat transfer medium flowing in the heat transfer medium pipe 5*b* can be controlled. Alternatively, the first heat transfer medium flow switching device 22, the second heat transfer medium flow switching device 23, and the first heat transfer medium flow control device 25 may be formed in a unified configuration.

The second heat transfer medium flow switching device 28 is constituted of, for example, a two-way valve with variable opening degree (opening area), and serves to control the flow rate of the second heat transfer medium flowing in the second intermediate heat exchanger 13*b*. The second heat transfer medium flow switching device 28 is provided in the heat transfer medium pipe 5*a* in which the second heat transfer medium flows, at a position corresponding to the inlet flow path of the second intermediate heat exchanger 13*b*. The second heat transfer medium flow switching device 28 may be provided in the outlet flow path of the second intermediate heat exchanger 13*b*. The opening degree of the second heat transfer medium flow switching device 28 is controlled so that, for example, a difference between a temperature detected by the intermediate heat exchanger temperature sensor 33*b* and a temperature detected by the intermediate heat exchanger temperature sensor 33*a* becomes constant.

Further, the relay unit 3 includes various sensors (two intermediate heat exchanger outlet temperature sensors 31*a*, 31*b*, two intermediate heat exchanger temperature sensors 33*a*, 33*b*, four use-side heat exchanger outlet temperature sensors 34*a* to 34*d*, four intermediate heat exchanger refrigerant temperature sensors 35*a* to 35*d*, a low-pressure refrigerant pressure sensor 37*b*, and a high-pressure refrigerant pressure sensor 38*b*). The information detected by these sensors (temperature information, pressure information) is transmitted to a controller 60 associated with the relay unit 3, to be utilized for controlling the driving frequency of the compressor 10*b*, the switching of the first refrigerant flow switching device 27, the opening degree of the first expansion device 16, the opening and closing of the open/close device 17, the switching of the second refrigerant flow switching device 18, the driving frequency of the pump 21, the switching of the first heat transfer medium flow switching device 22, the switching of the second heat transfer medium flow switching device 23, the opening degree of the first heat transfer medium flow control device 25, and the opening degree of the second heat transfer medium flow control device 28.

The two intermediate heat exchanger outlet temperature sensors 31 (intermediate heat exchanger outlet temperature sensors 31*a*, 31*b*) respectively serve to detect the temperature of the first heat transfer medium flowing out of the first intermediate heat exchanger 15*a* and the first intermediate heat exchanger 15*b*, and may be constituted of a thermistor for example. The intermediate heat exchanger outlet temperature sensor 31*a* is provided in the heat transfer medium pipe 5*b* at a position corresponding to the inlet side of the pump 21*a*. The intermediate heat exchanger outlet temperature sensor 31*b* is provided in the heat transfer medium pipe 5*b* at a position corresponding to the inlet side of the pump 21*b*.

The four use-side heat exchanger outlet temperature sensors 34 (use-side heat exchanger outlet temperature sensor 34*a* to use-side heat exchanger outlet temperature sensor 34*d*) are each provided between the first heat transfer medium flow switching device 22 and the first heat transfer medium flow control device 25 to detect the temperature of the first heat transfer medium flowing out of the use-side heat exchanger 26, and may be constituted of a thermistor for example. The number of use-side heat exchanger outlet temperature sensors 34 corresponds to the number of indoor units 2 (four in Embodiment 1). The use-side heat exchanger outlet temperature sensors 34 are numbered as use-side heat exchanger outlet temperature sensor 34*a*, use-side heat exchanger outlet temperature sensor 34*b*, use-side heat exchanger outlet temperature sensor 34*c*, and use-side heat exchanger outlet temperature sensor 34*d* from the bottom in FIG. 2, to correspond to the indoor units 2. The use-side heat exchanger outlet temperature sensor 34 may be provided in the flow path between the first heat transfer medium flow control device 25 and the use-side heat exchanger 26.

The four intermediate heat exchanger refrigerant temperature sensors 35 (intermediate heat exchanger refrigerant temperature sensor 35*a* to intermediate heat exchanger refrigerant temperature sensor 35*d*) are each provided on the inlet side or outlet side of the refrigerant of the first intermediate heat exchanger 15, to detect the temperature of the first refrigerant flowing into or out of the first intermediate heat exchanger 15, and may be constituted of a thermistor for example. The intermediate heat exchanger refrigerant temperature sensor 35*a* is provided between the first intermediate heat exchanger 15*a* and the second refrigerant flow switching device 18*a*. The intermediate heat exchanger refrigerant temperature sensor 35*b* is provided between the first intermediate heat exchanger 15*a* and the first expansion device 16*a*. The intermediate heat exchanger refrigerant temperature sensor 35*c* is provided between the first intermediate heat exchanger 15*b* and the second refrigerant flow switching device 18*b*. The intermediate heat exchanger refrigerant temperature sensor 35*d* is provided between the first intermediate heat exchanger 15*b* and the first expansion device 16*b*.

The intermediate heat exchanger temperature sensor 33*a* is provided in the flow path of the heat transfer medium at a position on the inlet side of the second intermediate heat exchanger 13*b*, to detect the temperature of the second heat transfer medium flowing into the second intermediate heat exchanger 13*b*. The intermediate heat exchanger temperature sensor 33*b* is provided in the flow path of the heat transfer medium at a position on the outlet side of the second intermediate heat exchanger 13*b*, to detect the temperature of the second heat transfer medium flowing out of the second intermediate heat exchanger 13*b*. The intermediate heat exchanger temperature sensor 33*a* and the intermediate heat exchanger temperature sensor 33*b* may be constituted of, for example, a thermistor.

The low-pressure refrigerant pressure sensor 37*b* is provided in the suction flow path of the compressor 10*b*, to detect the pressure of the first refrigerant flowing into the compressor 10*b*. The high-pressure refrigerant pressure sensor 38*b* is provided in the discharge flow path of the compressor 10*b*, to detect the pressure of the first refrigerant discharged from the compressor 10*b*.

The controller 60 is constituted of a microcomputer for example, and controls the driving frequency of the compressor 10*b*, the switching of the first refrigerant flow switching device 27, the driving frequency of the pump 21*a* and the pump 21*b*, the opening degree of the first expansion device 16*a* and the first expansion device 16*b*, the opening and closing of the open/close device 17, the switching of the second refrigerant flow switching device 18, the switching of the first heat transfer medium flow switching device 22, the switching of the second heat transfer medium flow switching device 23, the opening degree of the first heat transfer medium flow control device 25, and the opening degree of the second heat transfer medium flow control device 28, according to the information detected by the sensors and instructions from the remote controller, to thereby perform the operation modes to be subsequently described.

The heat transfer medium pipe 5*a*, in which the second heat transfer medium flows, is connected to the inlet and the outlet of the second intermediate heat exchanger 13*b*. The heat transfer medium pipe 5*a* connected to the outlet of the second intermediate heat exchanger 13*b* is connected to the outdoor unit 1, and the heat transfer medium pipe 5*a* connected to the inlet of the second intermediate heat exchanger 13*b* is connected to the outdoor unit 1 via the second heat transfer medium flow control device 28.

The heat transfer medium pipe 5*b* in which the first heat transfer medium flows includes a section connected to the first intermediate heat exchanger 15*a* and a section connected to the first intermediate heat exchanger 15*b*. The heat transfer medium pipe 5*b* is split into the number of branches corresponding to the number of indoor units 2 connected to the relay unit 3 (four in Embodiment 1). The heat transfer medium pipe 5*b* is connected at the first heat transfer medium flow switching device 22, and the second heat transfer medium flow switching device 23. It is decided whether the heat transfer medium from the first intermediate heat exchanger 15*a* or the heat transfer medium from the first intermediate heat exchanger 15*b* is to be introduced into the use-side heat exchanger 26, by controlling the action of the first heat transfer medium flow switching device 22 and the second heat transfer medium flow switching device 23.

In the air-conditioning apparatus 100, the compressor 10*a*, the third refrigerant flow switching device 11, the heat source-side heat exchanger 12, the second expansion device 16*c*, the refrigerant flow path in the third intermediate heat exchanger 13*a*, and the accumulator 19 are connected via the refrigerant pipe 4, thus constituting the second refrigerant circuit A in the outdoor unit 1.

In addition, in the air-conditioning apparatus 100 the compressor 10*b*, the first refrigerant flow switching device 27, the refrigerant flow path in the second intermediate heat exchanger 13*b*, the open/close device 17, the first expansion device 16, the refrigerant flow path in the first intermediate heat exchanger 15, and the second refrigerant flow switching device 18 are connected via the refrigerant pipe 4, thus constituting the first refrigerant circuit C in the relay unit 3.

In the air-conditioning apparatus 100, heat transfer medium flow path in the third intermediate heat exchanger 13*a*, the pump 21*c*, the second heat transfer medium flow control device 28, and the heat transfer medium flow path in the second intermediate heat exchanger 13*b* are connected via the heat transfer medium pipe 5*a* to constitute the second heat transfer medium circuit B for circulation between the outdoor unit 1 and the relay unit 3.

Likewise, in the air-conditioning apparatus 100 the heat transfer medium flow path of the first intermediate heat exchanger 15, the pump 21*a* and the pump 21*b*, the first heat transfer medium flow switching device 22, the first heat transfer medium flow control device 25, the use-side heat exchanger 26, and the second heat transfer medium flow switching device 23 are connected via the heat transfer medium pipe 5*b*, to constitute the first heat transfer medium circuit D for circulation between the relay unit 3 and each of the indoor units 2.

In the air-conditioning apparatus 100, the plurality of use-side heat exchangers 26 are connected in parallel to each of the first intermediate heat exchangers 15, thus constituting the plurality of lines in the first heat transfer medium circuit D.

Thus, in the air-conditioning apparatus 100 the outdoor unit 1 and the relay unit 3 are connected to each other via the third intermediate heat exchanger 13*a* in the outdoor unit 1 and the second intermediate heat exchanger 13*b* in the relay unit 3. In addition, the relay unit 3 and each of the indoor units 2 are connected to each other via the first intermediate heat exchanger 15*a* and the first intermediate heat exchanger 15*b*.

In the air-conditioning apparatus 100, heat exchange is performed in the third intermediate heat exchanger 13*a* between the second refrigerant circulating in the second refrigerant circuit A in the outdoor unit 1 and the second heat transfer medium circulating in the second heat transfer medium circuit B in the outdoor unit 1, and heat exchange is performed in the second intermediate heat exchanger 13*b* between the first refrigerant circulating in the first refrigerant circuit C in the relay unit 3 and the second heat transfer medium conveyed from the outdoor unit 1. Further, heat exchange is performed in the first intermediate heat exchanger 15*a* and the first intermediate heat exchanger 15*b* between the first refrigerant circulating in the first refrigerant circuit C in the relay unit 3 and the first heat transfer medium circulating in the first heat transfer medium circuit D in the relay unit 3.

In the mentioned process, the second refrigerant circulates inside the outdoor unit 1 and the first refrigerant circulates inside the relay unit 3, and hence the second refrigerant and the first refrigerant are kept from being mixed with each other. In addition, although the first heat transfer medium and the second heat transfer medium both flow into and out of the relay unit 3, the flow paths are separated and hence the first heat transfer medium and the second heat transfer medium are kept from being mixed with each other.

In the air-conditioning apparatus 100, further, the controller 50 in the outdoor unit 1 and the controller 60 in the relay unit 3 are connected wirelessly or by wires via a communication line 70, for communication between the controller 50 and the controller 60. Here, the controller 50 may be located in the vicinity of the outdoor unit 1, instead of thereinside. Likewise, the controller 60 may be located in the vicinity of the relay unit 3, instead of thereinside.

The operation modes performed by the air-conditioning apparatus 100 will be described hereunder. The air-conditioning apparatus 100 is configured to receive an instruction from each of the indoor units 2 and to cause the corresponding indoor unit 2 to perform the cooling operation or heating operation. In other words, the air-conditioning apparatus 100 is configured to cause all of the indoor units 2 to perform the same operation, or allow each of the indoor units 2 to perform a different operation.

The operation modes that the air-conditioning apparatus 100 is configured to perform include a cooling-only operation mode in which all of the indoor units 2 in operation perform the cooling operation, a heating-only operation mode in which all of the indoor units 2 in operation perform the heating operation, a cooling-main operation mode in which the load of cooling is greater in the cooling and heating mixed operation, and a heating-main operation mode in which the load of heating is greater in the cooling and heating mixed operation. Each of the operation modes will be described hereunder, along with the flow of the refrigerant and the heat transfer medium.

[Cooling-Only Operation Mode]

Figure 3:
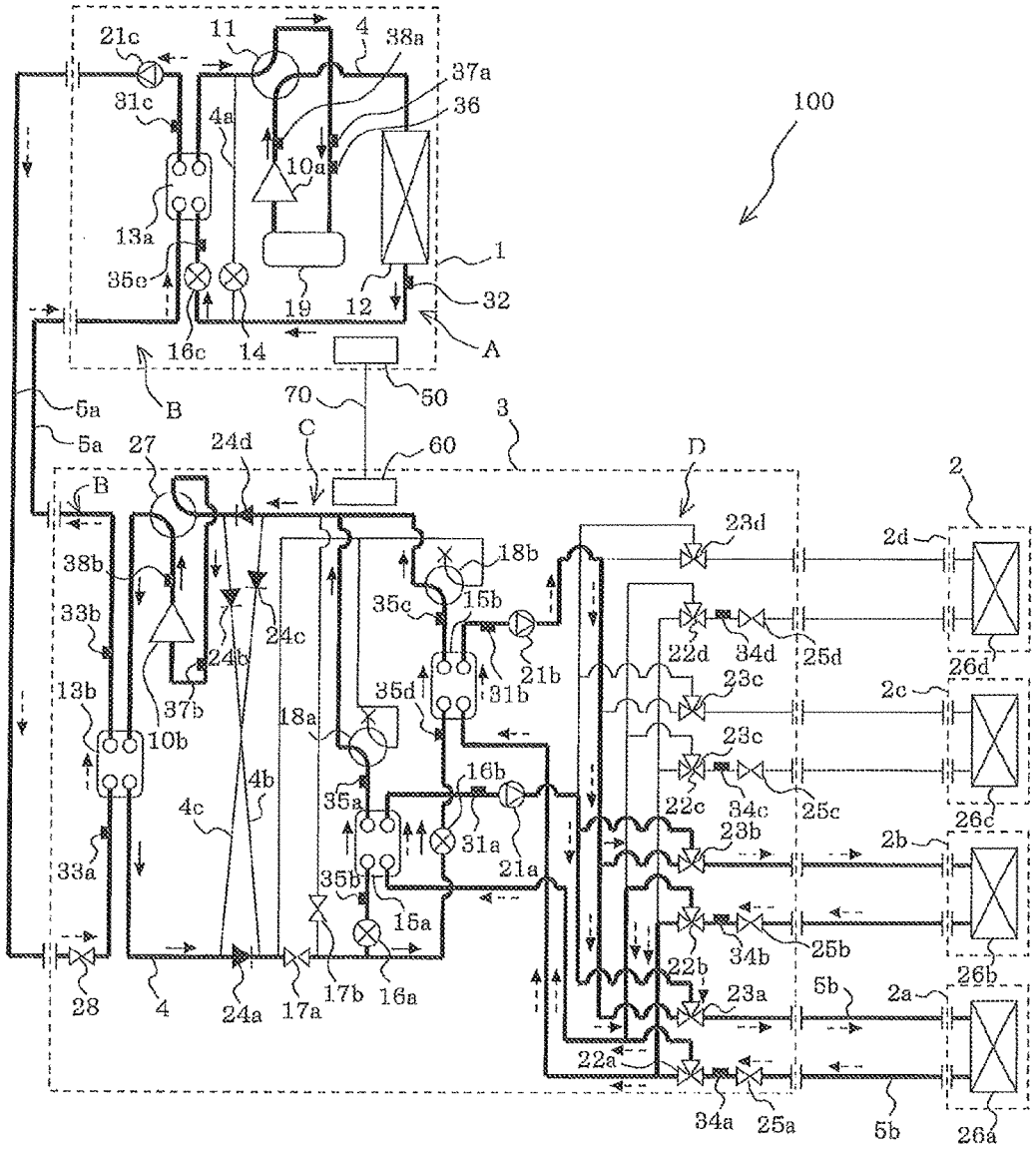
FIG. 3 is a system circuit diagram showing the flow of a refrigerant and a heat transfer medium in the air-conditioning apparatus according to Embodiment 1 of the present invention, in a cooling-only operation.

FIG. 3 is a system circuit diagram showing the flow of the refrigerant and the heat transfer medium in the air-conditioning apparatus 100, in the cooling-only operation mode. Referring to FIG. 3, the cooling-only operation mode will be described on the assumption that the cooling load has arisen only in the use side heat exchanger 26*a* and the use side heat exchanger 26*b*. In FIG. 3, the pipes illustrated in bold lines represent the pipes in which the refrigerant and the heat transfer medium flow. In addition, in FIG. 3, the flow of the refrigerant is indicated by solid arrows and the flow of the heat transfer medium is indicated by broken-line arrows.

In the cooling-only operation mode shown in FIG. 3, in the outdoor unit 1 the third refrigerant flow switching device 11 is switched to cause the refrigerant discharged from the compressor 10*a* to flow into the third intermediate heat exchanger 13*a* after passing through the heat source-side heat exchanger 12, and then the pump 21*c* is driven to circulate the second heat transfer medium. In the relay unit 3, the first refrigerant flow switching device 27 is switched to cause the refrigerant discharged from the compressor 10*b* to flow into the second intermediate heat exchanger 13*b*, and the pump 21*a* and the pump 21*b* are activated. The first heat transfer medium flow control device 25*a* and the first heat transfer medium flow control device 25*b* are fully opened, while the first heat transfer medium flow control device 25*c* and the first heat transfer medium flow control device 25*d* are fully closed, to allow the heat transfer medium to circulate between each of the first intermediate heat exchanger 15*a* and the first intermediate heat exchanger 15*b* and each of the use-side heat exchanger 26*a* and the use-side heat exchanger 26*b*.

First, the flow of the second refrigerant in the second refrigerant circuit A in the outdoor unit 1 will be described hereunder.

The second refrigerant in a low-temperature/low-pressure gas phase is compressed by the compressor 10*a* and discharged therefrom in the form of high-temperature/high-pressure gas refrigerant. The high-temperature/high-pressure gas refrigerant discharged from the compressor 10*a* flows into the heat source-side heat exchanger 12 which serves as a condenser, through the third refrigerant flow switching device 11. The second refrigerant is then condensed and liquefied while transmitting heat to outdoor air in the heat source-side heat exchanger 12, thereby turning into high-pressure liquid refrigerant.

The high-pressure liquid refrigerant which has flowed out of the heat source-side heat exchanger 12 flows into the second expansion device 16*c* to be thereby expanded and turns into low-temperature/low-pressure two-phase refrigerant. The low-temperature/low-pressure two-phase refrigerant flows into the third intermediate heat exchanger 13*a* which serves as an evaporator, and removes heat from the second heat transfer medium circulating in the second heat transfer medium circuit B thereby turning into low-temperature/low-pressure gas refrigerant while cooling the second heat transfer medium. In this process, the flow path is formed so that the second refrigerant and the second heat transfer medium flow parallel to each other in the third intermediate heat exchanger 13*a*. The gas refrigerant which has flowed out of the third intermediate heat exchanger 13*a* passes through the third refrigerant flow switching device 11 and the accumulator 19, and is again sucked into the compressor 10*a*.

In the mentioned process, the opening degree of the second expansion device 16*c* is controlled to keep a degree of superheating at a constant level, the degree of superheating representing a difference between the temperature detected by the compressor-sucked refrigerant temperature sensor 36 and the temperature detected by the intermediate heat exchanger refrigerant temperature sensor 35*e*. Here, the bypass flow control device 14 is fully closed.

In addition, the frequency (rotation speed) of the compressor 10*a* is controlled such that the temperature of the second heat transfer medium detected by the intermediate heat exchanger outlet temperature sensor 31*c* matches a target temperature. The control target of the temperature detected by the intermediate heat exchanger outlet temperature sensor 31*c* may be set to a range between, for example, 10 degrees Celsius and 40 degrees Celsius, and more preferably between 15 degrees Celsius and 35 degrees Celsius. The temperature in such a range facilitates production of cooled water and/or hot water, irrespective of the operation mode of the indoor unit 2. In addition, the temperature in the mentioned range suppresses heat transmission loss from the heat transfer medium pipe 5*a* to outside air, thereby improving the efficiency of the system as a whole, which contributes to saving of energy. Further, the temperature in the mentioned range enables the target temperature to be reached with the compressor 10*a* of a smaller capacity even though the temperature of outside air sent to the heat source-side heat exchanger 12 is relatively high, thereby allowing reduction in cost of the system.

Here, the target temperature may be varied depending on the operation mode of the relay unit 3. For example, the target temperature may be set to 10 degrees Celsius in the cooling-only operation mode. Setting the second heat transfer medium to such a low temperature in the cooling-only operation mode enables the cooling requirement from the indoor unit 2 to be satisfied despite employing the compressor 10*b* of a smaller capacity in the relay unit 3, thereby allowing reduction in cost of the system. In addition, the target temperature may be set, for example, to 40 degrees Celsius. Setting the second heat transfer medium to such a low temperature in the cooling-only operation mode allows the compressor 10*a* of a lower compression ratio to be employed in the outdoor unit 1, thus allowing a compressor of a smaller capacity to be employed, which leads to reduction in cost of the system.

The frequency of the compressor 10*a* may be controlled such that the pressure of the second refrigerant detected by the low-pressure refrigerant pressure sensor 37*a* becomes close to a target pressure. Further, both of the frequency of the compressor 10*a* and the rotation speed of the non-illustrated fan for sending air to the heat source-side heat exchanger 12 may be controlled, such that the pressure (low pressure) of the second refrigerant detected by the low-pressure refrigerant pressure sensor 37*a* and the pressure (high pressure) of the second refrigerant detected by the high-pressure refrigerant pressure sensor 38*a* both become close to the target pressure. Alternatively, the frequency of the compressor 10*a* may be controlled such that the temperature detected by the intermediate heat exchanger outlet temperature sensor 31*c* becomes close to a target temperature.

Here, a minimum controllable frequency is specified in the compressor 10*a*. Accordingly, the temperature detected by the intermediate heat exchanger outlet temperature sensor 31*c* may be lower than the target temperature, and the pressure detected by the low-pressure refrigerant pressure sensor 37*a* may be lower than the target pressure even when the compressor 10*a* is driven at the minimum frequency, for example in the case where the temperature of outside air introduced into the heat source-side heat exchanger 12 is relatively low. In such a case, it is preferable to adjust the opening degree of the bypass flow control device 14, to bring the temperature detected by the intermediate heat exchanger outlet temperature sensor 31*c* and the pressure detected by the low-pressure refrigerant pressure sensor 37*a* close to the respective target values. Such an arrangement ensures that the operation status matches the control target irrespective of the environmental conditions, thereby stabilizing the operation of the system.

The mentioned arrangement also prevents the third intermediate heat exchanger 13*a* from bursting when the temperature of the second refrigerant flowing in the third intermediate heat exchanger 13*a* excessively drops to the point of freezing, thereby upgrading the safety level of the system. In the case of controlling the bypass flow control device 14 as above, the liquid refrigerant or the two-phase refrigerant of low dryness flows in the refrigerant pipe 4*a* and joins with the gas-phase second refrigerant flowing out of the third intermediate heat exchanger 13*a*. Accordingly, the temperature of the two-phase refrigerant of high dryness is detected by the compressor-sucked refrigerant temperature sensor 36 as the temperature of the second refrigerant, and therefore the second expansion device 16*c* is disabled from controlling the dryness.

In such a case, for example the ratio between the opening degree of the second expansion device 16*c* and the opening degree of the bypass flow control device 14 may be set to a fixed value, and the both opening degrees may be collectively controlled to turn the second refrigerant passing through the compressor-sucked refrigerant temperature sensor 36 into the gas refrigerant. Alternatively, a non-illustrated additional sensor capable of detecting the temperature of the refrigerant may be provided on the outlet side of the third intermediate heat exchanger 13*a*, which is opposite to the inlet side where the intermediate heat exchanger refrigerant temperature sensor 35*e* is provided, and the opening degree of the second expansion device 16*c* may be controlled such that the degree of superheating matches a target value, the degree of superheating representing a difference between the temperature detected by the additional sensor and the temperature detected by the intermediate heat exchanger refrigerant temperature sensor 35*e*.

Employing an electronic expansion valve with variable opening degree as the bypass flow control device 14 allows the control to be smoothly performed, however different configurations may be adopted. For example, a plurality of solenoid valves may be provided to control the flow rate of the refrigerant in the refrigerant pipe 4*a* by controlling the number of solenoid valves to be opened. Instead, a single solenoid valve set to realize a predetermined flow rate upon being opened may be employed. Although such a configuration slightly degrades the controllability, the third intermediate heat exchanger 13*a* can be prevented from bursting due to freezing.

When the compressor 10*a* is controllable to a sufficiently low frequency, the bypass flow control device 14 and the refrigerant pipe 4*a* may be excluded, in which case no particular inconvenience will be incurred.

Hereunder, the flow of the second heat transfer medium from the outdoor unit 1 to the relay unit 3 in the second heat transfer medium circuit B will be described.

In the cooling-only operation mode, the cooling energy of the second heat refrigerant is transferred to the second heat transfer medium in the third intermediate heat exchanger 13*a*, and the pump 21*c* causes the cooled second heat transfer medium to flow through the heat transfer medium pipe 5*a*. The second heat transfer medium pressurized by the pump 21*c* and discharged therefrom flows out of the outdoor unit 1 and flows into the relay unit 3 through the heat transfer medium pipe 5*a*. The second heat transfer medium which has entered the relay unit 3 flows into the second intermediate heat exchanger 13*b* through the second heat transfer medium flow control device 28. The second heat transfer medium transfers the cooling energy to the first refrigerant in the second intermediate heat exchanger 13*b*, and then flows out of the relay unit 3. The second heat transfer medium which has flowed out of the relay unit 3 flows into the outdoor unit 1 through the heat transfer medium pipe 5*a*, and then again flows into the third intermediate heat exchanger 13*a*.

In this process, the opening degree of the second heat transfer medium flow control device 28 is controlled so that a difference between the temperature of the second heat transfer medium on the outlet side of the second intermediate heat exchanger 13*b* detected by the intermediate heat exchanger temperature sensor 33*b* and the temperature of the second heat transfer medium on the inlet side of the second intermediate heat exchanger 13*b* detected by the intermediate heat exchanger temperature sensor 33*a* matches a target value. Then the rotation speed of the pump 21*c* is controlled so that the opening degree of the second heat transfer medium flow control device 28 thus controlled becomes as close as possible to full-open. More specifically, when the opening degree of the second heat transfer medium flow control device 28 is considerably smaller than full-open, the rotation speed of the pump 21*c* is reduced. When the opening degree of the second heat transfer medium flow control device 28 is close to full-open, the pump 21*c* is controlled to maintain the same flow rate of the second heat transfer medium. Here, it is not mandatory that the second heat transfer medium flow control device 28 is fully opened, but it suffices that the second heat transfer medium flow control device 28 is opened to a substantially high degree, such as 90% or 85% of the fully opened state.

In this case, the controller 60 controlling the opening degree of the second heat transfer medium flow control device 28 is located inside or close to the relay unit 3. The controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the second heat transfer medium flow control device 28 to the controller 50 of the outdoor unit 1 through wired or wireless communication line 70 connecting between the relay unit 3 and the outdoor unit 1, to thereby perform a linkage control described as above.

The controller 50 of the outdoor unit 1 also controls the compressor 10*a*, the second expansion device 16*c*, the bypass flow control device 14, and the actuator on the refrigerant side such as the non-illustrated fan provided for the heat source-side heat exchanger 12.

Hereunder, the flow of the first refrigerant in the first refrigerant circuit C in the relay unit 3 will be described.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* flows into the second intermediate heat exchanger 13*b* acting as a condenser, through the first refrigerant flow switching device 27, and is condensed and liquefied while transferring heat to the second heat transfer medium in the second intermediate heat exchanger 13*b*, thereby turning into high-pressure liquid refrigerant. In this process the flow path is formed so that the second heat transfer medium and the first refrigerant flow in opposite directions to each other in the second intermediate heat exchanger 13*b*.

The high-pressure liquid refrigerant which has flowed out of the second intermediate heat exchanger 13*b* is branched after flowing through the check valve 24*a* and the open/close device 17*a*, and expanded in the first expansion device 16*a* and the first expansion device 16*b* thus to turn into low-temperature/low-pressure two-phase refrigerant. The two-phase refrigerant flows into each of the first intermediate heat exchanger 15*a* and the first intermediate heat exchanger 15*b* acting as an evaporator, and cools the first heat transfer medium circulating in the first heat transfer medium circuit D by removing heat from the first heat transfer medium, thereby turning into low-temperature/low-pressure gas refrigerant. In this process the flow path is formed so that the first refrigerant and the first heat transfer medium flow parallel to each other in the first intermediate heat exchanger 15*a* and the first intermediate heat exchanger 15*b*.

The gas refrigerant which has flowed out of the first intermediate heat exchanger 15*a* and the first intermediate heat exchanger 15*b* is joined after passing through the second refrigerant flow switching device 18*a* and the second refrigerant flow switching device 18*b*, and is again sucked into the compressor 10*b* through the check valve 24*d* and the first refrigerant flow switching device 27.

In the mentioned process, the opening degree of the first expansion device 16*a* is controlled to keep a degree of superheating at a constant level, the degree of superheating representing a difference between the temperature detected by the intermediate heat exchanger refrigerant temperature sensor 35*a* and the temperature detected by the intermediate heat exchanger refrigerant temperature sensor 35*b*. Likewise, the opening degree of the first expansion device 16*b* is controlled to keep a degree of superheating at a constant level, the degree of superheating representing a difference between the temperature detected by the intermediate heat exchanger refrigerant temperature sensor 35*c* and the temperature detected by the intermediate heat exchanger refrigerant temperature sensor 35*d*. Here, the open/close device 17*a* is opened and the open/close device 17*b* is closed.

In addition, the compressor 10*b* is controlled so that the pressure (low pressure) of the first refrigerant detected by the low-pressure refrigerant pressure sensor 37*b* matches a target pressure, for example the saturation pressure corresponding to 0 degrees Celsius. Alternatively, the frequency of the compressor 10*b* may be controlled so that the temperature detected by the intermediate heat exchanger outlet temperature sensor 31*a* and/or the temperature detected by the intermediate heat exchanger outlet temperature sensor 31*b* becomes close to a target temperature.

The flow of the first heat transfer medium in the first heat transfer medium circuit D will now be described.

In the cooling-only operation mode, the cooling energy of the first refrigerant is transmitted to the first heat transfer medium in both of the first intermediate heat exchanger 15*a* and the first intermediate heat exchanger 15*b*, and the cooled first heat transfer medium is driven by the pump 21*a* and the pump 21*b* to flow through the heat transfer medium pipe 5*b*. The first heat transfer medium pressurized by the pump 21*a* and the pump 21*b* and discharged therefrom flows into the use-side heat exchanger 26*a* and the use-side heat exchanger 26*b*, through the second heat transfer medium flow switching device 23*a* and the second heat transfer medium flow switching device 23*b*. Then the first heat transfer medium removes heat from indoor air in the use-side heat exchanger 26*a* and the use-side heat exchanger 26*b*, thereby cooling the indoor space 7.

Thereafter, the first heat transfer medium flows out of the use-side heat exchanger 26*a* and the use-side heat exchanger 26*b* and flows into the first heat transfer medium flow control device 25*a* and the first heat transfer medium flow control device 25*b*. In the mentioned process, the flow rate of the first heat transfer medium flowing into the use-side heat exchanger 26*a* and the use-side heat exchanger 26*b* is controlled by the first heat transfer medium flow control device 25*a* and the first heat transfer medium flow control device 25*b* to satisfy the air-conditioning load required in the indoor space. The heat transfer medium which has flowed out of the first heat transfer medium flow control device 25*a* and the first heat transfer medium flow control device 25*b* passes through the first heat transfer medium flow switching device 22*a* and the first heat transfer medium flow switching device 22*b*, and flows into the first intermediate heat exchanger 15*a* and the first intermediate heat exchanger 15*b*, and is again sucked into the pump 21*a* and the pump 21*b*.

In the heat transfer medium pipe 5*b* in the use-side heat exchanger 26, the first heat transfer medium flows in the direction from the second heat transfer medium flow switching device 23 toward the first heat transfer medium flow switching device 22 through the first heat transfer medium flow control device 25. The air-conditioning load required in the indoor space 7 can be satisfied by controlling to maintain at a target value the difference between the temperature detected by the intermediate heat exchanger outlet temperature sensor 31*a* or the temperature detected by the intermediate heat exchanger outlet temperature sensor 31*b* and the temperature detected by the use-side heat exchanger outlet temperature sensor 34.

Either of the temperatures detected by the intermediate heat exchanger outlet temperature sensor 31*a* and the intermediate heat exchanger outlet temperature sensor 31*b*, or the average temperature thereof, may be adopted as the temperature at the outlet of the first intermediate heat exchanger 15. In the mentioned process, the first heat transfer medium flow switching device 22 and the second heat transfer medium flow switching device 23 are set to an opening degree that allows the flow path to be secured in both of the first intermediate heat exchanger 15*a* and the first intermediate heat exchanger 15*b*, and allows the flow rate to accord with the heat exchange amount.

Here, although in principle it is desirable to control the use-side heat exchanger 26 on the basis of the difference in temperature between the inlet and the outlet thereof, actually the heat transfer medium temperature at the inlet of the use side heat exchangers 26 is nearly the same as the temperature detected by the intermediate heat exchanger outlet temperature sensor 31*a* or the intermediate heat exchanger outlet temperature sensor 31*b*, and therefore adopting the value of the intermediate heat exchanger outlet temperature sensor 31*a* and/or the intermediate heat exchanger outlet temperature sensor 31*b* allows reduction of the number of temperature sensors, which leads to reduction in cost of the system.

This also applies to the heating-only operation mode, the cooling-main operation mode, and the heating-main operation mode to be subsequently described.

During the cooling-only operation mode, the flow path to the use-side heat exchanger 26 where the thermal load has not arisen (including a state where a thermostat is off) is closed by the first heat transfer medium flow control device 25 to restrict the flow of the heat transfer medium, since it is not necessary to supply the heat transfer medium to such use-side heat exchanger 26. In FIG. 3, the thermal load is present in the use-side heat exchanger 26*a* and the use-side heat exchanger 26*b* and hence the heat transfer medium is supplied thereto, however the thermal load has not arisen in the use-side heat exchanger 26*c* and the use-side heat exchanger 26*d*, and therefore the corresponding first heat transfer medium flow control device 25*c* and first heat transfer medium flow control device 25*d* are fully closed.

When the thermal load arises in the use-side heat exchanger 26*c* or the use-side heat exchanger 26*d*, the first heat transfer medium flow control device 25*c* or the first heat transfer medium flow control device 25*d* may be opened to allow the heat transfer medium to circulate.

This also applies to the heating-only operation mode, the cooling-main operation mode, and the heating-main operation mode to be subsequently described.

[Heating-Only Operation Mode]

Figure 4:
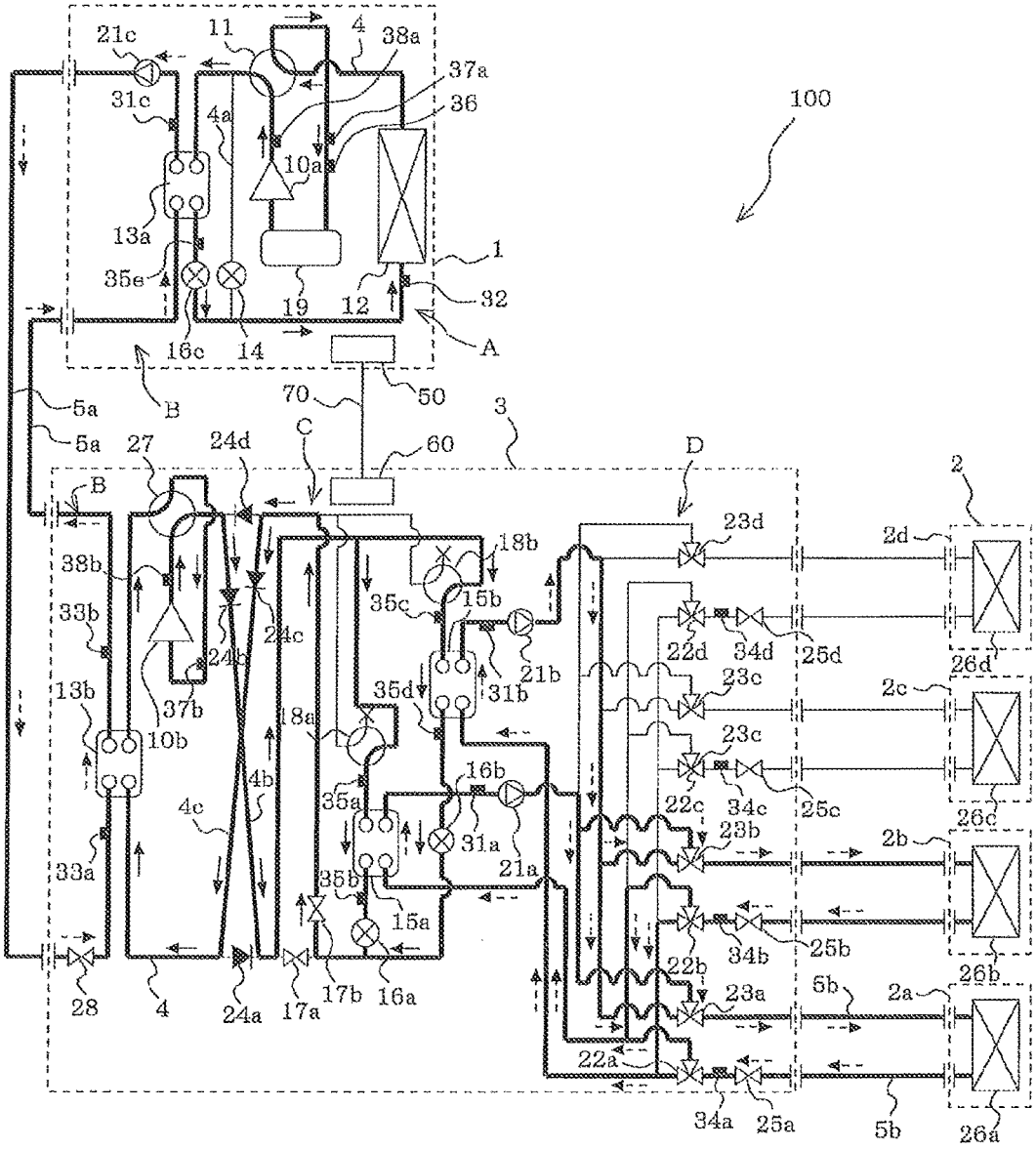
FIG. 4 is a system circuit diagram showing the flow of the refrigerant and the heat transfer medium in the air-conditioning apparatus according to Embodiment 1 of the present invention, in a heating-only operation.

FIG. 4 is a system circuit diagram showing the flow of the refrigerant and the heat transfer medium in the air-conditioning apparatus 100, in the heating-only operation mode. Referring to FIG. 4, the heating-only operation mode will be described on the assumption that the heating load has arisen only in the use side heat exchanger 26*a* and the use side heat exchanger 26*b*. In FIG. 4, the pipes illustrated in bold lines represent the pipes in which the refrigerant and the heat transfer medium flow. In addition, in FIG. 4, the flow of the refrigerant is indicated by solid arrows and the flow of the heat transfer medium is indicated by broken-line arrows.

In the heating-only operation mode shown in FIG. 4, in the outdoor unit 1 the third refrigerant flow switching device 11 is switched to cause the refrigerant discharged from the compressor 10*a* to flow into the heat source-side heat exchanger 12 after passing through the third intermediate heat exchanger 13*a*, and then the pump 21*c* is driven to circulate the second heat transfer medium. In the relay unit 3, the first refrigerant flow switching device 27 is switched to cause the refrigerant discharged from the second intermediate heat exchanger 13*b* to flow into the compressor 10*b*, and the pump 21*a* and the pump 21*b* are activated. The first heat transfer medium flow control device 25*a* and the first heat transfer medium flow control device 25*b* are fully opened, while the first heat transfer medium flow control device 25*c* and the first heat transfer medium flow control device 25*d* are fully closed, to allow the heat transfer medium to circulate between each of the first intermediate heat exchanger 15*a* and the first intermediate heat exchanger 15*b* and each of the use-side heat exchanger 26*a* and the use-side heat exchanger 26*b*.

First, the flow of the second refrigerant in the second refrigerant circuit A in the outdoor unit 1 will be described hereunder.

The second refrigerant in a low-temperature/low-pressure gas phase is compressed by the compressor 10*a* and discharged therefrom in the form of high-temperature/high-pressure gas refrigerant. The high-temperature/high-pressure gas refrigerant discharged from the compressor 10*a* flows into the third intermediate heat exchanger 13*a* which serves as a condenser, through the third refrigerant flow switching device 11. The second refrigerant is then condensed and liquefied while transmitting heat in the third intermediate heat exchanger 13*a* to the second heat transfer medium circulating in the second heat transfer medium circuit B, thereby turning into high-pressure liquid refrigerant. In this process, the flow path is formed so that the second refrigerant and the second heat transfer medium flow in opposite directions to each other, in the third intermediate heat exchanger 13*a*.

The high-pressure liquid refrigerant which has flowed out of the third intermediate heat exchanger 13*a* flows into the second expansion device 16*c* to be thereby expanded and turns into low-temperature/low-pressure two-phase refrigerant. The low-temperature/low-pressure two-phase refrigerant flows into the heat source-side heat exchanger 12 which serves as an evaporator, and evaporates while removing heat from outside air, thereby turning into low-temperature/low-pressure gas refrigerant. The gas refrigerant which has flowed out of the heat source-side heat exchanger 12 passes through the third refrigerant flow switching device 11 and the accumulator 19, and is again sucked into the compressor 10*a*.

In the mentioned process, the opening degree of the second expansion device 16*c* is controlled to keep a degree of subcooling at a constant level, the degree of subcooling representing a difference between the saturation temperature calculated from the pressure detected by the high-pressure refrigerant pressure sensor 38*a* and the temperature detected by the intermediate heat exchanger refrigerant temperature sensor 35*e*. Here, the bypass flow control device 14 is fully closed.

In addition, the frequency (rotation speed) of the compressor 10*a* is controlled such that the temperature of the second heat transfer medium detected by the intermediate heat exchanger outlet temperature sensor 31*c* matches a target temperature. The control target of the temperature detected by the intermediate heat exchanger outlet temperature sensor 31*c* may be set to a range between, for example, 10 degrees Celsius and 40 degrees Celsius, and more preferably between 15 degrees Celsius and 35 degrees Celsius. The temperature in such a range facilitates production of cooled water and/or hot water, irrespective of the operation mode of the indoor unit 2. In addition, the temperature in the mentioned range suppresses heat transmission loss from the heat transfer medium pipe 5*a* to outside air, thereby improving the efficiency of the system as a whole, which contributes to saving of energy. Further, the temperature in the mentioned range enables the target temperature to be reached with the compressor 10*a* of a smaller capacity even though the temperature of outside air sent to the heat source-side heat exchanger 12 is relatively high, thereby allowing reduction in cost of the system.

Here, the target temperature may be varied depending on the operation mode of the relay unit 3. For example, the target temperature may be set to 40 degrees Celsius in the heating-only operation mode. Setting the second heat transfer medium to such a high temperature in the cooling-only operation mode enables the heating requirement from the indoor unit 2 to be satisfied despite employing the compressor 10*b* of a smaller capacity in the relay unit 3, thereby allowing reduction in cost of the system. In addition, the target temperature may be set, for example, to 10 degrees Celsius. Setting the second heat transfer medium to such a low temperature in the heating-only operation mode allows the compressor 10*a* of a lower compression ratio to be employed in the outdoor unit 1, thus allowing a compressor of a smaller capacity to be employed, which leads to reduction in cost of the system.

The frequency of the compressor 10*a* may be controlled such that the pressure of the second refrigerant detected by the high-pressure refrigerant pressure sensor 38*a* becomes close to a target pressure. Further, both of the frequency of the compressor 10*a* and the rotation speed of the non-illustrated fan for sending air to the heat source-side heat exchanger 12 may be controlled, such that the pressure (high pressure) of the second refrigerant detected by the high-pressure refrigerant pressure sensor 38*a* and the pressure (low pressure) of the second refrigerant detected by the low-pressure refrigerant pressure sensor 37*a* both become close to the target pressure. Alternatively, the frequency of the compressor 10*a* may be controlled such that the temperature detected by the intermediate heat exchanger outlet temperature sensor 31*c* becomes close to a target temperature.

Here, a minimum controllable frequency is specified in the compressor 10*a*. Accordingly, the temperature detected by the intermediate heat exchanger outlet temperature sensor 31*c* may be higher than the target temperature, and the pressure detected by the high-pressure refrigerant pressure sensor 38*a* may be higher than the target pressure even when the compressor 10*a* is driven at the minimum frequency, for example in the case where the temperature of outside air introduced into the heat source-side heat exchanger 12 is relatively high. In such a case, it is preferable to adjust the opening degree of the bypass flow control device 14, to bring the temperature detected by the intermediate heat exchanger outlet temperature sensor 31*c* and the pressure detected by the low-pressure refrigerant pressure sensor 37*a* close to the respective target values. Such an arrangement ensures that the operation status matches the control target irrespective of the environmental conditions, thereby stabilizing the operation of the system.

Employing an electronic expansion valve with variable opening degree as the bypass flow control device 14 allows the control to be smoothly performed, however different configurations may be adopted. For example, a plurality of solenoid valves may be provided to control the flow rate of the refrigerant in the refrigerant pipe 4*a* by controlling the number of solenoid valves to be opened. Instead, a single solenoid valve set to realize a predetermined flow rate upon being opened may be employed.

When the compressor 10*a* is controllable to a sufficiently low frequency, the bypass flow control device 14 and the refrigerant pipe 4*a* may be excluded, in which case no particular inconvenience will be incurred.

Hereunder, the flow of the second heat transfer medium from the outdoor unit 1 to the relay unit 3 in the second heat transfer medium circuit B will be described.

In the heating-only operation mode, the heating energy of the second refrigerant is transferred to the second heat transfer medium in the third intermediate heat exchanger 13*a*, and the pump 21*c* causes the heated second heat transfer medium to flow through the heat transfer medium pipe 5*a*. The second heat transfer medium pressurized by the pump 21*c* and discharged therefrom flows out of the outdoor unit 1 and flows into the relay unit 3 through the heat transfer medium pipe 5*a*. The second heat transfer medium which has entered the relay unit 3 flows into the second intermediate heat exchanger 13*b* through the second heat transfer medium flow control device 28. The second heat transfer medium transfers the heating energy to the second refrigerant in the second intermediate heat exchanger 13*b*, and flows out of the relay unit 3. The second heat transfer medium which has flowed out of the relay unit 3 flows into the outdoor unit 1 through the heat transfer medium pipe 5*a*, and then again flows into the third intermediate heat exchanger 13*a*.

In this process, the second heat transfer medium flow control device 28 controls the opening degree so that a difference between the temperature of the second heat transfer medium on the inlet side of the second intermediate heat exchanger 13*b* detected by the intermediate heat exchanger temperature sensor 33*a* and the temperature of the second heat transfer medium on the outlet side of the second intermediate heat exchanger 13*b* detected by the intermediate heat exchanger temperature sensor 33*b* matches a target value. Then the rotation speed of the pump 21*c* is controlled so that the opening degree of the second heat transfer medium flow control device 28 thus controlled becomes as close as possible to full-open. More specifically, when the opening degree of the second heat transfer medium flow control device 28 is considerably smaller than full-open, the rotation speed of the pump 21*c* is reduced. When the opening degree of the second heat transfer medium flow control device 28 is close to full-open, the pump 21*c* is controlled to maintain the same flow rate of the second heat transfer medium. Here, it is not mandatory that the second heat transfer medium flow control device 28 is fully opened, but it suffices that the second heat transfer medium flow control device 28 is opened to a substantially high degree, such as 90% or 85% of the fully opened state.

In this case, the controller 60 controlling the opening degree of the second heat transfer medium flow control device 28 is located inside or close to the relay unit 3. The controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the second heat transfer medium flow control device 28 to the controller 50 of the outdoor unit 1 through wired or wireless communication line 70 connecting between the relay unit 3 and the outdoor unit 1, to thereby perform a linkage control described as above.

The controller 50 of the outdoor unit 1 also controls the compressor 10*a*, the second expansion device 16*c*, the bypass flow control device 14, and the actuator on the refrigerant side such as the non-illustrated fan provided for the heat source-side heat exchanger 12.

Hereunder, the flow of the first refrigerant in the first refrigerant circuit C in the relay unit 3 will be described.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* is branched after passing through the first refrigerant flow switching device 27, the check valve 24*b*, and the refrigerant pipe 4*b*. The high-temperature/high-pressure gas refrigerant branched as above passes through the second refrigerant flow switching device 18*a* and the second refrigerant flow switching device 18*b*, and then flows into the first intermediate heat exchanger 15*a* and the first intermediate heat exchanger 15*b* acting as a condenser.

The high-temperature/high-pressure gas refrigerant which has entered the first intermediate heat exchanger 15*a* and the first intermediate heat exchanger 15*b* is condensed and liquefied while transferring heat to the first heat transfer medium circulating in the first heat transfer medium circuit D, thereby turning into high-pressure liquid refrigerant. In this process the flow path is formed so that the first heat transfer medium and the first refrigerant flow in opposite directions to each other in the first intermediate heat exchanger 15*a* and the first intermediate heat exchanger 15*b*.

The liquid refrigerant which has flowed out of the first intermediate heat exchanger 15*a* and the first intermediate heat exchanger 15*b* is expanded in the first expansion device 16*a* and the first expansion device 16*b* thus to turn into low-temperature/low-pressure two-phase refrigerant, and passes through the open/close device 17*b* and then flows into the second intermediate heat exchanger 13*b* acting as an evaporator, through the check valve 24*c* and the refrigerant pipe 4*c*. The refrigerant which has entered the second intermediate heat exchanger 13*b* removes heat from the second heat transfer medium flowing in the second heat transfer medium circuit B, thereby turning into low-temperature/low-pressure gas refrigerant, and is again sucked into the compressor 10*b* through the first refrigerant flow switching device 27. In this process the flow path is formed so that the first refrigerant and the second heat transfer medium flow parallel to each other in the second intermediate heat exchanger 13*b*.

In the mentioned process, the opening degree of the first expansion device 16*a* is controlled to keep a degree of subcooling at a constant level, the degree of subcooling representing a difference between a saturation temperature calculated from the pressure (high pressure) of the first refrigerant detected by the high-pressure refrigerant pressure sensor 38*b* and the temperature detected by the intermediate heat exchanger refrigerant temperature sensor 35*b*. Likewise, the opening degree of the first expansion device 16*b* is controlled to keep a degree of subcooling at a constant level, the degree of subcooling representing a difference between a saturation temperature calculated from the pressure (high pressure) of the first refrigerant detected by the high-pressure refrigerant pressure sensor 38*b* and the temperature detected by the intermediate heat exchanger refrigerant temperature sensor 35*b*. In addition, the open/close device 17*a* is opened and the open/close device 17*b* is closed. Here, in the case where the temperature at an intermediate position of the first intermediate heat exchanger 15 is measurable, the temperature at the intermediate position may be used instead of the high-pressure refrigerant pressure sensor 38*b*, in which case the system can be formed at a lower cost.

In addition, the compressor 10*b* is controlled so that the pressure (high pressure) of the first refrigerant detected by the high-pressure refrigerant pressure sensor 38*b* matches a target pressure, for example the saturation pressure corresponding to 49 degrees Celsius. Alternatively, the frequency of the compressor 10*b* may be controlled so that the temperature detected by the intermediate heat exchanger outlet temperature sensor 31*a* and/or the temperature detected by the intermediate heat exchanger outlet temperature sensor 31*b* becomes close to a target temperature.

The flow of the first heat transfer medium in the first heat transfer medium circuit D will now be described.

In the heating-only operation mode, the heating energy of the first refrigerant is transmitted to the first heat transfer medium in both of the first intermediate heat exchanger 15*a* and the first intermediate heat exchanger 15*b*, and the heated first heat transfer medium is driven by the pump 21*a* and the pump 21*b* to flow through the heat transfer medium pipe 5*b*. The first heat transfer medium pressurized by the pump 21*a* and the pump 21*b* and discharged therefrom flows into the use-side heat exchanger 26*a* and the use-side heat exchanger 26*b*, through the second heat transfer medium flow switching device 23*a* and the second heat transfer medium flow switching device 23*b*. Then the heat transfer medium transfers heat to indoor air in the use-side heat exchanger 26*a* and the use-side heat exchanger 26*b*, thereby heating the indoor space 7.

Thereafter, the first heat transfer medium flows out of the use-side heat exchanger 26*a* and the use-side heat exchanger 26*b* and flows into the first heat transfer medium flow control device 25*a* and the first heat transfer medium flow control device 25*b*. In the mentioned process, the flow rate of the first heat transfer medium flowing into the use-side heat exchanger 26*a* and the use-side heat exchanger 26*b* is controlled by the first heat transfer medium flow control device 25*a* and the first heat transfer medium flow control device 25*b* to satisfy the air-conditioning load required in the indoor space. The first heat transfer medium which has flowed out of the first heat transfer medium flow control device 25*a* and the first heat transfer medium flow control device 25*b* passes through the first heat transfer medium flow switching device 22*a* and the first heat transfer medium flow switching device 22*b*, and flows into the first intermediate heat exchanger 15*a* and the first intermediate heat exchanger 15*b*, and is again sucked into the pump 21*a* and the pump 21*b*.

In the heat transfer medium pipe 5*b* in the use-side heat exchanger 26, the heat transfer medium flows in the direction from the second heat transfer medium flow switching device 23 toward the first heat transfer medium flow switching device 22 through the first heat transfer medium flow control device 25. The air-conditioning load required in the indoor space 7 can be satisfied by controlling to maintain at a target value the difference between the temperature detected by the intermediate heat exchanger outlet temperature sensor 31*a* or the temperature detected by the intermediate heat exchanger outlet temperature sensor 31*b* and the temperature detected by the use-side heat exchanger outlet temperature sensor 34.

Either of the temperatures detected by the intermediate heat exchanger outlet temperature sensor 31*a* and the intermediate heat exchanger outlet temperature sensor 31*b*, or the average temperature thereof, may be adopted as the temperature at the outlet of the first intermediate heat exchanger 15. In the mentioned process, the first heat transfer medium flow switching device 22 and the second heat transfer medium flow switching device 23 are set to an opening degree that allows the flow path to be secured in both of the first intermediate heat exchanger 15*a* and the first intermediate heat exchanger 15*b*, and allows the flow rate to accord with the heat exchange amount.

[Cooling-Main Operation Mode]

Figure 5:
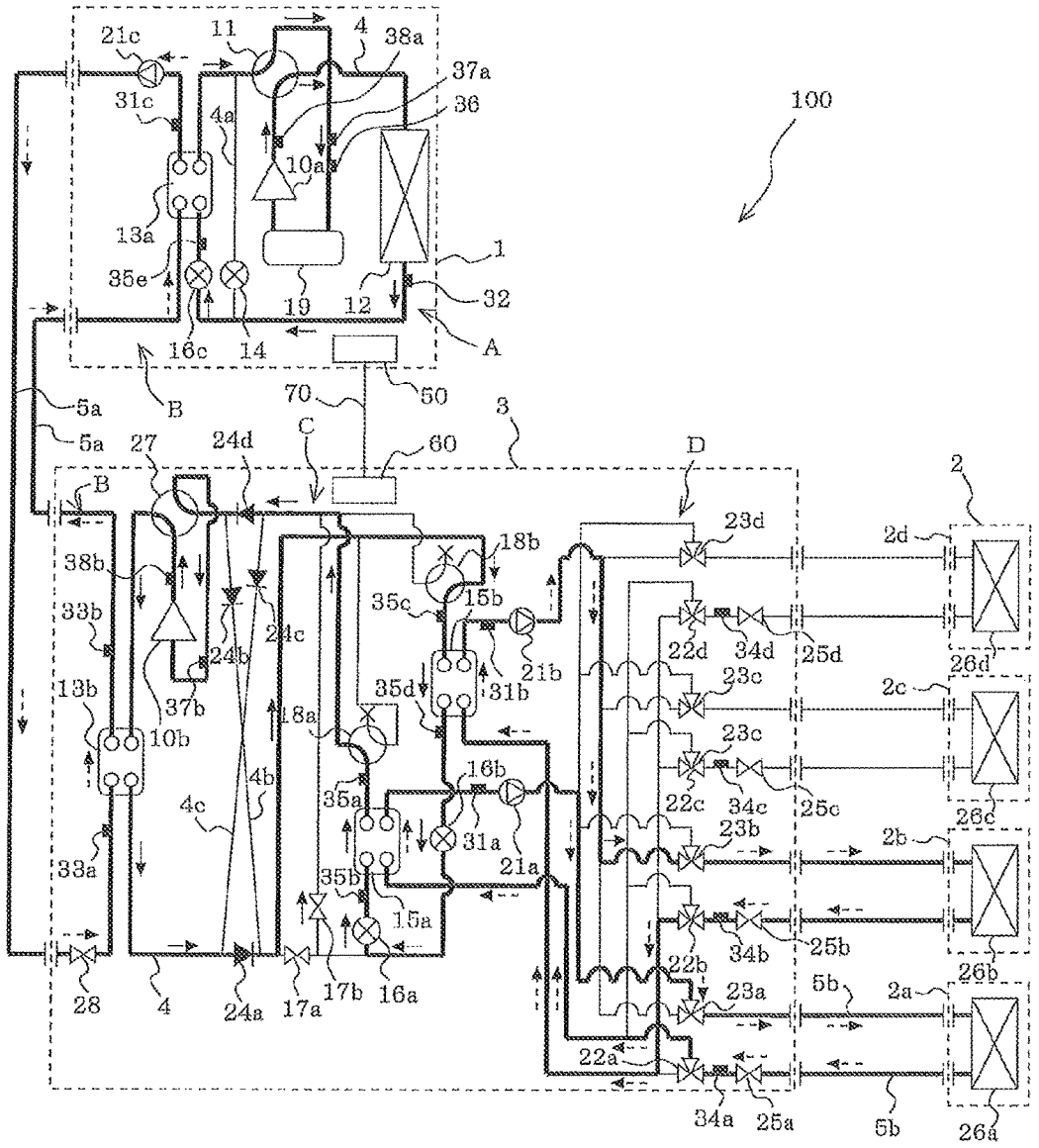
FIG. 5 is a system circuit diagram showing the flow of the refrigerant and the heat transfer medium in the air-conditioning apparatus according to Embodiment 1 of the present invention, in a cooling-main operation.

FIG. 5 is a system circuit diagram showing the flow of the refrigerant and the heat transfer medium in the air-conditioning apparatus 100, in the cooling-main operation mode. Referring to FIG. 5, the cooling-main operation mode will be described on the assumption that the cooling load has arisen in the use side heat exchanger 26*a* and the heating load has arisen in the use side heat exchanger 26*b*. In FIG. 5, the pipes illustrated in bold lines represent the pipes in which the refrigerant and the heat transfer medium flow. In addition, the flow of the refrigerant is indicated by solid arrows and the flow of the heat transfer medium is indicated by broken-line arrows.

In the cooling-main operation mode shown in FIG. 5, in the outdoor unit 1 the third refrigerant flow switching device 11 is switched to cause the refrigerant discharged from the compressor 10*a* to flow into the third intermediate heat exchanger 13*a* after passing through the heat source-side heat exchanger 12, and then the pump 21*c* is driven to circulate the second heat transfer medium. In the relay unit 3, the first refrigerant flow switching device 27 is switched to cause the refrigerant discharged from the compressor 10*b* to flow into the second intermediate heat exchanger 13*b*, and the pump 21*a* and the pump 21*b* are activated. The first heat transfer medium flow control device 25*a* and the first heat transfer medium flow control device 25*b* are fully opened, while the first heat transfer medium flow control device 25*c* and the first heat transfer medium flow control device 25*d* are fully closed, to allow the heat transfer medium to circulate between each of the first intermediate heat exchanger 15*a* and the first intermediate heat exchanger 15*b* and each of the use-side heat exchanger 26*a* and the use-side heat exchanger 26*b*.

First, the flow of the second refrigerant in the second refrigerant circuit A in the outdoor unit 1 will be described hereunder.

The second refrigerant in a low-temperature/low-pressure gas phase is compressed by the compressor 10*a* and discharged therefrom in the form of high-temperature/high-pressure gas refrigerant. The high-temperature/high-pressure gas refrigerant discharged from the compressor 10*a* flows into the heat source-side heat exchanger 12 which serves as a condenser, through the third refrigerant flow switching device 11. The second refrigerant is then condensed and liquefied while transmitting heat to outdoor air in the heat source-side heat exchanger 12, thereby turning into high-pressure liquid refrigerant.

The high-pressure liquid refrigerant which has flowed out of the heat source-side heat exchanger 12 flows into the second expansion device 16*c* to be thereby expanded and turns into low-temperature/low-pressure two-phase refrigerant. The low-temperature/low-pressure two-phase refrigerant flows into the third intermediate heat exchanger 13*a* which serves as an evaporator, and removes heat from the second heat transfer medium circulating in the second heat transfer medium circuit B thereby turning into low-temperature/low-pressure gas refrigerant while cooling the second heat transfer medium. In this process, the flow path is formed so that the second refrigerant and the second heat medium flow parallel to each other in the third intermediate heat exchanger 13*a*. The gas refrigerant which has flowed out of the third intermediate heat exchanger 13*a* passes through the third refrigerant flow switching device 11 and the accumulator 19, and is again sucked into the compressor 10*a*.

In the mentioned process, the opening degree of the second expansion device 16*c* is controlled to keep a degree of superheating at a constant level, the degree of superheating representing a difference between the temperature detected by the compressor-sucked refrigerant temperature sensor 36 and the temperature detected by the intermediate heat exchanger refrigerant temperature sensor 35*e*. Here, the bypass flow control device 14 is fully closed.

In addition, the frequency (rotation speed) of the compressor 10*a* is controlled such that the temperature of the second heat transfer medium detected by the intermediate heat exchanger outlet temperature sensor 31*c* matches a target temperature. The control target of the temperature detected by the intermediate heat exchanger outlet temperature sensor 31*c* may be set to a range between, for example, 10 degrees Celsius and 40 degrees Celsius, and more preferably between 15 degrees Celsius and 35 degrees Celsius. The temperature in such a range facilitates production of cooled water and/or hot water, irrespective of the operation mode of the indoor unit 2. In addition, the temperature in the mentioned range suppresses heat transmission loss from the heat transfer medium pipe 5*a* to outside air, thereby improving the efficiency of the system as a whole, which contributes to saving of energy. Further, the temperature in the mentioned range enables the target temperature to be reached with the compressor 10*a* of a smaller capacity even though the temperature of outside air sent to the heat source-side heat exchanger 12 is relatively high, thereby allowing reduction in cost of the system.

The frequency of the compressor 10*a* may be controlled such that the pressure of the second refrigerant detected by the low-pressure refrigerant pressure sensor 37*a* becomes close to a target pressure. Further, both of the frequency of the compressor 10*a* and the rotation speed of the non-illustrated fan for sending air to the heat source-side heat exchanger 12 may be controlled, such that the pressure (low pressure) of the second refrigerant detected by the low-pressure refrigerant pressure sensor 37*a* and the pressure (high pressure) of the second refrigerant detected by the high-pressure refrigerant pressure sensor 38*a* both become close to the target pressure. Alternatively, the frequency of the compressor 10*a* may be controlled such that the temperature detected by the intermediate heat exchanger outlet temperature sensor 31*c* becomes close to a target temperature.

Here, a minimum controllable frequency is specified in the compressor 10*a*. Accordingly, the temperature detected by the intermediate heat exchanger outlet temperature sensor 31*c* may be lower than the target temperature, and the pressure detected by the low-pressure refrigerant pressure sensor 37*a* may be lower than the target pressure even when the compressor 10*a* is driven at the minimum frequency, for example in the case where the temperature of outside air introduced into the heat source-side heat exchanger 12 is relatively low. In such a case, it is preferable to adjust the opening degree of the bypass flow control device 14, to bring the temperature detected by the intermediate heat exchanger outlet temperature sensor 31*c* and the pressure detected by the low-pressure refrigerant pressure sensor 37*a* close to the respective target values. Such an arrangement ensures that the operation status matches the control target irrespective of the environmental conditions, thereby stabilizing the operation of the system.

The mentioned arrangement also prevents the third intermediate heat exchanger 13*a* from bursting when the temperature of the second refrigerant flowing in the third intermediate heat exchanger 13*a* excessively drops to the point of freezing, thereby upgrading the safety level of the system. In the case of controlling the bypass flow control device 14 as above, the liquid refrigerant or the two-phase refrigerant of low dryness flows in the refrigerant pipe 4*a* and joins with the gas-phase second refrigerant flowing out of the third intermediate heat exchanger 13*a*. Accordingly, the temperature of the two-phase refrigerant of high dryness is detected by the compressor-sucked refrigerant temperature sensor 36 as the temperature of the second refrigerant, and therefore the second expansion device 16*c* is disabled from controlling the dryness.

In such a case, for example the ratio between the opening degree of the second expansion device 16*c* and the opening degree of the bypass flow control device 14 may be set to a fixed value, and the both opening degrees may be collectively controlled to turn the second refrigerant passing through the compressor-sucked refrigerant temperature sensor 36 into the gas refrigerant. Alternatively, a non-illustrated additional sensor capable of detecting the temperature of the refrigerant may be provided on the outlet side of the third intermediate heat exchanger 13*a*, which is opposite to the inlet side where the intermediate heat exchanger refrigerant temperature sensor 35*e* is provided, and the opening degree of the second expansion device 16*c* may be controlled such that the degree of superheating matches a target value, the degree of superheating representing a difference between the temperature detected by the additional sensor and the temperature detected by the intermediate heat exchanger refrigerant temperature sensor 35*e*.

Employing an electronic expansion valve with variable opening degree as the bypass flow control device 14 allows the control to be smoothly performed, however different configurations may be adopted. For example, a plurality of solenoid valves may be provided to control the flow rate of the refrigerant in the refrigerant pipe 4*a* by controlling the number of solenoid valves to be opened. Instead, a single solenoid valve set to realize a predetermined flow rate when opened may be employed. Although such a configuration slightly degrades the controllability, the third intermediate heat exchanger 13*a* can be prevented from bursting due to freezing.

When the compressor 10*a* is controllable to a sufficiently low frequency, the bypass flow control device 14 and the refrigerant pipe 4*a* may be excluded, in which case no particular inconvenience will be incurred.

Hereunder, the flow of the second heat transfer medium from the outdoor unit 1 to the relay unit 3 in the second heat transfer medium circuit B will be described.

In the cooling-main operation mode, the cooling energy of the second refrigerant is transferred to the second heat transfer medium in the third intermediate heat exchanger 13*a*, and the pump 21*c* causes the cooled second heat transfer medium to flow through the heat transfer medium pipe 5*a*. The second heat transfer medium pressurized by the pump 21*c* and discharged therefrom flows out of the outdoor unit 1 and flows into the relay unit 3 through the heat transfer medium pipe 5*a*. The second heat transfer medium which has entered the relay unit 3 flows into the second intermediate heat exchanger 13*b* through the second heat transfer medium flow control device 28. The second heat transfer medium transmits the cooling energy to the second refrigerant in the second intermediate heat exchanger 13*b*, and then flows out of the relay unit 3 and flows into the outdoor unit 1 through the heat transfer medium pipe 5*a*, and then again flows into the third intermediate heat exchanger 13*a*.

In this process, the second heat transfer medium flow control device 28 controls the opening degree to bring the pressure on the high pressure-side in the first refrigerant circuit C to be subsequently described close to a target pressure, to control the flow rate of the second heat transfer medium flowing in the second intermediate heat exchanger. Then the rotation speed of the pump 21*c* is controlled so that the opening degree of the second heat transfer medium flow control device 28 thus controlled becomes as close as possible to full-open. More specifically, when the opening degree of the second heat transfer medium flow control device 28 is considerably smaller than full-open, the rotation speed of the pump 21*c* is reduced. When the opening degree of the second heat transfer medium flow control device 28 is close to full-open, the pump 21*c* is controlled to maintain the same flow rate of the second heat transfer medium. Here, it is not mandatory that the second heat transfer medium flow control device 28 is fully opened, but it suffices that the second heat transfer medium flow control device 28 is opened to a substantially high degree, such as 90% or 85% of the fully opened state.

In this case, the controller 60 controlling the opening degree of the second heat transfer medium flow control device 28 is located inside or close to the relay unit 3. The controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the second heat transfer medium flow control device 28 to the controller 50 of the outdoor unit 1 through wired or wireless communication line 70 connecting between the relay unit 3 and the outdoor unit 1, to thereby perform a linkage control described as above.

The controller 50 of the outdoor unit 1 also controls the non-illustrated fan provided for the third intermediate heat exchanger 13*a*.

The controller 50 of the outdoor unit 1 also controls the compressor 10*a*, the second expansion device 16*c*, the bypass flow control device 14, and the actuator on the refrigerant side such as the non-illustrated fan provided for the heat source-side heat exchanger 12.

Hereunder, the flow of the first refrigerant in the first refrigerant circuit C in the relay unit 3 will be described.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* flows into the second intermediate heat exchanger 13*b* acting as a first condenser, through the first refrigerant flow switching device 27, and is condensed while transferring heat to the second heat transfer medium in the second intermediate heat exchanger 13*b*, thereby turning into high-pressure two-phase refrigerant. In this process the flow path is formed so that the second heat transfer medium and the first refrigerant flow in opposite directions to each other in the second intermediate heat exchanger 13*b*.

The high-pressure two-phase refrigerant which has flowed out of the second intermediate heat exchanger 13*b* flows into the first intermediate heat exchanger 15*b* acting as a second condenser through the check valve 24*a* and the second refrigerant flow switching device 18*b*. The high-pressure two-phase refrigerant which has entered the first intermediate heat exchanger 15*b* is condensed and liquefied while transferring heat to the first heat transfer medium circulating in the first heat transfer medium circuit D, thereby turning into liquid refrigerant. In this process the flow path is formed so that the first refrigerant and the first heat transfer medium flow in opposite directions to each other in the first intermediate heat exchanger 15*b*.

The liquid refrigerant which has flowed out of the first intermediate heat exchanger 15*b* is expanded in the first expansion device 16*b* thus to turn into low-pressure two-phase refrigerant, and flows into the first intermediate heat exchanger 15*a* acting as an evaporator, through the first expansion device 16*a*.

The low-pressure two-phase refrigerant which has entered the first intermediate heat exchanger 15*a* removes heat from the first heat transfer medium circulating in the first heat transfer medium circuit D thereby cooling the first heat transfer medium and thus turning into low-pressure gas refrigerant. In this process the flow path is formed so that the first refrigerant and the first heat transfer medium flow in parallel to each other in the first intermediate heat exchanger 15*a*.

The gas refrigerant which has flowed out of the first intermediate heat exchanger 15*a* passes through the second refrigerant flow switching device 18*a*, the check valve 24*d*, and the first refrigerant flow switching device 27, and is again sucked into the compressor 10*b*.

In the mentioned process, the opening degree of the first expansion device 16*b* is controlled to keep a degree of superheating at a constant level, the degree of superheating representing a difference between the temperature detected by the intermediate heat exchanger refrigerant temperature sensor 35*a* and the temperature detected by the intermediate heat exchanger refrigerant temperature sensor 35*b*. Here, the first expansion device 16*a* is fully opened, the open/close device 17*a* is closed, and the open/close device 17*b* is closed. Alternatively, the opening degree of the first expansion device 16*b* may be controlled to keep a degree of subcooling at a constant level, the degree of subcooling representing a difference between a saturation temperature converted from the pressure detected by the high-pressure refrigerant pressure sensor 38*b* and the temperature detected by the intermediate heat exchanger refrigerant temperature sensor 35*b*. Further, the first expansion device 16*b* may be fully opened and the first expansion device 16*a* may be used to control the superheating or subcooling.

The frequency of the compressor 10*b* and the opening degree of the second heat transfer medium flow control device 28 are controlled so that the pressure (low pressure) of the first refrigerant detected by the low-pressure refrigerant pressure sensor 37*b* and the pressure (high pressure) of the first refrigerant detected by the high-pressure refrigerant pressure sensor 38*b* match the respective target pressures. The target value may be, for example, the saturation pressure corresponding to 49 degrees Celsius on the high pressure-side, and the saturation pressure corresponding to 0 degrees Celsius on the low pressure-side. By controlling the frequency of the compressor 10*b* the flow rate of the first refrigerant flowing in the first intermediate heat exchanger 15 and the second intermediate heat exchanger 13*b* can be adjusted, and by controlling the opening degree of the second heat transfer medium flow control device 28 the flow rate of the second heat transfer medium flowing in the second intermediate heat exchanger 13*b* can be adjusted. Through such control the heat exchange amount between the refrigerant and the heat transfer medium can be adjusted in the first intermediate heat exchanger 15*a*, the first intermediate heat exchanger 15*b*, and the second intermediate heat exchanger 13*b*, and therefore both of the high pressure-side pressure and the low pressure-side pressure can be controlled to the respective target values.

Further, the frequency of the compressor 10*b* and the opening degree of the second heat transfer medium flow control device 28 may be controlled so that the temperature detected by the intermediate heat exchanger outlet temperature sensor 31*a* and the temperature detected by the intermediate heat exchanger outlet temperature sensor 31*b* become close to the target temperature.

The flow of the first heat transfer medium in the first heat transfer medium circuit D will now be described.

In the cooling-main operation mode, the heating energy of the first refrigerant is transmitted to the first heat transfer medium in the first intermediate heat exchanger 15*b*, and the heated first heat transfer medium is driven by the pump 21*b* to flow through the heat transfer medium pipe 5*b*. In the cooling-main operation mode, in addition, the cooling energy of the first refrigerant is transmitted to the first heat transfer medium in the first intermediate heat exchanger 15*a*, and the cooled first heat transfer medium is driven by the pump 21*a* to flow through the heat transfer medium pipe 5*b*. The first heat transfer medium pressurized by the pump 21*a* and the pump 21*b* and discharged therefrom flows into the use-side heat exchanger 26*a* and the use-side heat exchanger 26*b*, through the second heat transfer medium flow switching device 23*a* and the second heat transfer medium flow switching device 23*b*.

The first heat transfer medium transfers heat to indoor air in the use-side heat exchanger 26*b*, thereby heating the indoor space 7. In contrast, the first heat transfer medium removes heat from indoor air in the use-side heat exchanger 26*a*, thereby cooling the indoor space 7. In the mentioned process, the flow rate of the heat transfer medium flowing into the use-side heat exchanger 26*a* and the use-side heat exchanger 26*b* is controlled by the first heat transfer medium flow control device 25*a* and the first heat transfer medium flow control device 25*b* to satisfy the air-conditioning load required in the indoor space. The heat transfer medium with the temperature slightly lowered by passing through the use-side heat exchanger 26*b* flows into the first intermediate heat exchanger 15*b* through the first heat transfer medium flow control device 25*b* and the first heat transfer medium flow switching device 22*b*, and is again sucked into the pump 21*b*. The heat transfer medium with the temperature slightly increased by passing through the use-side heat exchanger 26*a* flows into the first intermediate heat exchanger 15*a* through the first heat transfer medium flow control device 25*a* and the first heat transfer medium flow switching device 22*a*, and is again sucked into the pump 21*a*.

In the mentioned process, the heated first heat transfer medium and the cooled first heat transfer medium are introduced into the respective use-side heat exchangers 26 where the heating load and the cooling load are present, without being mixed with each other, under the control of the first heat transfer medium flow switching device 22 and the second heat transfer medium flow switching device 23. In the heat transfer medium pipe 5*b* in the use-side heat exchanger 26, the heat transfer medium flows in the direction from the second heat transfer medium flow switching device 23 toward the first heat transfer medium flow switching device 22 through the first heat transfer medium flow control device 25, on both of the heating and cooling sides. The air-conditioning load required in the indoor space 7 can be satisfied by controlling to maintain at a target value the difference between the temperature detected by the intermediate heat exchanger outlet temperature sensor 31*b* and the temperature detected by the use-side heat exchanger outlet temperature sensor 34 on the heating side, and the difference between the temperature detected by the intermediate heat exchanger outlet temperature sensor 31*a* and the temperature detected by the use-side heat exchanger outlet temperature sensor 34 on the cooling side.

[Heating-Main Operation Mode]

Figure 6:
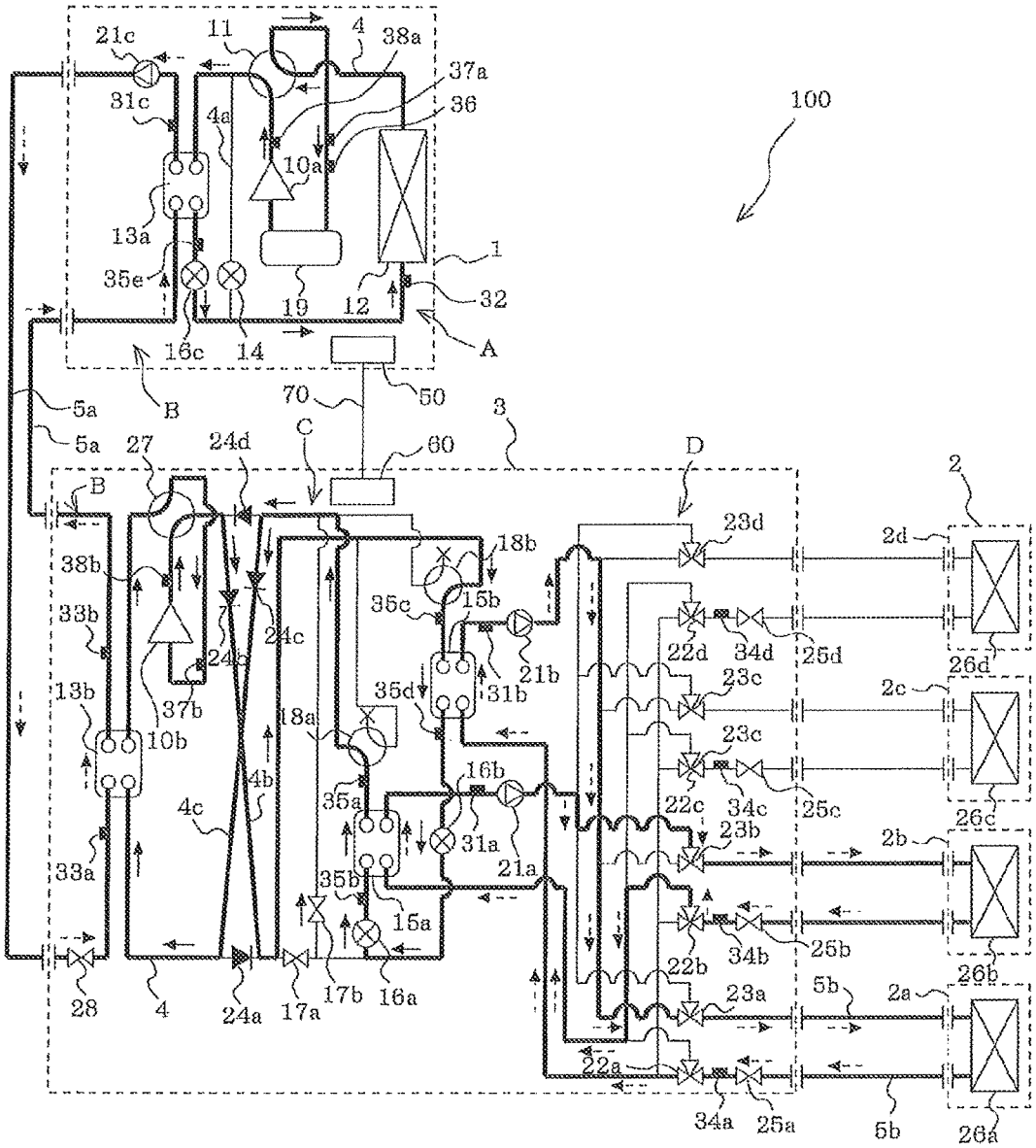
FIG. 6 is a system circuit diagram showing the flow of the refrigerant and the heat transfer medium in the air-conditioning apparatus according to Embodiment 1 of the present invention, in a heating-main operation.

FIG. 6 is a system circuit diagram showing the flow of the refrigerant and the heat transfer medium in the air-conditioning apparatus 100, in the heating-main operation mode. Referring to FIG. 6, the heating-main operation mode will be described on the assumption that the heating load has arisen in the use side heat exchanger 26*a* and the cooling load has arisen in the use side heat exchanger 26*b*. In FIG. 6, the pipes illustrated in bold lines represent the pipes in which the refrigerant and the heat transfer medium flow. In addition, the flow of the refrigerant is indicated by solid arrows and the flow of the heat transfer medium is indicated by broken-line arrows.

In the heating-main operation mode shown in FIG. 6, in the outdoor unit 1 the third refrigerant flow switching device 11 is switched to cause the refrigerant discharged from the compressor 10*a* to flow into the heat source-side heat exchanger 12 after passing through the third intermediate heat exchanger 13*a*, and then the pump 21*c* is driven to circulate the second heat transfer medium. In the relay unit 3, the first refrigerant flow switching device 27 is switched to cause the refrigerant discharged from the second intermediate heat exchanger 13*b* to flow into the compressor 10*b*, and the pump 21*a* and the pump 21*b* are activated. The first heat transfer medium flow control device 25*a* and the first heat transfer medium flow control device 25*b* are fully opened, while the first heat transfer medium flow control device 25*c* and the first heat transfer medium flow control device 25*d* are fully closed, to cause the heat transfer medium to circulate between the first intermediate heat exchanger 15*a* and the use-side heat exchanger 26*b*, as well as between the first intermediate heat exchanger 15*b* and the use-side heat exchanger 26*a*.

First, the flow of the second refrigerant in the second refrigerant circuit A in the outdoor unit 1 will be described hereunder.

The second refrigerant in a low-temperature/low-pressure gas phase is compressed by the compressor 10*a* and discharged therefrom in the form of high-temperature/high-pressure gas refrigerant. The high-temperature/high-pressure gas refrigerant discharged from the compressor 10*a* flows into the third intermediate heat exchanger 13*a* which serves as a condenser, through the third refrigerant flow switching device 11. The second refrigerant is then condensed and liquefied while transmitting heat in the third intermediate heat exchanger 13*a* to the second heat transfer medium circulating in the second heat transfer medium circuit B, thereby turning into high-pressure liquid refrigerant. In this process, the flow path is formed so that the second refrigerant and the second heat transfer medium flow in opposite directions to each other, in the third intermediate heat exchanger 13*a*.

The high-pressure liquid refrigerant which has flowed out of the third intermediate heat exchanger 13*a* flows into the second expansion device 16*c* to be thereby expanded and turns into low-temperature/low-pressure two-phase refrigerant. The low-temperature/low-pressure two-phase refrigerant flows into the heat source-side heat exchanger 12 which serves as an evaporator, and evaporates while removing heat from outside air, thereby turning into low-temperature/low-pressure gas refrigerant. The gas refrigerant which has flowed out of the heat source-side heat exchanger 12 passes through the third refrigerant flow switching device 11 and the accumulator 19, and is again sucked into the compressor 10*a*.

In the mentioned process, the opening degree of the second expansion device 16*c* is controlled to keep a degree of subcooling at a constant level, the degree of subcooling representing a difference between the saturation temperature calculated from the pressure detected by the high-pressure refrigerant pressure sensor 38*a* and the temperature detected by the intermediate heat exchanger refrigerant temperature sensor 35*e*. Here, the bypass flow control device 14 is fully closed.

In addition, the frequency (rotation speed) of the compressor 10*a* is controlled such that the temperature of the second heat transfer medium detected by the intermediate heat exchanger outlet temperature sensor 31*c* matches a target temperature. The control target of the temperature detected by the intermediate heat exchanger outlet temperature sensor 31*c* may be set to a range between, for example, 10 degrees Celsius and 40 degrees Celsius, and more preferably between 15 degrees Celsius and 35 degrees Celsius. The temperature in such a range facilitates production of cooled water and/or hot water, irrespective of the operation mode of the indoor unit 2. In addition, the temperature in the mentioned range suppresses heat transmission loss from the heat transfer medium pipe 5*a* to outside air, thereby improving the efficiency of the system as a whole, which contributes to saving of energy. Further, the temperature in the mentioned range enables the target temperature to be reached with the compressor 10*a* of a smaller capacity even though the temperature of outside air sent to the heat source-side heat exchanger 12 is relatively high, thereby allowing reduction in cost of the system.

The frequency of the compressor 10*a* may be controlled such that the pressure of the second refrigerant detected by the high-pressure refrigerant pressure sensor 38*a* becomes close to a target pressure. Further, both of the frequency of the compressor 10*a* and the rotation speed of the non-illustrated fan for sending air to the heat source-side heat exchanger 12 may be controlled, such that the pressure (high pressure) of the second refrigerant detected by the high-pressure refrigerant pressure sensor 38*a* and the pressure (low pressure) of the second refrigerant detected by the low-pressure refrigerant pressure sensor 37*a* both become close to the target pressure. Alternatively, the frequency of the compressor 10*a* may be controlled such that the temperature detected by the intermediate heat exchanger outlet temperature sensor 31*c* becomes close to a target temperature.

Here, a minimum controllable frequency is specified in the compressor 10*a*. Accordingly, the temperature detected by the intermediate heat exchanger outlet temperature sensor 31*c* may be higher than the target temperature, and the pressure detected by the high-pressure refrigerant pressure sensor 38*a* may be higher than the target pressure even when the compressor 10*a* is driven at the minimum frequency, for example in the case where the temperature of outside air introduced into the heat source-side heat exchanger 12 is relatively high. In such a case, it is preferable to adjust the opening degree of the bypass flow control device 14, to bring the temperature detected by the intermediate heat exchanger outlet temperature sensor 31*c* and the pressure detected by the low-pressure refrigerant pressure sensor 37*a* close to the respective target values. Such an arrangement ensures that the operation status matches the control target irrespective of the environmental conditions, thereby stabilizing the operation of the system.

Employing an electronic expansion valve with variable opening degree as the bypass flow control device 14 allows the control to be smoothly performed, however different configurations may be adopted. For example, a plurality of solenoid valves may be provided to control the flow rate of the refrigerant in the refrigerant pipe 4*a* by controlling the number of solenoid valves to be opened. Instead, a single solenoid valve set to realize a predetermined flow rate when opened may be employed.

When the compressor 10*a* is controllable to a sufficiently low frequency, the bypass flow control device 14 and the refrigerant pipe 4*a* may be excluded, in which case no particular inconvenience will be incurred.

Hereunder, the flow of the second heat transfer medium from the outdoor unit 1 to the relay unit 3 in the second heat transfer medium circuit B will be described.

In the heating-main operation mode, the heating energy of the second heat transfer medium is transferred to the second heat transfer medium in the third intermediate heat exchanger 13*a*, and the pump 21*c* causes the heated second heat transfer medium to flow through the heat transfer medium pipe 5*a*. The second heat transfer medium pressurized by the pump 21*c* and discharged therefrom flows out of the outdoor unit 1 and flows into the relay unit 3 through the heat transfer medium pipe 5*a*. The second heat transfer medium which has entered the relay unit 3 flows into the second intermediate heat exchanger 13*b* through the second heat transfer medium flow control device 28. The second heat transfer medium transmits the heating energy to the second refrigerant in the second intermediate heat exchanger 13*b*, and then flows out of the relay unit 3 and flows into the outdoor unit 1 through the heat transfer medium pipe 5*a*, and then again flows into the third intermediate heat exchanger 13*a*.

In this process, the second heat transfer medium flow control device 28 controls the opening degree to bring the pressure on the low pressure-side in the first refrigerant circuit C to be subsequently described close to a target pressure, to control the flow rate of the second heat transfer medium flowing in the second intermediate heat exchanger 13*b*. Then the rotation speed of the pump 21*c* is controlled so that the opening degree of the second heat transfer medium flow control device 28 thus controlled becomes as close as possible to full-open. More specifically, when the opening degree of the second heat transfer medium flow control device 28 is considerably smaller than full-open, the rotation speed of the pump 21*c* is reduced. When the opening degree of the second heat transfer medium flow control device 28 is close to full-open, the pump 21*c* is controlled to maintain the same flow rate of the second heat transfer medium. Here, it is not mandatory that the second heat transfer medium flow control device 28 is fully opened, but it suffices that the second heat transfer medium flow control device 28 is opened to a substantially high degree, such as 90% or 85% of the fully opened state.

In this case, the controller 60 controlling the opening degree of the second heat transfer medium flow control device 28 is located inside or close to the relay unit 3. The controller 50 controlling the rotation speed of the pump 21*c* is located inside or close to the outdoor unit 1. For example, the outdoor unit 1 (controller 50) may be installed on the roof of the building while the relay unit 3 (controller 60) is installed behind the ceiling of a predetermined floor of the building, in other words away from each other. Accordingly, the controller 60 of the relay unit 3 transmits a signal indicating the opening degree of the second heat transfer medium flow control device 28 to the controller 50 of the outdoor unit 1 through wired or wireless communication line 70 connecting between the relay unit 3 and the outdoor unit 1, to thereby perform a linkage control described as above.

The controller 50 of the outdoor unit 1 also controls the compressor 10*a*, the second expansion device 16*c*, the bypass flow control device 14, and the actuator on the refrigerant side such as the non-illustrated fan provided for the heat source-side heat exchanger 12.

Hereunder, the flow of the first refrigerant in the first refrigerant circuit C in the relay unit 3 will be described.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* passes through the first refrigerant flow switching device 27, the check valve 24*b* and the refrigerant pipe 4*b*, and the second refrigerant flow switching device 18*b*, and then flows into the first intermediate heat exchanger 15*b* acting as a condenser. The gas refrigerant which has entered the first intermediate heat exchanger 15*b* is condensed and liquefied while transferring heat to the first heat transfer medium circulating in the first heat transfer medium circuit D, thereby turning into liquid refrigerant. In this process the flow path is formed so that the first heat transfer medium and the first refrigerant flow in opposite directions to each other in the first intermediate heat exchanger 15*b*.

The liquid refrigerant which has flowed out of the first intermediate heat exchanger 15*b* is expanded in the first expansion device 16*b* thus to turn into low-pressure two-phase refrigerant, and flows into the first intermediate heat exchanger 15*a* acting as an evaporator, through the first expansion device 16*a*.

The low-pressure two-phase refrigerant which has entered the first intermediate heat exchanger 15*a* is evaporated by removing heat from the first heat transfer medium circulating in the first heat transfer medium circuit D, thereby cooling the first heat transfer medium. In this process the flow path is formed so that the first refrigerant and the first heat transfer medium flow in parallel to each other in the first intermediate heat exchanger 15*a*.

The low-pressure two-phase refrigerant which has flowed out of the first intermediate heat exchanger 15*a* passes through the second refrigerant flow switching device 18*a*, the check valve 24*c*, and flows into the second intermediate heat exchanger 13*b* acting as an evaporator. The refrigerant which has entered the second intermediate heat exchanger 13*b* removes heat from the second heat transfer medium circulating in the second heat transfer medium circuit B thereby turning into low-temperature/low-pressure gas refrigerant, and is again sucked into the compressor 10*b* through the first refrigerant flow switching device 27.

In the mentioned process, the opening degree of the first expansion device 16*b* is controlled to keep a degree of subcooling at a constant level, the degree of subcooling representing a difference between a saturation temperature converted from the pressure detected by the high-pressure refrigerant pressure sensor 38*b* and the temperature detected by the intermediate heat exchanger refrigerant temperature sensor 35*d*. The first expansion device 16*a* is fully opened, the open/close device 17*a* is closed, and the open/close device 17*b* is closed. Alternatively, the first expansion device 16*b* may be fully opened and the first expansion device 16*a* may be used to control the superheating or subcooling.

The frequency of the compressor 10*b* and the opening degree of the second heat transfer medium flow control device 28 are controlled so that the pressure (low pressure) of the first refrigerant detected by the low-pressure refrigerant pressure sensor 37*b* and the pressure (high pressure) of the first refrigerant detected by the high-pressure refrigerant pressure sensor 38*b* match the respective target pressures. The target value may be, for example, the saturation pressure corresponding to 49 degrees Celsius on the high pressure-side, and the saturation pressure corresponding to 0 degrees Celsius on the low pressure-side. By controlling the frequency of the compressor 10*b* the flow rate of the first refrigerant flowing in the first intermediate heat exchanger 15 and the second intermediate heat exchanger 13*b* can be adjusted, and by controlling the opening degree of the second heat transfer medium flow control device 28 the flow rate of the second heat transfer medium flowing in the second intermediate heat exchanger 13*b* can be adjusted. Through such control the heat exchange amount between the refrigerant and the heat transfer medium can be adjusted in the first intermediate heat exchanger 15*a*, the first intermediate heat exchanger 15*b*, and the second intermediate heat exchanger 13*b*, and therefore both of the high pressure-side pressure and the low pressure-side pressure can be controlled to the respective target values.

Further, the frequency of the compressor 10*b* and the opening degree of the second heat transfer medium flow control device 28 may be controlled so that the temperature detected by the intermediate heat exchanger outlet temperature sensor 31*a* and the temperature detected by the intermediate heat exchanger outlet temperature sensor 31*b* become close to the target temperature.

The flow of the first heat transfer medium in the first heat transfer medium circuit D will now be described.

In the heating-main operation mode, the heating energy of the first refrigerant is transmitted to the first heat transfer medium in the first intermediate heat exchanger 15*b*, and the heated first heat transfer medium is driven by the pump 21*b* to flow through the heat transfer medium pipe 5*b*. In the heating-main operation mode, in addition, the cooling energy of the first refrigerant is transmitted to the first heat transfer medium in the first intermediate heat exchanger 15*a*, and the cooled first heat transfer medium is driven by the pump 21*a* to flow through the heat transfer medium pipe 5*b*. The first heat transfer medium pressurized by the pump 21*a* and the pump 21*b* and discharged therefrom flows into the use-side heat exchanger 26*a* and the use-side heat exchanger 26*b*, through the second heat transfer medium flow switching device 23*a* and the second heat transfer medium flow switching device 23*b*.

The first heat transfer medium removes heat from indoor air in the use-side heat exchanger 26*b*, thereby cooling the indoor space 7. In contrast, the first heat transfer medium transfers heat to indoor air in the use-side heat exchanger 26*a*, thereby heating the indoor space 7. In the mentioned process, the flow rate of the heat transfer medium flowing into the use-side heat exchanger 26*a* and the use-side heat exchanger 26*b* is controlled by the first heat transfer medium flow control device 25*a* and the first heat transfer medium flow control device 25*b* to satisfy the air-conditioning load required in the indoor space. The heat transfer medium with the temperature slightly increased by passing through the use-side heat exchanger 26*b* flows into the first intermediate heat exchanger 15*a* through the first heat transfer medium flow control device 25*b* and the first heat transfer medium flow switching device 22*b*, and is again sucked into the pump 21*a*. The heat transfer medium with the temperature slightly lowered by passing through the use-side heat exchanger 26*a* flows into the first intermediate heat exchanger 15*b* through the first heat transfer medium flow control device 25*a* and the first heat transfer medium flow switching device 22*a*, and is again sucked into the pump 21*b*.

In the mentioned process, the heated first heat transfer medium and the cooled first heat transfer medium are introduced into the respective use-side heat exchangers 26 where the heating load and the cooling load are present, without being mixed with each other, under the control of the first heat transfer medium flow switching device 22 and the second heat transfer medium flow switching device 23. In the heat transfer medium pipe 5*b* in the use-side heat exchanger 26, the heat transfer medium flows in the direction from the second heat transfer medium flow switching device 23 toward the first heat transfer medium flow switching device 22 through the first heat transfer medium flow control device 25, on both of the heating and cooling sides. The air-conditioning load required in the indoor space 7 can be satisfied by controlling to maintain at a target value the difference between the temperature detected by the intermediate heat exchanger outlet temperature sensor 31*b* and the temperature detected by the use-side heat exchanger outlet temperature sensor 34 on the heating side, and the difference between the temperature detected by the intermediate heat exchanger outlet temperature sensor 31*a* and the temperature detected by the use-side heat exchanger outlet temperature sensor 34 on the cooling side.

[Defrosting Operation Mode]

Figure 7:
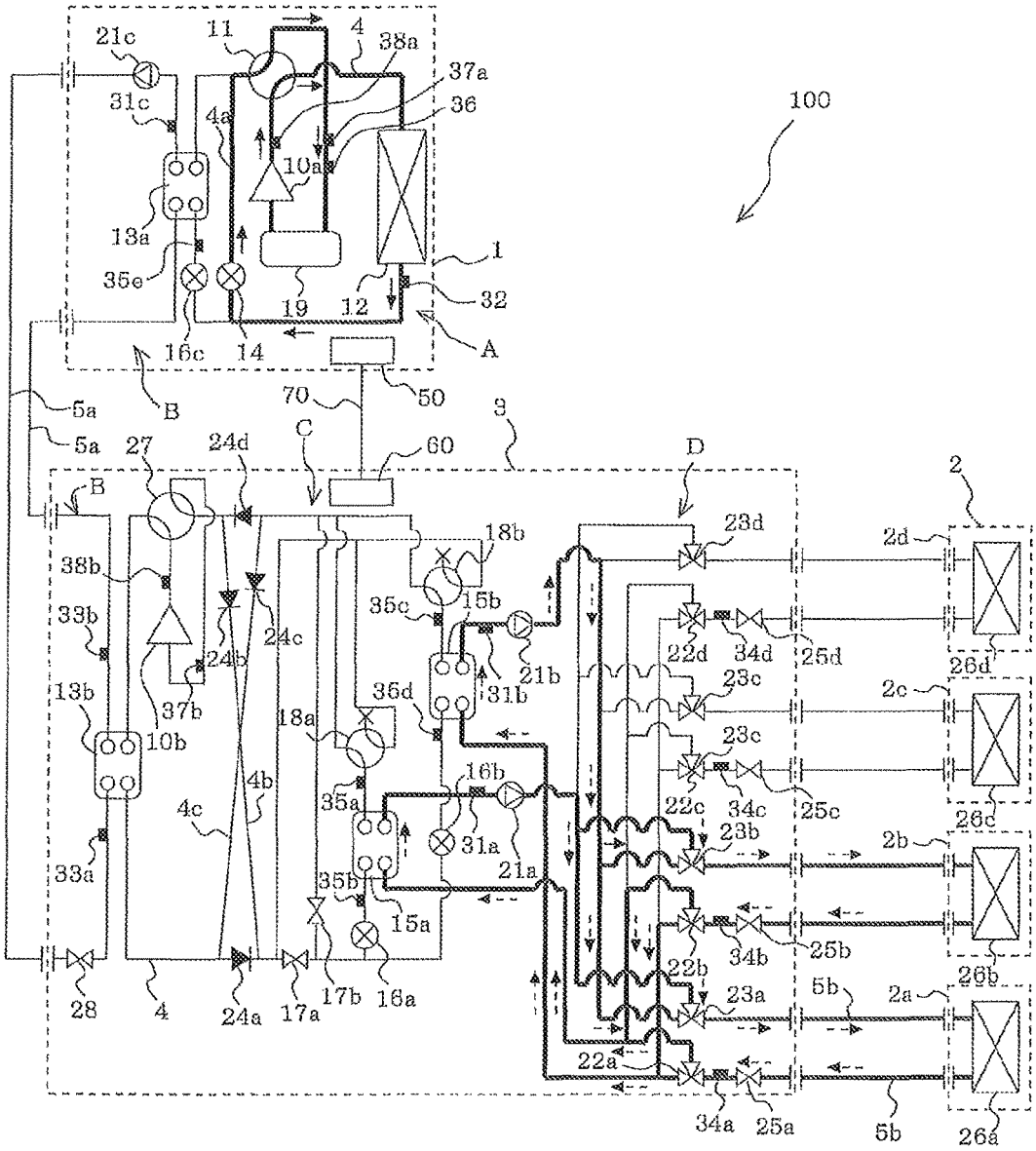
FIG. 7 is a system circuit diagram showing the flow of the refrigerant and the heat transfer medium in the air-conditioning apparatus according to Embodiment 1 of the present invention, in a defrosting operation.

FIG. 7 is a system circuit diagram showing the flow of the refrigerant and the heat transfer medium in the air-conditioning apparatus 100, in the defrosting operation mode. Referring to FIG. 7, the defrosting operation mode will be described on the assumption that the heating load has arisen in the use side heat exchanger 26*a* and the use side heat exchanger 26*b*. In FIG. 7, the pipes illustrated in bold lines represent the pipes in which the refrigerant and the heat transfer medium flow. In addition, the flow of the refrigerant is indicated by solid arrows and the flow of the heat transfer medium is indicated by broken-line arrows. The operation of the air-conditioning apparatus 100 in the defrosting operation mode will be described with reference to FIG. 7.

The defrosting operation mode is performed to remove frost, when frost is formed around the heat source-side heat exchanger 12 in the heating-only operation mode shown in FIG. 4 and in the heating-main operation mode shown in FIG. 6.

In the defrosting operation mode shown in FIG. 7, in the outdoor unit 1 the third refrigerant flow switching device 11 is switched to cause the refrigerant discharged from the compressor 10*a* to flow into the heat source-side heat exchanger 12. In the relay unit 3, the pump 21*a* and the pump 21*b* are driven, and the first heat transfer medium flow control device 25*a* and the first heat transfer medium flow control device 25*b* are fully opened while the first heat transfer medium flow control device 25*c* and the first heat transfer medium flow control device 25*d* are fully closed, so that the heat transfer medium circulates between the first intermediate heat exchanger 15*a* and the use-side heat exchanger 26*b*, as well as between the first intermediate heat exchanger 15*b* and the use-side heat exchanger 26*a*.

In the second refrigerant circuit A of the outdoor unit 1, the second refrigerant is compressed by the compressor 10*a* and also receives the heating energy stored in the casing of the compressor 10*a* thus to be heated, and is then discharged and flows into the heat source-side heat exchanger 12, around which frost has been formed, through the third refrigerant flow switching device 11. The second refrigerant which has entered the heat source-side heat exchanger 12 melts the frost formed therearound and is condensed and liquefied thus to turn into high-pressure liquid refrigerant, and flows out of the heat source-side heat exchanger 12. The high-pressure liquid refrigerant which has flowed out of the heat source-side heat exchanger 12 flows through the bypass flow control device 14 and the refrigerant pipe 4*a*. At this point, the second expansion device 16*c* is fully closed and the bypass flow control device 14 is fully opened, to restrict the second refrigerant from flowing into the third intermediate heat exchanger 13*a*.

Since frost shifts the phase with latent heat at 0 degrees Celsius, the second refrigerant which has exchanged heat with the frost in the heat source-side heat exchanger 12 is cooled to approximately 0 degrees Celsius. When the second refrigerant thus cooled flows into the third intermediate heat exchanger 13*a*, the second heat transfer medium may be frozen in the third intermediate heat exchanger 13*a* thereby causing the third intermediate heat exchanger 13*a* to burst. Even though the third intermediate heat exchanger 13*a* is exempted from bursting, the second refrigerant exchanges heat with the high-temperature second heat transfer medium, thereby lowering the temperature of the second heat transfer medium. Therefore, the second expansion device 16*c* is fully closed and the bypass flow control device 14 is fully opened, to cause the second refrigerant to flow through the bypass flow control device 14 and the refrigerant pipe 4*a*, without flowing through the third intermediate heat exchanger 13*a*.

After passing through the refrigerant pipe 4*a*, the second refrigerant is sucked into the compressor 10*a* through the third refrigerant flow switching device 11 and the accumulator 19. At this point, the compressor 10*a* is driven at the highest frequency.

In addition, the pump 21*c* is stopped to stop the flow of the second heat transfer medium in the second heat transfer medium circuit B. The compressor 10*b* is also stopped to stop the flow of the first refrigerant in the first refrigerant circuit.

In the relay unit 3, the pump 21*a*, the pump 21*b*, the first heat transfer medium flow switching device 22, the second heat transfer medium flow switching device 23, and the first heat transfer medium flow control device 25 are operated in the same way as in other operation modes, according to the air-conditioning load required by the indoor units 2. FIG. 7 illustrates the same flow as that of the heating-only operation mode shown in FIG. 4. The first heat transfer medium in the first heat transfer medium circuit D is a fluid having high thermal capacity such as water, and hence retains the heating energy or cooling energy generated by being heated or cooled in the preceding operation mode, even after the operation is switched to the defrosting operation mode. Accordingly, the heating or cooling of the space to be air-conditioned can be continued by allowing the first heat transfer medium to keep circulating during the defrosting operation mode.

[Heat Transfer Medium Pipe 5*a*]

As described thus far, the air-conditioning apparatus 100 according to Embodiment 1 is configured to perform a plurality of operation modes. In those operation modes, the second heat transfer medium such as water or an antifreeze solution flows in the heat transfer medium pipe 5*a* connecting between the outdoor unit 1 and the relay unit 3.

[Heat Transfer Medium Pipe 5*b*]

In the plurality of operation modes performed by the air-conditioning apparatus 100 according to Embodiment 1, the first heat transfer medium such as water or an antifreeze solution flows in the heat transfer medium pipe 5*b* connecting between the indoor unit 2 and the relay unit 3.

Since the first heat transfer medium and the second heat transfer medium are kept from being mixed with each other, the same heat transfer medium may be employed for both, or different heat media may be respectively employed.

[Relation Between First Refrigerant Flow Switching Device 27 and Third Refrigerant Flow Switching Device 11]

As described above, in the cooling-only operation mode the third intermediate heat exchanger 13*a* acts as an evaporator to cool the second heat transfer medium, and the second intermediate heat exchanger 13*b* acts as a condenser to heat the second heat transfer medium. In the heating-only operation mode, the third intermediate heat exchanger 13*a* acts as a condenser to heat the second heat transfer medium, and the second intermediate heat exchanger 13*b* acts as an evaporator to cool the second heat transfer medium. In the cooling-main operation mode, the third intermediate heat exchanger 13*a* acts as an evaporator to cool the second heat transfer medium, and the second intermediate heat exchanger 13*b* acts as a condenser to cool the second heat transfer medium. In the heating-main operation mode, the third intermediate heat exchanger 13*a* acts as a condenser to heat the second heat transfer medium, and the second intermediate heat exchanger 13*b* acts as an evaporator to cool the second heat transfer medium.

Thus, the third intermediate heat exchanger 13*a* and the second intermediate heat exchanger 13*b* perform reverse operations such that when one acts as a condenser to heat the second heat transfer medium the other acts as an evaporator to cool the second heat transfer medium. Accordingly, the temperature of the second heat transfer medium can be maintained at a generally constant level. Therefore, the direction of the third refrigerant flow switching device 11 can be immediately switched according to the direction of the first refrigerant flow switching device 27, through communication between the controller 60 of the relay unit 3 and the controller 50 of the outdoor unit 1 regarding the switching direction of the first refrigerant flow switching device 27 in the first refrigerant circuit C in the relay unit 3.

With the mentioned arrangement, the temperature of the second heat transfer medium can be stably controlled. Here, the transmission and reception of the switching direction of the first refrigerant flow switching device 27 may be substituted with transmission and reception of the operation mode (cooling-only operation mode, heating-only operation mode, cooling-main operation mode, and heating-main operation mode).

However, it is not mandatory to control the third refrigerant flow switching device 11 and the first refrigerant flow switching device 27 at the same time through communication between the controllers 50 and 60. For example, the first refrigerant circuit C in the relay unit 3 is arranged for one of the cooling-only operation mode, the heating-only operation mode, the cooling-main operation mode, and the heating-main operation mode depending on the air-conditioning load required by the indoor units 2, and the switching direction of the first refrigerant flow switching device 27 is accordingly determined, without the need of the communication between the controllers 50 and 60.

Regarding the heating and cooling of the second heat transfer medium, for example when both of the third intermediate heat exchanger 13*a* and the second intermediate heat exchanger 13*b* are set to heat the second heat transfer medium, the temperature detected by the intermediate heat exchanger outlet temperature sensor 31*c* of the outdoor unit 1 may continue to rise to such an extent that the temperature is unable to be adjusted to the target temperature, despite the compressor 10*a* being driven at the minimum frequency and the bypass flow control device 14 being utilized. In the case where the temperature detected by the intermediate heat exchanger outlet temperature sensor 31*c* thus exceeds a predetermined level when the third intermediate heat exchanger 13*a* is acting as a condenser, it is preferable to switch the third refrigerant flow switching device 11 to cause the third intermediate heat exchanger 13*a* to act as an evaporator.

In contrast, when both of the third intermediate heat exchanger 13*a* and the second intermediate heat exchanger 13*b* are set to cool the second heat transfer medium, the temperature detected by the intermediate heat exchanger outlet temperature sensor 31*c* of the outdoor unit 1 may continue to fall to such an extent that the temperature is unable to be adjusted to the target temperature, despite the compressor 10*a* being driven at the minimum frequency and the bypass flow control device 14 being utilized. In the case where the temperature detected by the intermediate heat exchanger outlet temperature sensor 31*c* thus falls below a predetermined level when the third intermediate heat exchanger 13*a* is acting as an evaporator, it is preferable to switch the third refrigerant flow switching device 11 to cause the third intermediate heat exchanger 13*a* to act as a condenser.

By controlling as above, the both refrigerant flow switching devices can be controlled in conjunction with each other, without the need of the communication of the operation mode between the controller 50 of the outdoor unit 1 and the controller 60 of the relay unit 3.

Figure 8:
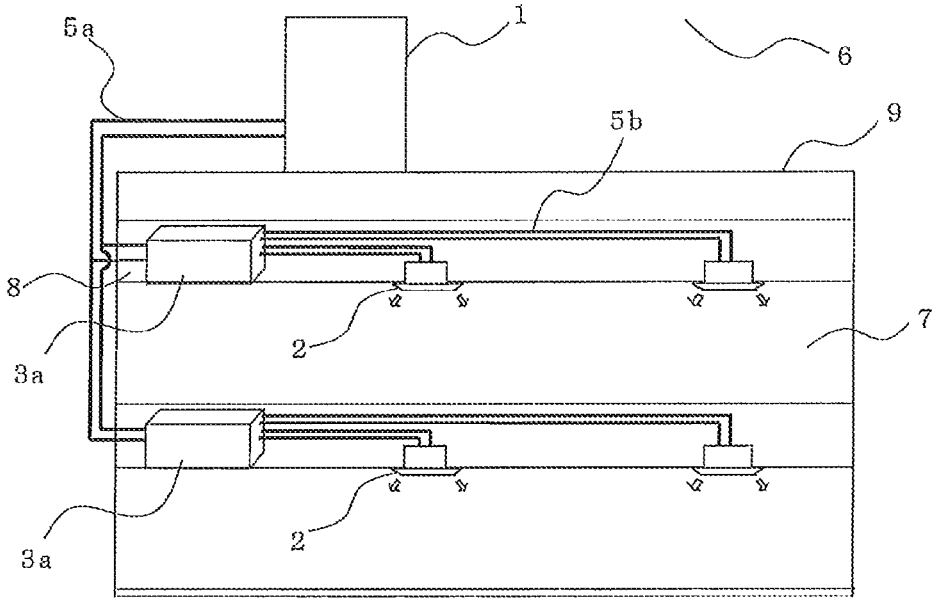
FIG. 8 is a schematic drawing showing another installation example of the air-conditioning apparatus according to Embodiment 1 of the present invention.

In the case where a plurality of relay units 3 are installed, the heat transfer medium pipe 5*a* connecting between the outdoor unit 1 and the relay unit 3 may be branched for connection to a relay unit 3*a* and a relay unit 3*b*, and the indoor units 2 may be connected to either of the relay units 3*a*, 3*b*, as shown in FIG. 8. Although a pair of relay units 3 are illustrated in FIG. 8, any desired number of relay units may be connected. FIG. 8 is a schematic drawing showing another installation example of the air-conditioning apparatus according to Embodiment 1 of the present invention.

Although not shown, the system may include a plurality of outdoor units 1, and the second heat transfer medium flowing out of each of the outdoor units 1 may be driven to circulate in the heat transfer medium pipe 5*a*, to flow into one or more relay units 3.

Although Embodiment 1 refers to the case where all the components of the relay unit 3 are accommodated in a single casing, the relay unit 3 may be separately disposed in a plurality of casings. Referring to FIG. 2 for example, the portion on the right of the pump 21*a* and the pump 21*b* may be accommodated in a separate casing, and the two casings of the relay unit 3 may be connected via the four pipes in which the first heat transfer medium flows. In this case, the two casings of the relay unit 3 may be located away from each other.

Although Embodiment 1 refers to the case where the first heat transfer medium flow switching device 22, the second heat transfer medium flow switching device 23, and the first heat transfer medium flow control device 25 are independent components, these devices may be configured in any desired form provided that the flow path of the heat transfer medium can be switched and the flow rate of the heat transfer medium can be controlled. For example, all of the first heat transfer medium flow switching device 22, the second heat transfer medium flow switching device 23, and the first heat transfer medium flow control device 25 may be unified into a single device, or any two of the first heat transfer medium flow switching device 22, the second heat transfer medium flow switching device 23, and the first heat transfer medium flow control device 25 may be unified.

Further, although Embodiment 1 refers to the case where the opening degree of the second heat transfer medium flow control device 28 is controlled to adjust the flow rate of the heat transfer medium flowing in the second intermediate heat exchanger 13*b*, and the rotation speed of the pump 21*c* is controlled to set the second heat transfer medium flow control device 28 close to a fully opened state, different arrangements may be adopted. For example, the second heat transfer medium flow control device 28 may be excluded, and the rotation speed of the pump 21*c* may be directly controlled to adjust the flow rate of the heat transfer medium flowing in the second intermediate heat exchanger 13*b*. In this case, the signal transmitted between the controller 50 and the controller 60 may be one or more of a signal indicating the temperature detected by the intermediate heat exchanger temperature sensor 33*a*, a signal indicating the temperature detected by the intermediate heat exchanger temperature sensor 33*b*, and a signal indicating the difference between the temperature detected by the intermediate heat exchanger temperature sensor 33*b* and the temperature detected by the intermediate heat exchanger temperature sensor 33*a*, instead of the opening degree of the second heat transfer medium flow control device 28.

In the air-conditioning apparatus 100, when only the heating load or the cooling load is present in the use-side heat exchanger 26, the corresponding first heat transfer medium flow switching device 22 and second heat transfer medium flow switching device 23 are set to an intermediate opening degree to allow the heat transfer medium to flow to both of the first intermediate heat exchanger 15*a* and the first intermediate heat exchanger 15*b*. Such an arrangement allows both of the first intermediate heat exchanger 15*a* and the first intermediate heat exchanger 15*b* to be utilized for the heating operation or the cooling operation, in which case a larger heat transmission area can be secured and therefore the heating operation or the cooling operation can be efficiently performed.

In the case where the heating load and the cooling load are present in mixture in the use-side heat exchanger 26, the first heat transfer medium flow switching device 22 and the second heat transfer medium flow switching device 23 corresponding to the use-side heat exchanger 26 engaged in the heating operation is switched to the flow path leading to the first intermediate heat exchanger 15*b* for heating, and the first heat transfer medium flow switching device 22 and the second heat transfer medium flow switching device 23 corresponding to the use-side heat exchanger 26 engaged in the cooling operation is switched to the flow path leading to the first intermediate heat exchanger 15*a* for cooling. With such an arrangement, the heating operation and the cooling operation can be freely selected with respect to each of the indoor units 2.

The first heat transfer medium flow switching device 22 and the second heat transfer medium flow switching device 23 according to Embodiment 1 may be configured in any desired form provided that the flow path can be switched, for example the three-way valve capable of switching the flow path in three ways, or a combination of two on/off valves each configured to open and close a two-way flow path. Alternatively, a device capable of varying the flow rate in a three-way flow path, such as a mixing valve driven by a stepping motor, or a combination of two devices each capable of varying the flow rate in a two-way flow path, such as electronic expansion valves may be employed, in place of the first heat transfer medium flow switching device 22 and the second heat transfer medium flow switching device 23. Such a configuration prevents a water hammer originating from sudden shutting of the flow path. Further, although the first heat transfer medium flow control device 25 is constituted of a two-way valve in Embodiment 1, the first heat transfer medium flow control device 25 may be a three-way control valve used in combination with a bypass pipe circumventing the use-side heat exchanger 26.

It is preferable that the first heat transfer medium flow control device 25 and the second heat transfer medium flow control device 28 are driven by a stepping motor to control the flow rate of the heat transfer medium in the flow path, in which case a two-way valve or a three-way valve having one way closed may be employed. Alternatively, the first heat transfer medium flow control device 25 may be constituted of an on/off valve that opens and closes a two-way flow path, for controlling the flow rate as an average value by repeating the on/off operation.

Although the second refrigerant flow switching device 18 is illustrated as a four-way valve, a plurality of two-way flow switching valves or three-way flow switching valves may be employed to allow the refrigerant to flow in the same manner.

It is a matter of course that the same effects can be attained even in the case where just one each of the use-side heat exchanger 26 and the first heat transfer medium flow control valve 25 are provided. In addition, a plurality of first intermediate heat exchangers 15 and expansion devices (first expansion device 16*a*, 16*b*, second throttle 16*c*), each configured to work in the same way, may naturally be employed. Further, although the first heat transfer medium flow control valve 25 is incorporated in the relay unit 3 in Embodiment 1, the first heat transfer medium flow control valve 25 may be incorporated in the indoor unit 2, or independently disposed from the relay unit 3 and the indoor unit 2.

The air-conditioning apparatus 100 provides prominent effects when a refrigerant having a low gas density on the low-pressure side, such as HFO-1234yf or HFO-1234ze(E), or highly flammable refrigerant such as propane (R290) is employed as the second refrigerant used in the outdoor unit 1, however different refrigerants may be employed. For example, a single mixed refrigerant such as R-22, HFO-134a, or R-32, a pseudo-azeotropic refrigerant mixture such as R-410A or R-404A, a non-azeotropic refrigerant mixture such as R-407C, a natural refrigerant such as $CO_2$, or a mixed refrigerant containing the cited refrigerants may be employed. When the first intermediate heat exchanger 15*a* is set to act as a condenser, an ordinary refrigerant that shifts between two phases is condensed and liquefied, and a refrigerant that turns to a supercritical state such as $CO_2$ is cooled in the supercritical state, and in either of the mentioned cases the same operation is performed in the remaining aspects, and the same effects can be attained.

Further, since the relay unit 3 of the air-conditioning apparatus 100 is normally installed inside the building, the first refrigerant employed in the first refrigerant circuit C of the relay unit 3 is located in the space not to be air-conditioned 8 inside the building. Accordingly, it is preferable to employ a non-flammable refrigerant such as R-22, HFO-134a, R-410A, R-404A, or R-407C as the first refrigerant, from the viewpoint of safety. Alternatively, the first refrigerant may be a low-flammable refrigerant (classified as A2L according to American Society of Heating, Refrigerating and Air-Conditioning Engineers (ASHRAE), which is a refrigerant with a burning rate not higher than 10 cm/s among those classified as A2) such as HFO-1234yf, HFO-1234ze(E), or R32, and further a refrigerant used in a high pressure supercritical state such as $CO_2$, a highly flammable refrigerant such as propane (R290), or other types of refrigerants may be employed.

When the first intermediate heat exchanger 15*a* or the first intermediate heat exchanger 15*b* is set to work as a condenser, a refrigerant that shifts between two phases is condensed and liquefied, and a refrigerant used in a supercritical state such as $CO_2$ is cooled in the supercritical state, and in either of the mentioned cases the same effects are attained.

In the case of employing a flammable refrigerant in the air-conditioning apparatus, the upper limit of the amount of the refrigerant loaded in the refrigerant circuit is stipulated by law according to the volume of the space (room) in which the air-conditioning apparatus is installed. When the refrigerant concentration in the air exceeds a lower flammable limit (LFL) and an ignition source is present, the refrigerant catches fire. According to ASHRAE, when the amount of a flammable refrigerant is not larger than four times of LFL there is no limitation of the volume of the space where the apparatus is to be installed, in other words the apparatus may be installed in a space of any size.

Further, when a refrigerant classified as low-flammable refrigerant (A2L refrigerant) among the flammable refrigerants, such as R32, HFO-1234yf, or HFO-1234ze (E) is employed, there is no limitation of the volume of the space where the apparatus is to be installed and the apparatus may be installed in a space of any size, provided that the amount of refrigerant loaded in the apparatus is not larger than 150% of four times of LFL. LFL of R-32 is 0.306 (kg/m$^3$) and LFL of HFO-1234yf is 0.289 (kg/m$^3$), and upon multiplying the LFL by 4×1.5 the amount of 1.836 (kg) is obtained for R-32 and 1.734 (kg) for HFO-1234yf. Accordingly, when the amount of refrigerant is not larger than the amount calculated above, no limitation is imposed on the installation location of the apparatus.

Accordingly, in the air-conditioning apparatus 100 it is only the relay unit 3 that contains the refrigerant and is located inside the building. Therefore, it is preferable to load an amount not exceeding 1.8 (kg) of R-32 or 1.7 (kg) of HFO-1234yf in the first refrigerant circuit C of the relay unit 3. In the case of employing a mixture of R-32 and HFO-1234yf, an amount of refrigerant not exceeding the limit calculated according to the mixture ratio may be loaded. With such amounts of the refrigerant, the relay unit 3 is free from limitation of the installation location and may be installed at any desired location.

In addition, even in the case of employing propane (R290), which is a highly flammable refrigerant (A3 according to ISO and ASHRAE), as the first refrigerant, LFL of propane is 0.038 (kg/m$^3$) and therefore the apparatus can be safely utilized free from limitation of the installation location, when the amount of refrigerant loaded in the first refrigerant circuit C is not larger than 0.152 (kg) which is four times of 0.038 (kg/m$^3$).

To reduce the amount of refrigerant to be loaded in the refrigerant circuit, the capacity of the apparatus has to be reduced. Accordingly, it is preferable that the compressor 10*b* provided in the relay unit 3 has a capacity (cooling capacity) that matches the refrigerant amount not exceeding, for example, 1.8 (kg) of R-32, 1.7 (kg) of HFO-1234yf, or 0.15 (kg) of propane. In the case where the air-conditioning load required by the building is larger than the capacity (calorific capacity of cooling and heating) of the relay unit 3 determined as above, a plurality of relay units 3 may be connected to one outdoor unit 1 as shown in FIG. 8.

Since the outdoor unit 1 is installed in an outdoor space, the amount of the refrigerant to be loaded in the second refrigerant circuit A in the outdoor unit 1 has to be below an upper limit differently stipulated from the foregoing regulation. However, detailed description thereof will be skipped.

In general, the flammable refrigerants have a low global warming potential (GWP). For example, GWP of propane (R-290) which is a highly flammable refrigerant (A3 according to ISO and ASHRAE) is 6, and GWP of HFO-1234yf which is a low-flammable refrigerant (A2L according to ASHRAE) is 4, and GWP of HFO-1234ze (E) is 6.

In the air-conditioning apparatus 100, the outdoor unit 1 is installed in the outdoor space and the relay unit 3 is installed in the space not to be air-conditioned inside the building. While it is dangerous to use a highly flammable refrigerant in an indoor space because of high risk of firing in case of leakage, the probability that the concentration of the refrigerant that has leaked reach LFL is lower in an outdoor space than in an indoor space. Accordingly, it is preferable to employ highly flammable refrigerant having a low GWP (for example, not higher than 50), such as propane as the second refrigerant to be loaded in the second refrigerant circuit A in the outdoor unit 1, and a low-flammable refrigerant having a low GWP (for example, not higher than 50), such as HFO-1234yf or HFO-1234ze (E) as the first refrigerant to be loaded in the first refrigerant circuit C of the relay unit 3, from the viewpoint of higher safety of the air-conditioning apparatus 100 and smaller impact on the global warming.

The first heat transfer medium and the second heat transfer medium may be the same material or materials different from each other. For example, brine (antifreeze solution), water, a mixture of water and brine, and a mixture of water and an anti-corrosive additive may be employed as the heat transfer medium. In the air-conditioning apparatus 100, therefore, even though the first heat transfer medium leaks into the indoor space 7 through the indoor unit 2, a high level of safety can be secured since the heat transfer medium having high safety is employed. In addition, since the heat transfer medium, not the refrigerant, circulates between the outdoor unit 1 and the relay unit 3, the amount of refrigerant used in the system as a whole can be reduced, and therefore a high level of safety can be secured even when a flammable refrigerant is employed as the first refrigerant and/or the second refrigerant.

Although the second heat transfer medium is exemplified by water or antifreeze solution which does not shift between two phases or turn into a super critical state during the operation, a refrigerant may also be employed as the second heat transfer medium, and the same type of refrigerant as the first refrigerant and the second refrigerant may be employed. When a refrigerant is used as the second heat transfer medium, a refrigerant pump is employed as the pump 21*c*. The pump 21*c* serves to convey the heating energy or cooling energy between the outdoor unit 1 and the relay unit 3, which is unchanged in the case of employing a refrigerant pump as the pump 21*c*. To be more detailed, although the structure of a compressor may incur malfunction when a difference in pressure between the inlet and outlet of the compressor is lower than a predetermined value, the pump 21*c* serves to convey the refrigerant acting as heat convey medium and is hence configured to work in a condition where the difference in pressure is relatively small between the inlet and outlet of the pump 21*c*.

The refrigerant may be either in a liquid phase or gas phase, and the second heat transfer medium may shift between phases or turn into a supercritical state, or remain in the liquid phase or gas phase without shifting the phase, in the third intermediate heat exchanger 13*a* and the second intermediate heat exchanger 13*b*. In the case of employing a refrigerant as the second heat transfer medium, it is preferable to employ a natural refrigerant such as $CO_2$, or a refrigerant having a lower GWP such as HFO-1234yf or HFO-1234ze(E), because of smaller impact on the environment in the event of leakage. Here, although a refrigerant may also be utilized as the first heat transfer medium, since the first heat transfer medium circuit D is located inside the building, for example, behind the ceiling, it is preferable to employ water or antifreeze solution as the first heat transfer medium, from the viewpoint of higher safety in the event of leakage.

In Embodiment 1, the air-conditioning apparatus 100 includes the outdoor unit 1 and the relay unit 3, which are connected via the heat transfer medium pipe 5*a*. However, in the case where the building in which the air-conditioning apparatus 100 is to be installed is equipped with a water supply source, but a suitable location for installing the outdoor unit 1 is unavailable or it is difficult to route the heat transfer medium pipe between the outdoor unit 1 and the relay unit 3, the water supply source may be directly connected to the relay unit 3 instead of installing the outdoor unit 1, to utilize the water as the second heat transfer medium. Alternatively, the second heat transfer medium may be circulated between the relay unit 3 and a cooling tower, to thereby remove heat from or transfer heat to the second heat transfer medium in the cooling tower.

In this case, however, the temperature of the second heat transfer medium flowing in the second intermediate heat exchanger 13*b* is determined by the water source and is hence the temperature of the second heat transfer medium is unable to control. Accordingly, when the temperature of the water source fluctuates the high pressure and the low pressure of the first refrigerant circuit C fluctuate. Therefore, the performance of the air-conditioning apparatus 100 becomes slightly unstable compared with the case of installing the outdoor unit 1, however even in such a case it is possible to cool or heat the air in the space to be air-conditioned, by utilizing the first refrigerant circuit C and the first heat transfer medium circuit D.

In general, the heat source-side heat exchanger and the use-side heat exchangers 26*a* to 26*d* are each provided with a fan for higher efficiency in heat transmission between the refrigerant or the heat transfer medium and air. Alternatively, for example a radiation type panel heater may be employed as the use-side heat exchangers 26*a* to 26*d*, and a water-cooled device that transmits heat with water or an antifreeze solution may be employed as the heat source-side heat exchanger 12. Thus, any device may be employed provided that the device is capable of transferring heat or removing heat.

Although the compressor 10*b* in the first refrigerant circuit C of the relay unit 3 is without an accumulator on the suction side, an accumulator may be provided.

Four of the use-side heat exchangers 26*a* to 26*d* are provided in Embodiment 1, however any desired number of use-side heat exchangers may be connected.

Although two heat exchangers, namely the first intermediate heat exchanger 15*a* and the first intermediate heat exchanger 15*b* are provided, naturally any desired number of such heat exchangers may be provided, as long as the heat transfer medium can be cooled or heated.

The pump 21*a*, the pump 21*b*, and the pump 21*c* may each be constituted of a plurality of pumps of a smaller capacity connected in parallel.

Further, the heat transfer medium pipe 5*a* for conducting the second heat transfer medium is normally located in the outdoor space 6, and the heat transfer medium pipe 5*b* for conducting the first heat transfer medium is normally located in a space inside the building 9. In cold districts, the temperature in the outdoor space 6 drops in winter and the second heat transfer medium may freeze, and hence it is preferable to employ an antifreeze solution such as brine as the second heat transfer medium. In contrast, the temperature of the space inside the building 9 does not significantly fall and therefore it is preferable to employ as the first heat transfer medium a liquid, for example water, which has a higher freezing point and lower viscosity than the second heat transfer medium. Such an arrangement prevents the second heat transfer medium flowing in the heat transfer medium pipe 5*a* from freezing, and allows the heat transfer medium pipe 5*b* for conducting the first heat transfer medium to be prolonged.

As described thus far, the air-conditioning apparatus 100 enables a cooling and a heating operation to be performed at the same time with the two heat transfer medium pipes 5*a* and 5*b* without introducing the refrigerant pipe into the building from outside. The outdoor unit 1 which utilizes the refrigerant can be installed outdoors or in a machine room, and the relay unit 3 can be installed in the space not to be air-conditioned inside the building, and therefore the refrigerant is kept from leaking into the room. In addition, the amount of the refrigerant in the relay unit 3 is relatively small and therefore, even though a flammable refrigerant leaks out of the relay unit 3 during the operation, the concentration of the refrigerant can only be far below the ignition point. Consequently, higher safety can be secured.

Embodiment 2

Figure 9:
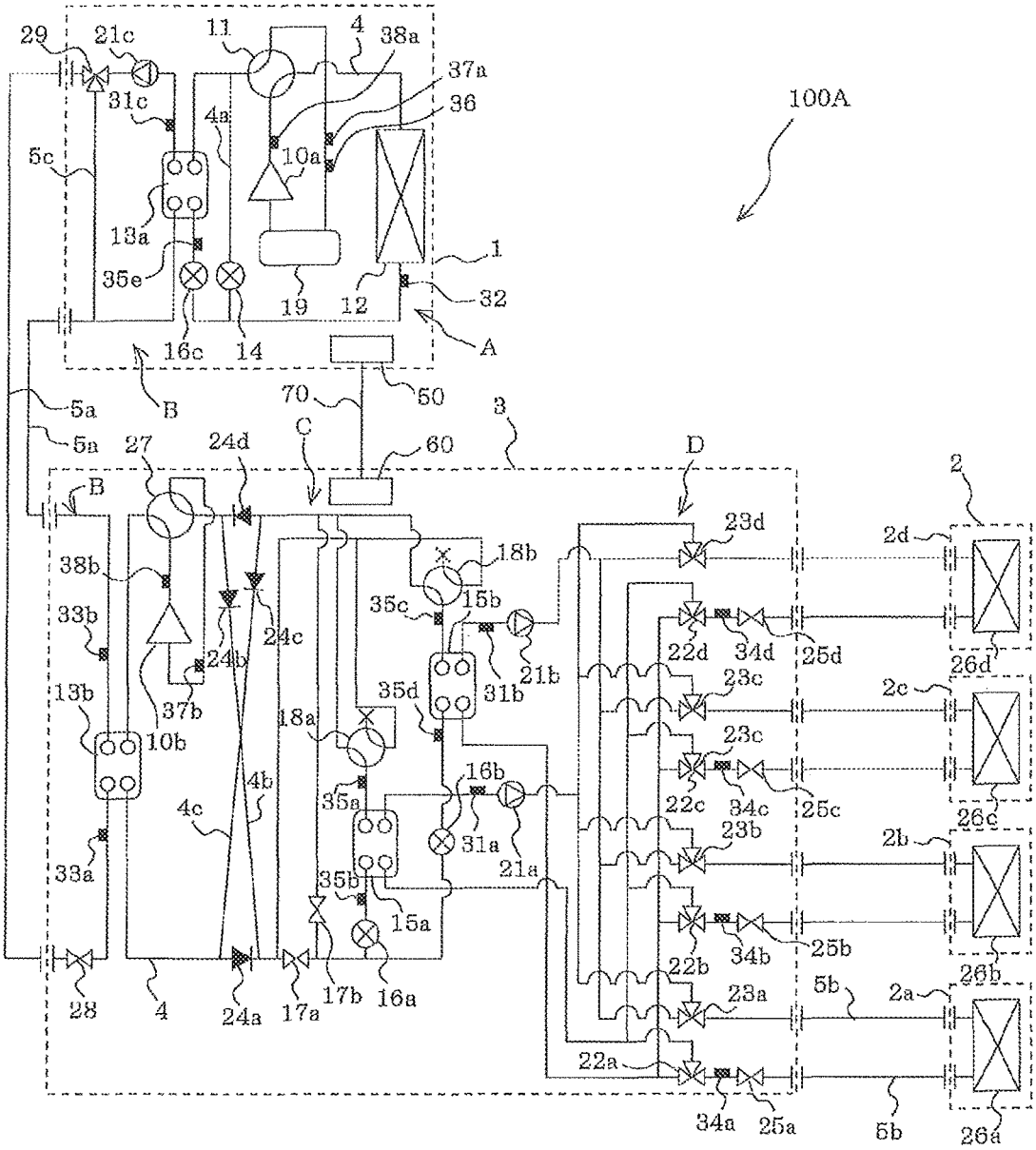
FIG. 9 is a schematic circuit diagram showing a configuration of an air-conditioning apparatus according to Embodiment 2 of the present invention.

FIG. 9 is a schematic circuit diagram showing a configuration of an air-conditioning apparatus according to Embodiment 2 of the present invention (hereinafter, air-conditioning apparatus 100A). Referring to FIG. 9, the air-conditioning apparatus 100A according to Embodiment 2 of the present invention will be described. The description of Embodiment 2 will be given focusing on the difference from the Embodiment 1, and the same constituents as those of Embodiment 1 will be given the same numeral, and the description thereof will not be repeated.

The air-conditioning apparatus 100A is different from the air-conditioning apparatus 100 in that a third heat transfer medium flow switching device 29 is provided on the outlet side of the pump 21*c*. In addition, a bypass pipe 5*c* circumventing the third intermediate heat exchanger 13*a* is routed to connect between the third heat transfer medium flow switching device 29 and the second heat transfer medium flow path located opposite to the third heat transfer medium flow switching device 29 with respect to the third intermediate heat exchanger 13*a*. The third heat transfer medium flow switching device 29 and the bypass pipe 5*c* are accommodated in the outdoor unit 1.

In Embodiment 2, the third heat transfer medium flow switching device 29 is switched to block the flow of the second heat transfer medium to the bypass pipe 5*c* and to allow the second heat transfer medium to flow toward the second intermediate heat exchanger 13*b* (relay unit 3), in the cooling-only operation mode, the heating-only operation mode, the cooling-main operation mode, and the heating-main operation mode. The working of the rest of portions in the cooling-only operation mode, the heating-only operation mode, the cooling-main operation mode, and the heating-main operation mode is the same as in Embodiment 1, and therefore the description will not be repeated.

Figure 10:
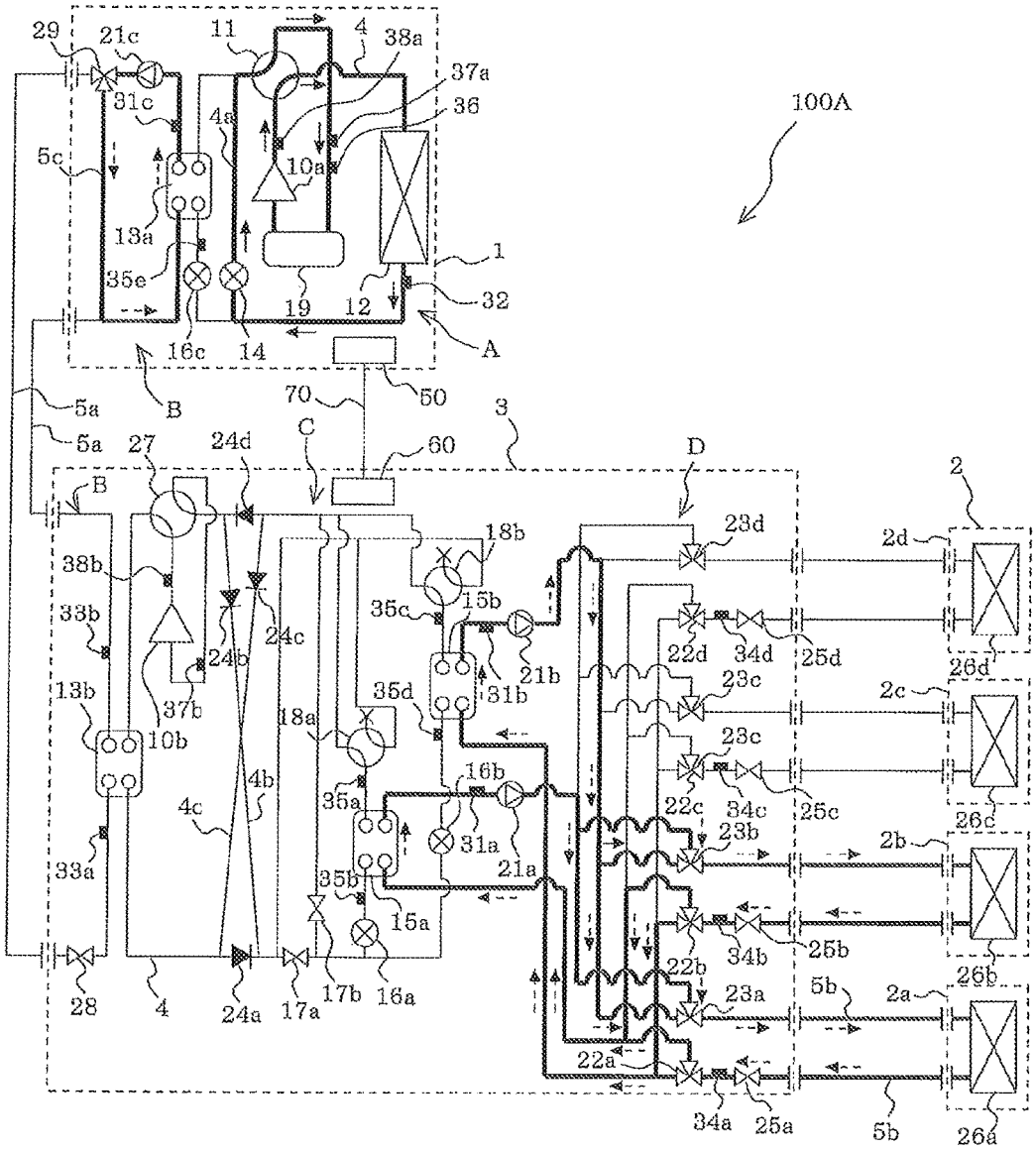
FIG. 10 is a system circuit diagram showing the flow of the refrigerant and the heat transfer medium in the air-conditioning apparatus according to Embodiment 2 of the present invention, in the defrosting operation.

FIG. 10 is a system circuit diagram showing the flow of the refrigerant and the heat transfer medium in the air-conditioning apparatus 100A, in the defrosting operation mode. Referring to FIG. 10, the defrosting operation mode will be described on the assumption that the heating load has arisen in the use side heat exchanger 26*a* and the use side heat exchanger 26*b*. In FIG. 10, the pipes illustrated in bold lines represent the pipes in which the refrigerant and the heat transfer medium flow. In addition, in FIG. 10, the flow of the refrigerant is indicated by solid arrows and the flow of the heat transfer medium is indicated by broken-line arrows. The operation of the air-conditioning apparatus in the defrosting operation mode will be described with reference to FIG. 10.

The defrosting operation mode is performed, as described with reference to Embodiment 1, to remove frost when frost is formed around the heat source-side heat exchanger 12 in the heating-only operation and the heating-main operation mode.

In the heating-main operation mode shown in FIG. 10, the second refrigerant flows through the second refrigerant circuit A in the same way as in Embodiment 1. Likewise, the first refrigerant flows (or stops) in the first refrigerant circuit C and the first heat transfer medium flows through the first heat transfer medium circuit D in the same way as in Embodiment 1, and the only difference is in the flow of the second heat transfer medium in the second heat transfer medium circuit B.

In the defrosting operation mode shown in FIG. 10, the third heat transfer medium flow switching device 29 is switched to block the flow of the second heat transfer medium to the second intermediate heat exchanger 13*b* (relay unit 3) and to allow the second heat transfer medium to flow to the bypass pipe 5*c*. Accordingly, when the pump 21*c* is activated in the second heat transfer medium circuit B in FIG. 10, the second heat transfer medium is discharged from the pump 21*c* and passes through the third heat transfer medium flow switching device 29 and the bypass pipe 5*c*. The second heat transfer medium then flows into the third intermediate heat exchanger 13*a* and is sucked into the pump 21*c*.

In the defrosting operation mode, the second refrigerant in the second refrigerant circuit A is caused to circumvent the third intermediate heat exchanger 13*a*, in other words restricted from flowing through the third intermediate heat exchanger 13*a*. However, a flow path closing valve is not provided on the other end of the third intermediate heat exchanger 13*a* opposite to the end where the second expansion device 16*c* is provided, and hence the second refrigerant of a low temperature may flow into the third intermediate heat exchanger 13*a* through the other end thereof. In addition, for example when sludge or dust accumulates inside the second expansion device 16*c* and disturbs the flow path from being fully closed, the flow of the second refrigerant is formed through the third intermediate heat exchanger 13*a*.

In such a case, the second heat transfer medium may freeze inside the third intermediate heat exchanger 13*a*, thereby causing the third intermediate heat exchanger 13*a* to burst. The air-conditioning apparatus 100A includes, therefore, the third heat transfer medium flow switching device 29 and the bypass pipe 5*c*, to cause the second heat transfer medium to circulate through the third intermediate heat exchanger 13*a* in the defrosting operation mode. Such an arrangement prevents the second heat transfer medium from freezing inside the third intermediate heat exchanger 13*a* thereby preventing the third intermediate heat exchanger 13*a* from bursting, thus upgrading the safety level of the system.

Here, the bursting of the third intermediate heat exchanger 13*a* can be prevented by causing the second heat transfer medium to circulate between the third intermediate heat exchanger 13*a* (outdoor unit 1) and the second intermediate heat exchanger 13*b* (relay unit 3), instead of providing the third heat transfer medium flow switching device 29 and the bypass pipe 5*c*. However, the third intermediate heat exchanger 13*a* is accommodated in the outdoor unit 1 and the second intermediate heat exchanger 13*b* is accommodated in the relay unit 3 located away from the outdoor unit 1. Accordingly, causing the second heat transfer medium to circulate between the outdoor unit 1 and the relay unit 3 requires a large amount of power for the pump 21*c*, which leads to waste of energy. However, the configuration according to Embodiment 2 allows the second heat transfer medium to circulate only inside the outdoor unit 1 in the defrosting operation mode, thereby reducing the power consumption by the pump 21*c* while preventing the third intermediate heat exchanger 13*a* from bursting, and thus contributing to saving energy.

As described above, the air-conditioning apparatus 100A provides the same advantageous effects as those provided by the air-conditioning apparatus 100, and also reduces the power consumption by the pump 21*c* while preventing the third intermediate heat exchanger 13*a* from bursting, and further contributes to saving energy.

Embodiment 3

Figure 11:
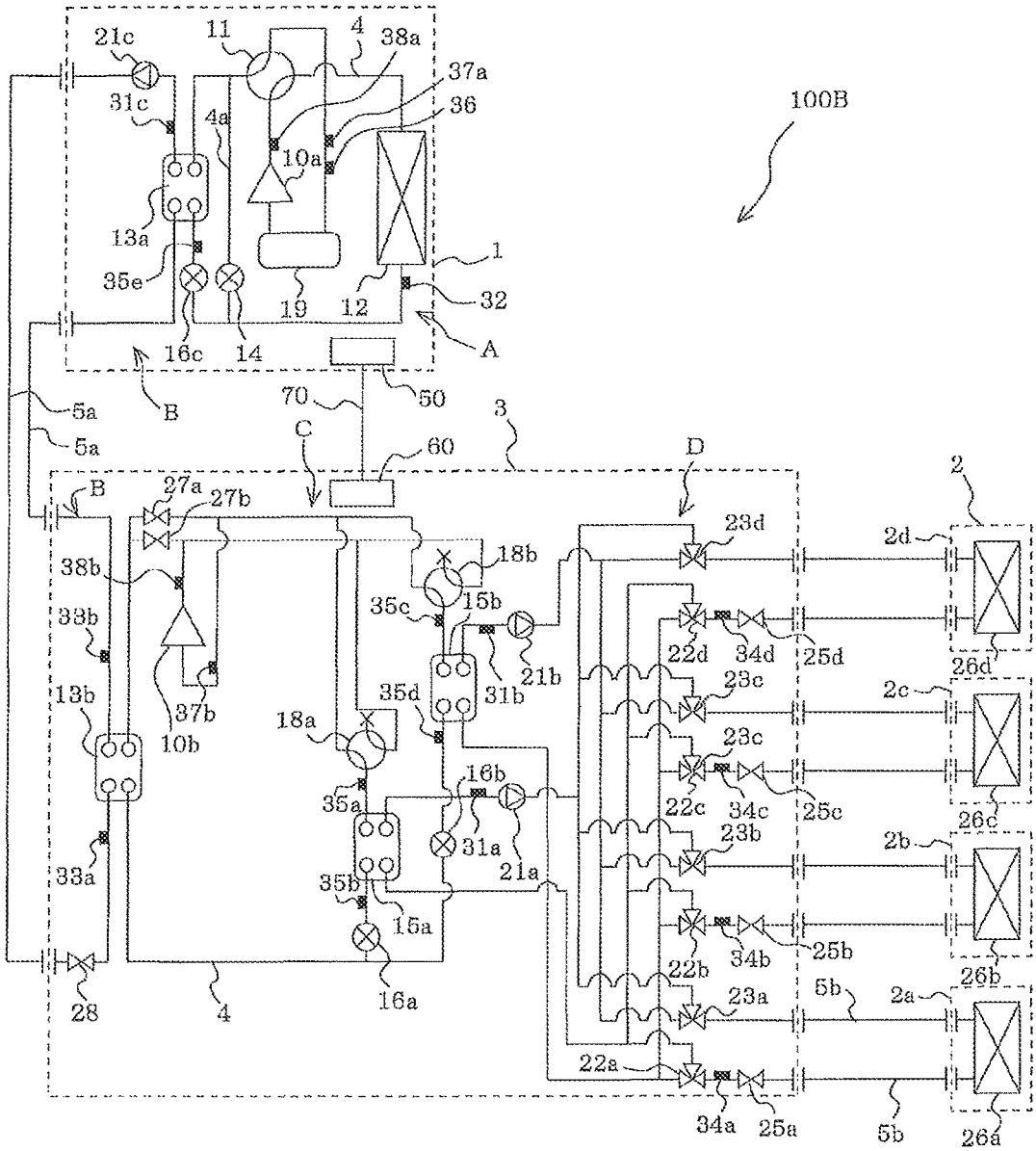
FIG. 11 is a schematic circuit diagram showing a configuration of an air-conditioning apparatus according to Embodiment 3 of the present invention.

FIG. 11 is a schematic circuit diagram showing a configuration of an air-conditioning apparatus according to Embodiment 3 of the present invention (hereinafter, air-conditioning apparatus 100B). Referring to FIG. 11, the air-conditioning apparatus 100B according to Embodiment 3 of the present invention will be described. The description of Embodiment 3 will be given focusing on the difference from the Embodiments 1 and 2, and the same constituents as those of Embodiments 1 and 2 will be given the same numeral, and the description thereof will not be repeated.

The air-conditioning apparatus 100B is different from the air-conditioning apparatus 100 in the circuit configuration of the first refrigerant circuit C in the relay unit 3. Specifically, the first refrigerant flow switching device 27 is substituted with a first refrigerant flow switching device 27*a* and a first refrigerant flow switching device 27*b*. In addition, the pipe on the discharge side of the compressor 10*b* is branched into a pipe leading to the second refrigerant flow switching device 18 and a pipe leading to the second intermediate heat exchanger 13*b*. Further, a portion of the first refrigerant circuit C on the left in FIG. 11 and a portion thereof on the right are connected to each other via three refrigerant pipes 4.

Although the first refrigerant flow switching device 27*a* and the first refrigerant flow switching device 27*b* are assumed to be an on/off valve for opening and closing the flow path such as an electronic valve or a two-way valve, any device may be employed provided that the flow path can be opened and closed. Alternatively, the first refrigerant flow switching device 27*a* and the first refrigerant flow switching device 27*b* may be formed as a unified body, to switch the flow path at the same time.

The operation modes that the air-conditioning apparatus 100A is configured to perform include the cooling-only operation mode, the heating-only operation mode, the cooling-main operation mode, and the heating-main operation mode as with the air-conditioning apparatus 100. Hereunder, the flow of the first refrigerant in the first refrigerant circuit C will be described, with respect to each of the operation modes. The second refrigerant circuit A, the second heat transfer medium circuit B, and the first heat transfer medium circuit D are configured to work in the same way as in Embodiment 1, and hence the description thereof will not be repeated.

[Cooling-Only Operation Mode]

Figure 12:
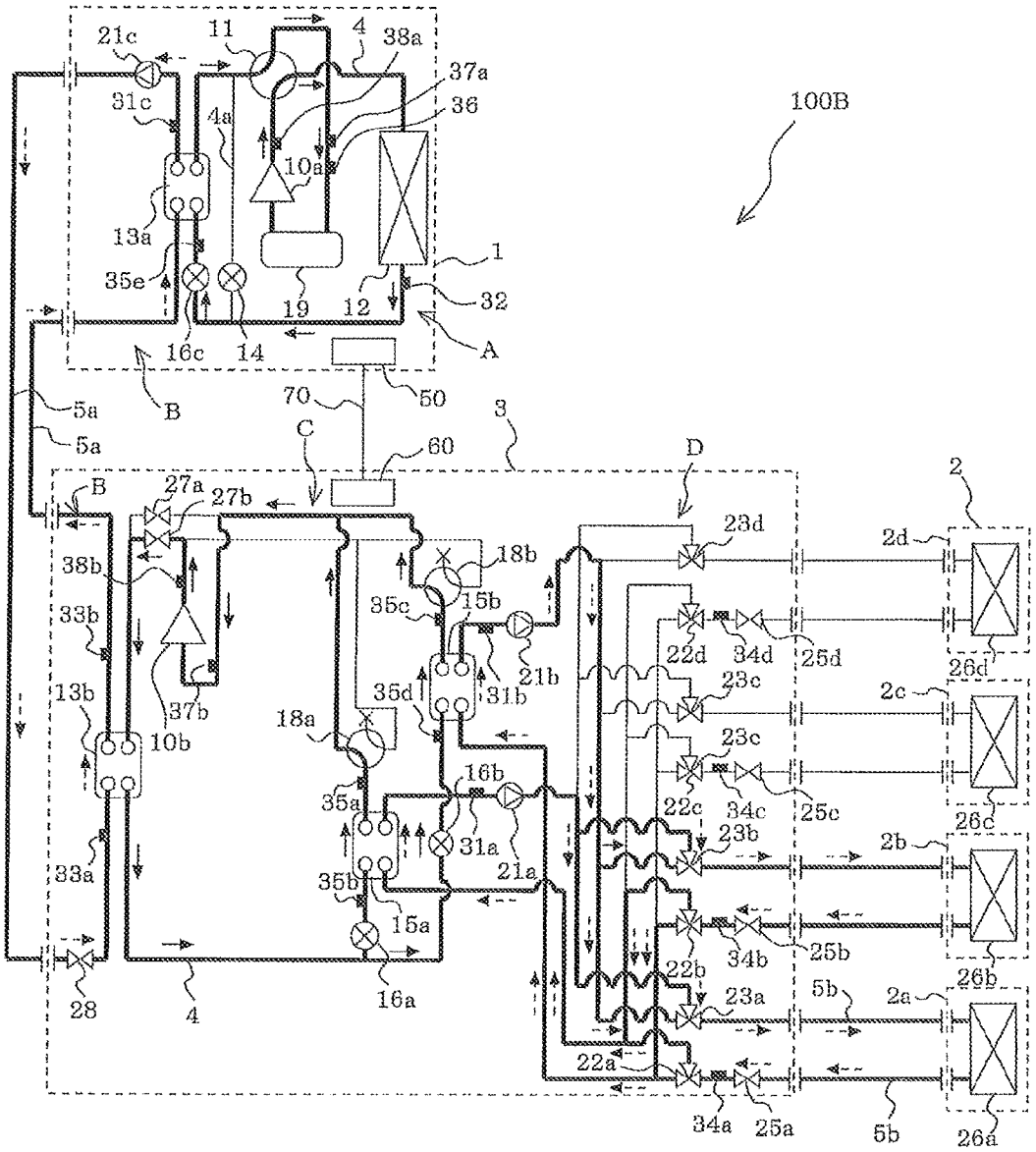
FIG. 12 is a system circuit diagram showing the flow of the refrigerant and the heat transfer medium in the air-conditioning apparatus according to Embodiment 3 of the present invention, in the cooling-only operation.

FIG. 12 is a system circuit diagram showing the flow of the refrigerant and the heat transfer medium in the air-conditioning apparatus 100, in the cooling-only operation. Referring to FIG. 12, the cooling-only operation mode will be described on the assumption that the cooling load has arisen only in the use side heat exchanger 26*a* and the use side heat exchanger 26*b*. In FIG. 12, the pipes illustrated in bold lines represent the pipes in which the refrigerant and the heat transfer medium flow. In addition, in FIG. 12, the flow of the refrigerant is indicated by solid arrows and the flow of the heat transfer medium is indicated by broken-line arrows.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* flows into the second intermediate heat exchanger 13*b* acting as a condenser, through the first refrigerant flow switching device 27*b*, and is condensed and liquefied while transferring heat to the second heat transfer medium in the second intermediate heat exchanger 13*b*, thereby turning into high-pressure liquid refrigerant. In this process the flow path is formed so that the second heat transfer medium and the first refrigerant flow in opposite directions to each other in the second intermediate heat exchanger 13*b*.

The high-pressure liquid refrigerant which has flowed out of the second intermediate heat exchanger 13*b* is branched and expanded in the first expansion device 16*a* and the first expansion device 16*b* thus to turn into low-temperature/low-pressure two-phase refrigerant. The two-phase refrigerant flows into each of the first intermediate heat exchanger 15*a* and the first intermediate heat exchanger 15*b* acting as an evaporator, and cools the first heat transfer medium circulating in the first heat transfer medium circuit D by removing heat from the first heat transfer medium, thereby turning into low-temperature/low-pressure gas refrigerant. In this process the flow path is formed so that the first refrigerant and the first heat transfer medium flow parallel to each other in the first intermediate heat exchanger 15*a* and the first intermediate heat exchanger 15*b*.

The gas refrigerant which has flowed out of the first intermediate heat exchanger 15*a* and the first intermediate heat exchanger 15*b* is joined with each other after passing through the second refrigerant flow switching device 18*a* and the second refrigerant flow switching device 18*b*, and is again sucked into the compressor 10*b*. At this point, the first refrigerant flow switching device 27*a* is closed and the first refrigerant flow switching device 27*b* is opened.

[Heating-Only Operation Mode]

Figure 13:
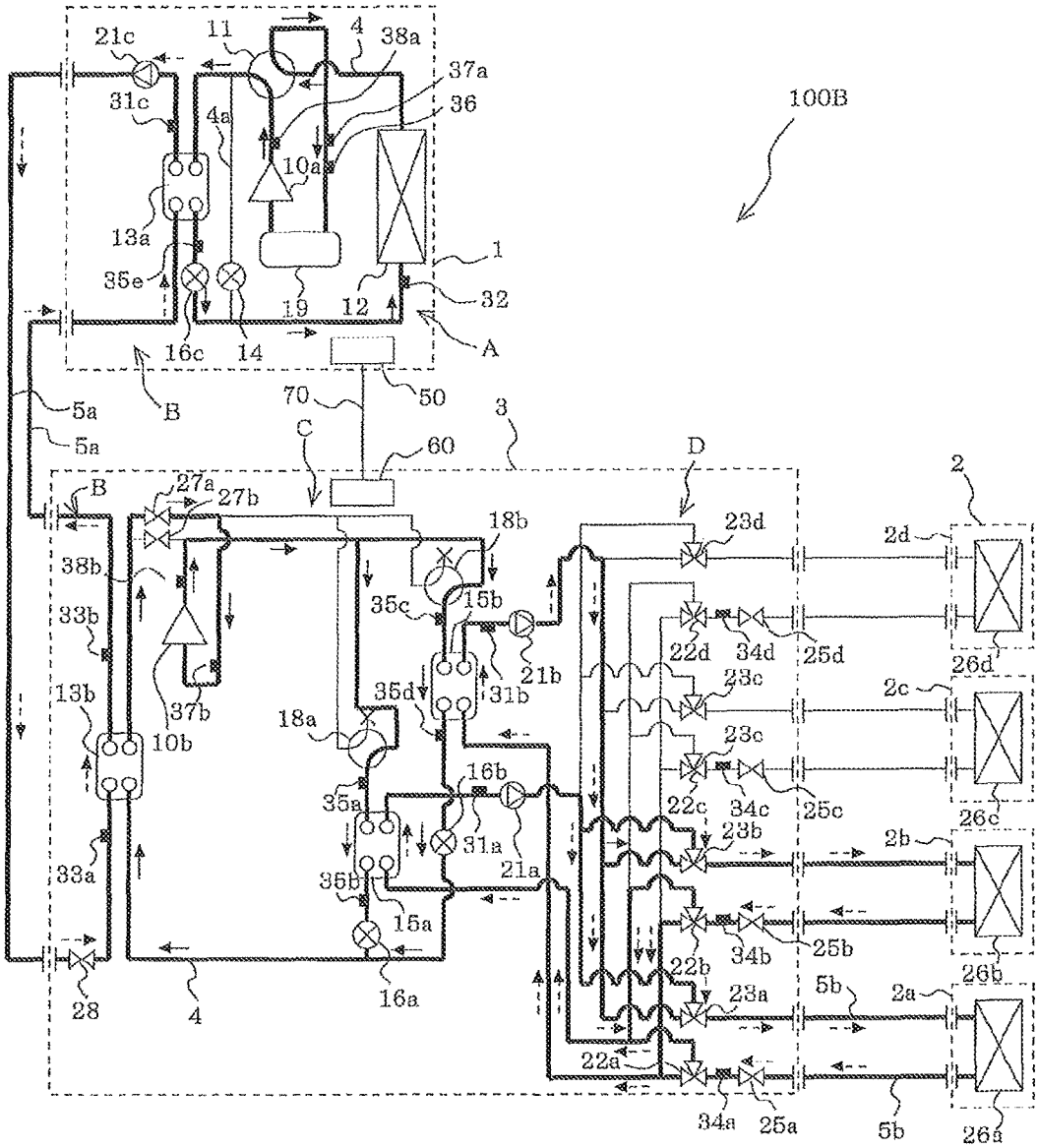
FIG. 13 is a system circuit diagram showing the flow of the refrigerant and the heat transfer medium in the air-conditioning apparatus according to Embodiment 3 of the present invention, in the heating-only operation.

FIG. 13 is a system circuit diagram showing the flow of the refrigerant and the heat transfer medium in the air-conditioning apparatus 100B, in the heating-only operation. Referring to FIG. 13, the heating-only operation mode will be described on the assumption that the heating load has arisen only in the use side heat exchanger 26*a* and the use side heat exchanger 26*b*. In FIG. 13, the pipes illustrated in bold lines represent the pipes in which the refrigerant and the heat transfer medium flow. In addition, in FIG. 13, the flow of the refrigerant is indicated by solid arrows and the flow of the heat transfer medium is indicated by broken-line arrows.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* is branched and flows into the first intermediate heat exchanger 15*a* and the first intermediate heat exchanger 15*b* acting as a condenser, through the second refrigerant flow switching device 18*a* and the second refrigerant flow switching device 18*b*.

The high-temperature/high-pressure gas refrigerant which has entered the first intermediate heat exchanger 15*a* and the first intermediate heat exchanger 15*b* is condensed and liquefied while transferring heat to the first heat transfer medium circulating in the first heat transfer medium circuit D, thereby turning into high-pressure liquid refrigerant. In this process the flow path is formed so that the first heat transfer medium and the first refrigerant flow in opposite directions to each other in the first intermediate heat exchanger 15*a* and the first intermediate heat exchanger 15*b*.

The liquid refrigerant which has flowed out of the first intermediate heat exchanger 15*a* and the first intermediate heat exchanger 15*b* is expanded in the first expansion device 16*a* and the first expansion device 16*b*, thus to turn into low-temperature/low-pressure two-phase refrigerant, and then joined with each other. The low-temperature/low-pressure two-phase refrigerant joined as above flows into the second intermediate heat exchanger 13*b* acting as an evaporator. The refrigerant which has entered the second intermediate heat exchanger 13*b* removes heat from the second heat transfer medium flowing in the second heat transfer medium circuit B, thereby turning into low-temperature/low-pressure gas refrigerant, and is again sucked into the compressor 10*b* through the first refrigerant flow switching device 27*a*. In this process the flow path is formed so that the first refrigerant and the second heat transfer medium flow parallel to each other in the second intermediate heat exchanger 13*b*. At this point, the first refrigerant flow switching device 27*a* is opened and the first refrigerant flow switching device 27*b* is closed.

[Cooling-Main Operation Mode]

Figure 14:
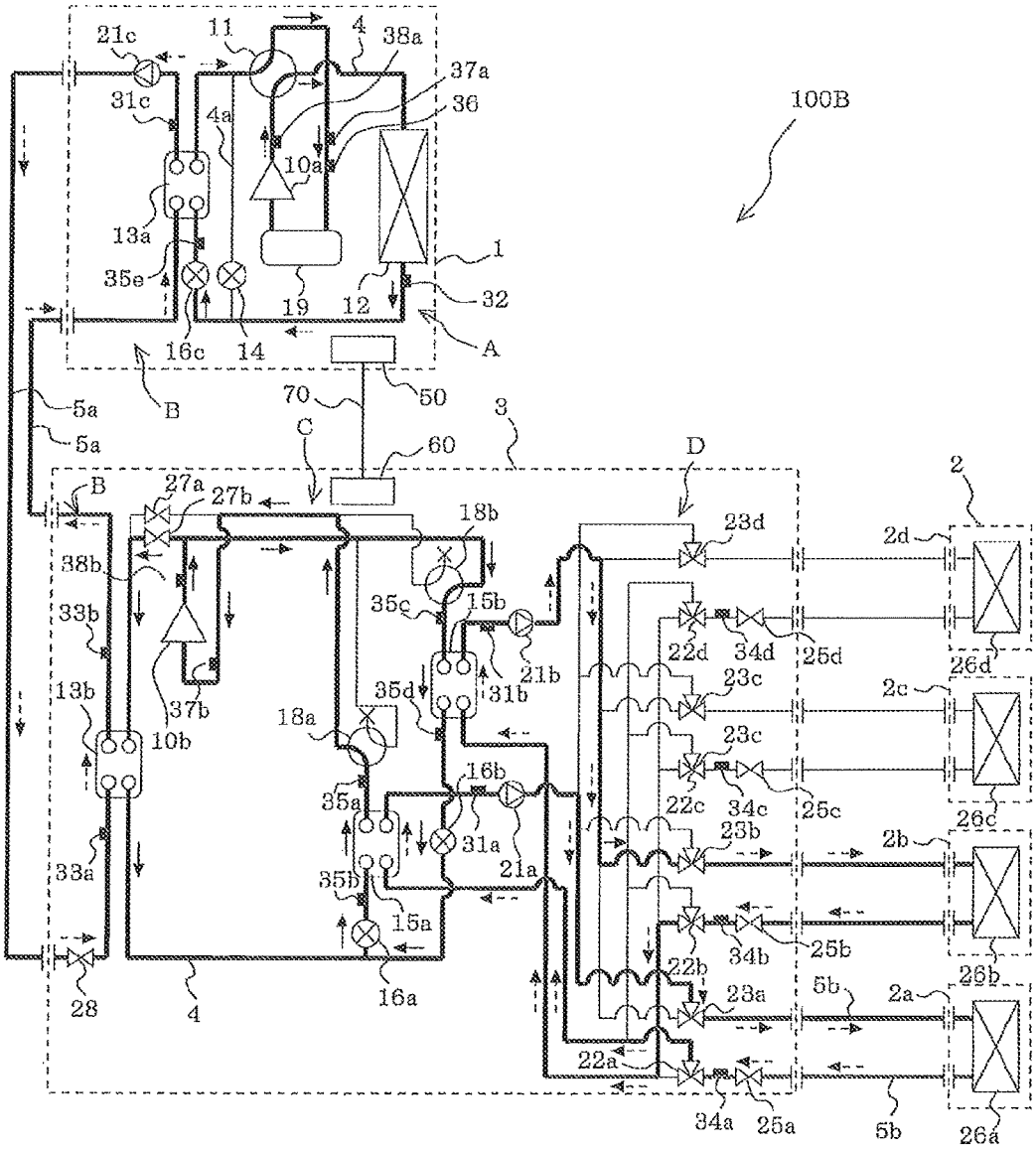
FIG. 14 is a system circuit diagram showing the flow of the refrigerant and the heat transfer medium in the air-conditioning apparatus according to Embodiment 3 of the present invention, in the cooling-main operation.

FIG. 14 is a system circuit diagram showing the flow of the refrigerant and the heat transfer medium in the air-conditioning apparatus 100B, in the cooling-main operation. Referring to FIG. 14, the cooling-main operation mode will be described on the assumption that the cooling load has arisen in the use side heat exchanger 26*a* and the heating load has arisen in the use side heat exchanger 26*b*. In FIG. 14, the pipes illustrated in bold lines represent the pipes in which the refrigerant and the heat transfer medium flow. In addition, in FIG. 14, the flow of the refrigerant is indicated by solid arrows and the flow of the heat transfer medium is indicated by broken-line arrows.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* is branched into the refrigerant flowing into the second intermediate heat exchanger 13*b* acting as a first condenser through the first refrigerant flow switching device 27*b* and the refrigerant flowing into the first intermediate heat exchanger 15*b* acting as a second condenser through the second refrigerant flow switching device 18*b*.

The refrigerant that has entered the second intermediate heat exchanger 13*b* acting as the first condenser through the first refrigerant flow switching device 27*b* is condensed while transferring heat to the second heat transfer medium in the second intermediate heat exchanger 13*b*, thereby turning into high-pressure refrigerant. In this process the flow path is formed so that the second heat transfer medium and the first refrigerant flow in opposite directions to each other in the second intermediate heat exchanger 13*b*.

The high-pressure two-phase gas refrigerant branched on the discharge side of the compressor 10*b* and introduced into the first intermediate heat exchanger 15*b* acting as the second condenser through the second refrigerant flow switching device 18*b* is condensed and liquefied while transferring heat to the first heat transfer medium circulating in the first heat transfer medium circuit D, thereby turning into liquid refrigerant. In this process the flow path is formed so that the first refrigerant and the first heat transfer medium flow in opposite directions to each other in the first intermediate heat exchanger 15*b*.

The liquid refrigerant that has flowed out of the first intermediate heat exchanger 15*b* passes through the fully opened first expansion device 16*b* and joins with the high-pressure liquid refrigerant that has flowed out of the second intermediate heat exchanger 13*b*. The liquid refrigerant joined with each other is expanded in the first expansion device 16*a* thus to turn into low-pressure two-phase refrigerant, and flows into the first intermediate heat exchanger 15*a* acting as an evaporator. The low-pressure two-phase refrigerant which has entered the first intermediate heat exchanger 15*a* cools the first heat transfer medium circulating in the first heat transfer medium circuit D by removing heat from the first heat transfer medium, thereby turning into low-pressure gas refrigerant. In this process the flow path is formed so that the first refrigerant and the first heat transfer medium flow parallel to each other in the first intermediate heat exchanger 15*a*.

The gas refrigerant which has flowed out of the first intermediate heat exchanger 15*a* is again sucked into the compressor 10*b* through the second refrigerant flow switching device 18*a*. At this point, the first refrigerant flow switching device 27*a* is closed, the first refrigerant flow switching device 27*b* is opened. The first expansion device 16*b* is fully opened, and the opening degree of the first expansion device 16*a* is controlled to keep a degree of superheating at a constant level, the degree of superheating representing a difference between the temperature detected by the intermediate heat exchanger refrigerant temperature sensor 35*a* and the temperature detected by the intermediate heat exchanger refrigerant temperature sensor 35*b*. Alternatively, the opening degree of the first expansion device 16*a* may be controlled to keep a degree of subcooling at a constant level, the degree of subcooling representing a difference between a saturation temperature converted from the pressure detected by the high-pressure refrigerant pressure sensor 38*b* and the temperature detected by the intermediate heat exchanger refrigerant temperature sensor 35*d*.

[Heating-Main Operation Mode]

Figure 15:
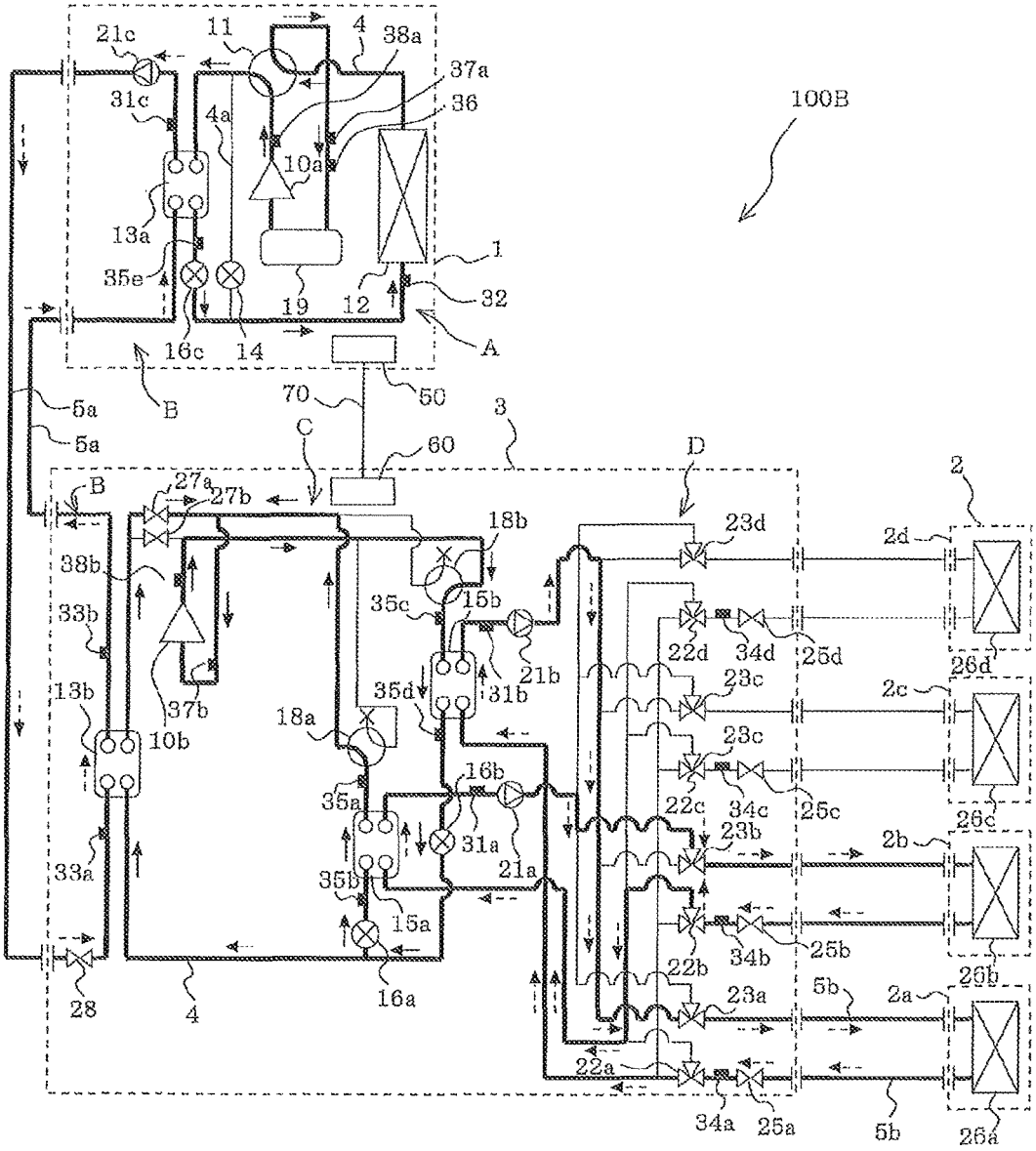
FIG. 15 is a system circuit diagram showing the flow of the refrigerant and the heat transfer medium in the air-conditioning apparatus according to Embodiment 3 of the present invention, in the heating-main operation.

FIG. 15 is a system circuit diagram showing the flow of the refrigerant and the heat transfer medium in the air-conditioning apparatus 100B, in the heating-main operation. Referring to FIG. 15, the cooling-main operation mode will be described on the assumption that the heating load has arisen in the use side heat exchanger 26*a* and the cooling load has arisen in the use side heat exchanger 26*b*. In FIG. 15, the pipes illustrated in bold lines represent the pipes in which the refrigerant and the heat transfer medium flow. In addition, in FIG. 15, the flow of the refrigerant is indicated by solid arrows and the flow of the heat transfer medium is indicated by broken-line arrows.

The first refrigerant in a low-temperature/low-pressure state is compressed by the compressor 10*b* and discharged therefrom in the form of high-temperature/high-pressure gas refrigerant. The high-temperature/high-pressure gas refrigerant discharged from the compressor 10*b* flows into the first intermediate heat exchanger 15*b* acting as a condenser, through the second refrigerant flow switching device 18*b*. The gas refrigerant which has entered the first intermediate heat exchanger 15*b* is condensed and liquefied while transferring heat to the first heat transfer medium circulating in the first heat transfer medium circuit D, thereby turning into liquid refrigerant. In this process the flow path is formed so that the first heat transfer medium and the first refrigerant flow in opposite directions to each other in the first intermediate heat exchanger 15*b*.

The liquid refrigerant which has flowed out of the first intermediate heat exchanger 15*b* is expanded in the first expansion device 16*b* thus to turn into low-pressure two-phase refrigerant, and then branched into the refrigerant flowing into the first intermediate heat exchanger 15*a* acting as an evaporator through the fully opened first expansion device 16*a* and the refrigerant flowing into the second intermediate heat exchanger 13*b* acting as an evaporator.

The low-pressure two-phase refrigerant that has entered the first intermediate heat exchanger 15*a* acting as an evaporator through the fully opened first expansion device 16*a* is evaporated upon removing heat from the heat transfer medium circulating in the first heat transfer medium circuit D, thereby cooling the first heat transfer medium and turning into low-temperature/low-pressure gas refrigerant. The refrigerant that has entered the second intermediate heat exchanger 13*b* removes heat from the second heat transfer medium circulating in the second heat transfer medium circuit B, thereby turning into low-temperature/low-pressure gas refrigerant.

Thereafter, the low-temperature/low-pressure gas refrigerant that has flowed out of the first intermediate heat exchanger 15*a* passes through the second refrigerant flow switching device 18*a* and then flows out of the second intermediate heat exchanger 13*b*, and joins with the low-temperature/low-pressure gas refrigerant that has passed through the first refrigerant flow switching device 27*a* and is again sucked into the compressor 10*b*. In this process the flow path is formed so that the refrigerant and the heat transfer medium flow parallel to each other in the first intermediate heat exchanger 15*a* and in the second intermediate heat exchanger 13*b*.

At this point, the first refrigerant flow switching device 27*a* is opened, the first refrigerant flow switching device 27*b* is closed, the first expansion device 16*a* is fully opened, and the opening degree of the first expansion device 16*b* is controlled to keep a degree of subcooling at a constant level, the degree of subcooling representing a difference between a saturation temperature converted from the pressure detected by the high-pressure refrigerant pressure sensor 38*b* and the temperature detected by the intermediate heat exchanger refrigerant temperature sensor 35*d*.

With the configuration of the air-conditioning apparatus 100B, the flow rate of the refrigerant flowing in the second intermediate heat exchanger 13*b* and the flow rate of the refrigerant flowing in the first intermediate heat exchanger 15*a* are unable to dynamically control, but are determined depending on the flow resistance of the pipe. Accordingly, it is preferable to provide a non-illustrated additional expansion device in the refrigerant flow path on the inlet side of the second intermediate heat exchanger 13*b*, because in this case the flow rate of the refrigerant flowing in the second intermediate heat exchanger 13*b* and the flow rate of the refrigerant flowing in the first intermediate heat exchanger 15*a* can be adjusted by controlling both of the additional expansion device and the first expansion device 16*a*, and thus the intermediate heat exchanger can be more effectively utilized.

As described above, air-conditioning apparatus 100B provides the same advantageous effects as those provided by the air-conditioning apparatus 100. The configuration according to Embodiment 2 may also be incorporated in the air-conditioning apparatus 100B. In this case, the third intermediate heat exchanger 13*a* can be prevented from bursting and the power consumption by the pump 21*c* can be reduced, and further an energy-saving effect can be attained.

REFERENCE SIGNS LIST

1: outdoor unit, 2: indoor unit, 2*a*: indoor unit, 2*b*: indoor unit, 2*c*: indoor unit, 2*d*: indoor unit, 3: relay unit, 3*a*: relay unit, 3*b*: relay unit, 4: refrigerant pipe, 4*a*: refrigerant pipe, 4*b*: refrigerant pipe, 4*c*: refrigerant pipe, 5*a*: heat transfer medium pipe (second heat transfer medium pipe), 5*b*: heat transfer medium pipe (first heat transfer medium pipe), 5*c*: bypass pipe, 6: outdoor space, 7: indoor space, 8: space, 9: building, 10*a*: compressor (second compressor), 10*b*: compressor (first compressor), 11: third refrigerant flow switching device, 12: heat source-side heat exchanger, 13*a*: third intermediate heat exchanger, 13*b*: second intermediate heat exchanger, 14: bypass flow control device, 15: first intermediate heat exchanger, 15*a*: first intermediate heat exchanger, 15*b*: first intermediate heat exchanger, 16: first expansion device, 16*a*: first expansion device, 16*b*: first expansion device, 16*c*: second expansion device, 17: open/close device, 17*a*: open/close device, 17*b*: open/close device, 18: second refrigerant flow switching device, 18*a*: second refrigerant flow switching device, 18*b*: second refrigerant flow switching device, 21: pump, 21*a*: pump, 21*b*: pump, 21*c*: pump, 22: first heat transfer medium flow switching device, 22*a*: first heat transfer medium flow switching device, 22*b*: first heat transfer medium flow switching device, 22*c*: first heat transfer medium flow switching device, 22*d*: first heat transfer medium flow switching device, 23: second heat transfer medium flow switching device, 23*a*: second heat transfer medium flow switching device, 23*b*: second heat transfer medium flow switching device, 23*c*: second heat transfer medium flow switching device, 23*d*: second heat transfer medium flow switching device, 24*a*: check valve, 24*b*: check valve, 24*c*: check valve, 24*d*: check valve, 25: first heat transfer medium flow control device, 25*a*: first heat transfer medium flow control device, 25*b*: first heat transfer medium flow control device, 25*c*: first heat transfer medium flow control device, 25*d*: first heat transfer medium flow control device, 26: use-side heat exchanger, 26*a*: use-side heat exchanger, 26*b*: use-side heat exchanger, 26*c*: use-side heat exchanger, 26*d*: use-side heat exchanger, 27: first refrigerant flow switching device, 27*a*: first refrigerant flow switching device, 27*b*: first refrigerant flow switching device, 28: second heat transfer medium flow control device, 29: third heat transfer medium flow switching device, 31: intermediate heat exchanger outlet temperature sensor, 31*a*: intermediate heat exchanger outlet temperature sensor, 31*b*: intermediate heat exchanger outlet temperature sensor, 31*c*: intermediate heat exchanger outlet temperature sensor, 32: heat source-side heat exchanger outlet refrigerant temperature sensor, 33*a*: intermediate heat exchanger temperature sensor, 33*b*: intermediate heat exchanger temperature sensor, 34: use-side heat exchanger outlet temperature sensor, 34*a*: use-side heat exchanger outlet temperature sensor, 34*b*: use-side heat exchanger outlet temperature sensor, 34*c*: use-side heat exchanger outlet temperature sensor, 34*d*: use-side heat exchanger outlet temperature sensor, 35: intermediate heat exchanger refrigerant temperature sensor, 35*a*: intermediate heat exchanger refrigerant temperature sensor, 35*b*: intermediate heat exchanger refrigerant temperature sensor, 35*c*: intermediate heat exchanger refrigerant temperature sensor, 35*d*: intermediate heat exchanger refrigerant temperature sensor, 35*e*: intermediate heat exchanger refrigerant temperature sensor, 36: compressor-sucked refrigerant temperature sensor, 37*a*: low-pressure refrigerant pressure sensor, 37*b*: low-pressure refrigerant pressure sensor, 38*a*: high-pressure refrigerant pressure sensor, 38*b*: high-pressure refrigerant pressure sensor, 50: controller (second controller), 60: controller (first controller), 70: communication line, 100: air-conditioning apparatus, 100A: air-conditioning apparatus, 100B: air-conditioning apparatus, A: second refrigerant circuit, B: second heat transfer medium circuit, C: first refrigerant circuit, D: first heat transfer medium circuit

The invention claimed is:

1. An air-conditioning apparatus comprising:

a plurality of indoor units, wherein each indoor unit is configured to be installed inside a building at a position that allows the indoor units to condition air in a space to be air-conditioned and including a use-side heat exchanger;

a relay unit configured to be installed in a space not to be air-conditioned and different from the space to be air-conditioned; and an outdoor unit configured to be installed in one of an outdoor space outside the building and a space inside the building communicating with the outdoor space, wherein the relay unit and the plurality of indoor units are connected to each other via a first heat transfer medium pipe in which a first heat transfer medium that transports heating energy or cooling energy flows, the outdoor unit and the relay unit are connected to each other via a second heat transfer medium pipe in which a second heat transfer medium that transports heating energy or cooling energy flows, the relay unit includes:

a first compressor;

a first refrigerant flow switching device;

a plurality of first intermediate heat exchangers;

a second refrigerant flow switching device associated with each of the plurality of first intermediate heat exchangers;

a plurality of first expansion devices that depressurize a first refrigerant that shifts between two phases or turns into a supercritical state during operation; and a second intermediate heat exchanger, wherein the first compressor, the first refrigerant flow switching device, a refrigerant flow path in the plurality of first intermediate heat exchangers, the second refrigerant flow switching device, the plurality of first expansion devices, and a refrigerant flow path in the second intermediate heat exchanger are connected via a first refrigerant pipe in which the first refrigerant that shifts between two phases or turns into a supercritical state flows, to form a first refrigerant circuit, the first heat transfer medium is allowed to circulate through a heat transfer medium flow path in the plurality of first intermediate heat exchangers, a plurality of first heat transfer medium feeding devices that feed the first heat transfer medium, and the plurality of use-side heat exchangers, to form a first heat transfer medium circuit, cooling of the first heat transfer medium and heating of the first heat transfer medium are performed at the same time utilizing at least one of the first refrigerant flow switching device and the second refrigerant flow switching device, a first heat transfer medium flow switching device is provided between the plurality of first intermediate heat exchangers and the plurality of use-side heat exchangers, the first heat transfer medium flow switching device is configured to separately distribute the heated first heat transfer medium and the cooled first heat transfer medium to at least one of the indoor units, and the outdoor unit is configured to control a temperature of the second heat transfer medium, the air-conditioning apparatus further comprising a cooling and heating mixed operation mode in which, in the relay unit, heat is removed from or rejected to the second heat transfer medium utilizing evaporation heat or condensation heat of the first refrigerant, the first heat transfer medium is cooled with the evaporation heat of the first refrigerant in at least one of the plurality of first intermediate heat exchangers, and the first heat transfer medium is heated with the condensation heat of the first refrigerant in at least one of the rest of first intermediate heat exchangers, wherein both of a frequency of the first compressor and a flow rate of the second heat transfer medium flowing into the second intermediate heat exchanger are controlled in the cooling and heating mixed operation mode to:

cause both of the evaporation temperature of the first refrigerant flowing in the refrigerant flow path for cooling the first heat transfer medium in the first intermediate heat exchanger and the condensation temperature of the first refrigerant flowing in the refrigerant flow path for heating the first heat transfer medium in the first intermediate heat exchanger to approach respective target values, or cause both of a temperature of the first heat transfer medium cooled in the first intermediate heat exchanger cooling the first heat transfer medium and a temperature of the first heat transfer medium heated in the first intermediate heat exchanger heating the first heat transfer medium to approach respective target values.

2. The air-conditioning apparatus of claim 1, wherein a temperature of the first heat transfer medium heated by the first intermediate heat exchanger heating the first heat transfer medium is higher than a temperature of the second heat transfer medium, and a temperature of the first heat transfer medium cooled by the first intermediate heat exchanger cooling the first heat transfer medium is lower than a temperature of the second heat transfer medium.

3. The air-conditioning apparatus of claim 2, wherein the temperature of the second heat transfer medium is not lower than 10 degrees Celsius and not higher than 40 degrees Celsius.

4. The air-conditioning apparatus of claim 1, wherein the relay unit and the plurality of indoor units are connected to each other via a pair of the first heat transfer medium pipes, the relay unit is connected via a pair of the second heat transfer medium pipes, and waste heat of the first refrigerant circuit is discharged to the outdoor space via the second heat transfer medium, through heat exchange in the second intermediate heat exchanger between the first refrigerant and the second heat transfer medium.

5. The air-conditioning apparatus of claim 1, further comprising:

a second heat transfer medium circuit formed by connecting, via a second heat transfer medium pipe in which the second heat transfer medium flows, a heat transfer medium flow path in the second intermediate heat exchanger, a heat transfer medium flow path in a third intermediate heat exchanger, and a second heat transfer medium feeding device connected; and a second refrigerant circuit formed by connecting, via a second refrigerant pipe in which the second refrigerant flows, a second compressor, a third refrigerant flow switching device, a refrigerant flow path in the third intermediate heat exchanger, a second expansion device that depressurizes a second refrigerant that shifts between two phases or turns into a supercritical state during operation, and a heat source-side heat exchanger, wherein the second compressor, the third refrigerant flow switching device, the third intermediate heat exchanger, the second expansion device, and the heat source-side heat exchanger are accommodated in the outdoor unit, the first compressor, the first refrigerant flow switching device, the second refrigerant flow switching device, the plurality of first intermediate heat exchangers, the plurality of first expansion devices, the second intermediate heat exchanger, the plurality of first heat transfer medium feeding devices, and the plurality of first heat transfer medium flow switching devices are accommodated in the relay unit, the use-side heat exchanger is accommodated in the plurality of indoor units, the first heat transfer medium circuit and the second heat transfer medium circuit are formed to restrict the first heat transfer medium and the second heat transfer medium from being mixed with each other, the relay unit includes a first controller, and the first controller controls, in the cooling and heating mixed operation mode, both of the frequency of the first compressor and the flow rate of the second heat transfer medium flowing into the second intermediate heat exchanger, to cause the evaporation temperature of the first refrigerant flowing in the refrigerant flow path for cooling the first heat transfer medium in the first intermediate heat exchanger and the condensation temperature of the first refrigerant flowing in the refrigerant flow path for heating the first heat transfer medium in the first intermediate heat exchanger to approach respective target values.

6. The air-conditioning apparatus of claim 5, wherein the second heat transfer medium circuit includes a second heat transfer medium flow control device with variable opening degree, and the second heat transfer medium feeding device, a flow rate of the second heat transfer medium circulating in the second intermediate heat exchanger is controlled by adjusting the opening degree of the second heat transfer medium flow control device, and rotation speed of the second heat transfer medium feeding device is controlled according to the flow rate.

7. The air-conditioning apparatus of claim 6, further comprising a second controller, wherein the second heat transfer medium feeding device is connected to the second controller, the first controller and the second controller are connected to each other via a wired or wireless signal line, and the opening degree of the second heat transfer medium flow control device and rotation speed of the second heat transfer medium feeding device are controlled in conjunction with each other, through transmission and reception of information including at least the opening degree of the second heat transfer medium flow control device, between the first controller and the second controller.

8. The air-conditioning apparatus of claim 7, wherein the first refrigerant flow switching device in the relay unit and the third refrigerant flow switching device in the outdoor unit are controlled in conjunction with each other on the basis of a signal transmitted and received between the first controller and the second controller.

9. The air-conditioning apparatus of claim 5, wherein the second refrigerant used in the second refrigerant circuit is a highly flammable refrigerant having a global warming potential not higher than 50.

10. The air-conditioning apparatus of claim 5, further comprising a first bypass pipe disposed to connect between a position on a pipe connecting between an end of the second expansion device and an end of the refrigerant flow path in the third intermediate heat exchanger and between the other end of the second expansion device and the heat source-side heat exchanger, and a position on a pipe to which the other end of the third intermediate heat exchanger is connected.

11. The air-conditioning apparatus of claim 10, further comprising a defrosting operation mode in which the second refrigerant flowing out of the heat source-side heat exchanger is conducted to the other end of the third intermediate heat exchanger through the first bypass pipe, without being allowed to flow to the third intermediate heat exchanger.

12. The air-conditioning apparatus of claim 5, wherein the plurality of indoor units is enabled to perform at least one of the cooling operation and the cooling operation during the defrosting operation for the heat source-side heat exchanger, by causing the first heat transfer medium to circulate.

13. The air-conditioning apparatus of claim 5, wherein the outdoor unit includes a second bypass pipe connecting between a position on a flow path on the inlet side of the heat transfer medium flow path in the third intermediate heat exchanger and a position on a flow path on the outlet side of the heat transfer medium flow path in the third intermediate heat exchanger.

14. The air-conditioning apparatus of claim 13, wherein the second heat transfer medium flowing out of the third intermediate heat exchanger is caused to flow into the third intermediate heat exchanger through the second bypass pipe, in a defrosting operation.

15. The air-conditioning apparatus of claim 1, further comprising:

a cooling-only operation mode including generating only the first heat transfer medium cooled in the first intermediate heat exchanger;

a heating-only operation mode including generating only the first heat transfer medium heated in the first intermediate heat exchanger; and a heat transfer medium temperature sensor located on at least one of an inlet side and an outlet side of the heat transfer medium flow path in the second intermediate heat exchanger, wherein, in the cooling-only operation mode and the heating-only operation mode, the flow rate of the second heat transfer medium flowing into the second intermediate heat exchanger is controlled on the basis of a temperature detected by the heat transfer medium temperature sensor or a value calculated from the temperature detected by the heat transfer medium temperature sensor.

16. The air-conditioning apparatus of claim 1, wherein the first refrigerant used in the first refrigerant circuit is a low-flammable refrigerant having a global warming potential not higher than 50 and a burning rate not higher than 10 cm/s.

17. The air-conditioning apparatus of claim 1, wherein in the case where the first refrigerant is R-32, an amount of the first refrigerant not exceeding 1.8 kg is loaded in the refrigerant circuit, and in the case where the refrigerant is HFO-1234yf, an amount of the first refrigerant not exceeding 1.7 kg is loaded in the first refrigerant circuit.

18. The air-conditioning apparatus of claim 1, wherein the first refrigerant used in the first refrigerant circuit is propane, and an amount of the propane is not larger than 0.15 (kg).

19. The air-conditioning apparatus of claim 1, wherein an antifreeze solution is employed as the second heat transfer medium, and a liquid having lower viscosity than the second heat transfer medium is employed as the first heat transfer medium.

* * * * *